US011993423B2

(12) United States Patent
Tao et al.

(10) Patent No.: US 11,993,423 B2
(45) Date of Patent: May 28, 2024

(54) TAMPER-EVIDENT BAG SEAL

(71) Applicant: Inno-Pak, LLC, Delaware, OH (US)

(72) Inventors: Denny V. Tao, Katy, TX (US); Nathan W. Schultz, Westerville, OH (US); Steven A. Mayer, Indianapolis, IN (US)

(73) Assignee: Inno-Pak, LLC, Delaware, OH (US)

( * ) Notice: Subject to any disclaimer, the term of this patent is extended or adjusted under 35 U.S.C. 154(b) by 149 days.

(21) Appl. No.: 17/729,911

(22) Filed: Apr. 26, 2022

(65) Prior Publication Data

US 2022/0250801 A1 Aug. 11, 2022

Related U.S. Application Data

(63) Continuation-in-part of application No. 17/683,560, filed on Mar. 1, 2022, and a continuation-in-part of application No. 29/725,476, filed on Feb. 25, 2020, now Pat. No. Des. 949,686, which is a continuation-in-part of application No. 29/707,037, filed on Sep. 25, 2019, now Pat. No. Des. 949,010.

(51) Int. Cl.

| | |
|---|---|
| ***B65D 33/34*** | (2006.01) |
| ***B65D 33/12*** | (2006.01) |
| ***B65D 33/16*** | (2006.01) |

(52) U.S. Cl.

CPC ..... *B65D 33/34* (2013.01); *B65D 33/12* (2013.01); *B65D 33/1691* (2013.01)

(58) Field of Classification Search

CPC ..... B65D 33/34; B65D 33/12; B65D 33/1691
USPC ..... 383/205, 207–209
See application file for complete search history.

(56) References Cited

U.S. PATENT DOCUMENTS

| | | | |
|---|---|---|---|
| 1,410,404 | A | 3/1922 | Haines |
| 1,537,956 | A | 5/1925 | Meyers |
| 1,792,885 | A | 2/1931 | Andrews |
| 2,050,967 | A | 8/1936 | Farmer |
| 2,128,196 | A | 8/1938 | Vogel |

(Continued)

FOREIGN PATENT DOCUMENTS

| | | | |
|---|---|---|---|
| BR | 202013008295 | U2 | 3/2015 |
| CN | 2347943 | Y | 11/1999 |

(Continued)

OTHER PUBLICATIONS

Machine translation of JP-2017186073-A.*

(Continued)

*Primary Examiner* — Jes F Pascua
(74) *Attorney, Agent, or Firm* — Ward and Smith, P.A.; Ryan K. Simmons

(57) ABSTRACT

A tamper-evident bag seal. The tamper-evident bag seal may include a body having a length and a width, the body may include a first panel and a second panel, the first and second panels each having a first side and second side; a fold line extending along the length of the body dividing the first panel and the second panel; a tear strip disposed along a length of at least one of the first panel and second panel; vertical separation lines disposed along opposing end portions of at least one of the first panel and second panel; and a first adhesive strip disposed on the second side of the first panel and a second adhesive strip disposed on the second side of the second panel.

26 Claims, 48 Drawing Sheets

(56) References Cited

U.S. PATENT DOCUMENTS

| | | | | |
|---|---|---|---|---|
| 2,149,030 | A | 2/1939 | Arlington | |
| 2,355,786 | A | 8/1944 | Dreher | |
| 2,693,836 | A | 11/1954 | Hayes | |
| 2,765,974 | A * | 10/1956 | Phipps | B65D 77/12 383/203 |
| 2,846,134 | A | 8/1958 | Esber | |
| 2,934,255 | A | 4/1960 | McDuffie | |
| 3,141,601 | A | 7/1964 | Ayres | |
| 3,203,621 | A | 8/1965 | Wright | |
| 3,215,335 | A * | 11/1965 | Turpin | B65D 33/1691 383/83 |
| 3,215,336 | A * | 11/1965 | 111965 | B65D 75/68 426/123 |
| D205,970 | S | 10/1966 | Leifeld | |
| 3,545,668 | A | 12/1970 | Hultberg | |
| 3,730,421 | A | 5/1973 | Stanley | |
| 3,770,188 | A | 11/1973 | Bressickello | |
| D229,485 | S | 12/1973 | Petersen | |
| 3,811,613 | A | 5/1974 | Harrison | |
| D233,083 | S | 10/1974 | Rosa | |
| 4,243,171 | A | 1/1981 | Prin | |
| 4,276,982 | A | 7/1981 | Sibrava et al. | |
| D277,555 | S | 2/1985 | Pattillo | |
| 4,566,129 | A | 1/1986 | Mcnamee | |
| D290,025 | S | 5/1987 | Cole | |
| D293,694 | S | 1/1988 | Alden | |
| 4,723,300 | A | 2/1988 | Aranow | |
| 4,785,940 | A | 11/1988 | Wilson | |
| 4,790,670 | A | 12/1988 | Barbaro | |
| 4,946,093 | A | 8/1990 | Moorman | |
| 4,955,981 | A | 9/1990 | Provost | |
| 5,035,515 | A | 7/1991 | Crossman | |
| 5,096,113 | A | 3/1992 | Focke | |
| 5,205,649 | A | 4/1993 | Fullerton | |
| 5,226,941 | A | 7/1993 | Uibel | |
| D372,864 | S | 8/1996 | Hansen | |
| 5,608,949 | A | 3/1997 | Cooley et al. | |
| 5,711,751 | A | 1/1998 | Harmanoglu | |
| D394,675 | S | 5/1998 | Haas | |
| 5,824,380 | A | 10/1998 | Hagen | |
| 5,881,432 | A | 3/1999 | Good | |
| 6,176,615 | B1 | 1/2001 | Leimkuehler | |
| D438,797 | S | 3/2001 | Bozlee | |
| D442,085 | S | 5/2001 | Bozlee | |
| 6,286,681 | B1 | 9/2001 | Wilfong et al. | |
| D451,389 | S | 12/2001 | Bozlee | |
| 6,361,209 | B1 | 3/2002 | LaRue et al. | |
| D462,904 | S | 9/2002 | Mellon | |
| D501,134 | S | 1/2005 | Takahashi et al. | |
| D502,872 | S | 3/2005 | Fleming | |
| 6,913,389 | B2 | 7/2005 | Kannankeril et al. | |
| D510,601 | S | 10/2005 | Best | |
| 7,004,632 | B2 | 2/2006 | Hamilton et al. | |
| 7,090,272 | B2 | 8/2006 | Novakovich | |
| 7,427,161 | B2 | 9/2008 | Sill | |
| 8,033,447 | B2 | 10/2011 | Katoh | |
| D739,766 | S | 9/2015 | Glass et al. | |
| D751,907 | S | 3/2016 | Donadee | |
| 9,434,513 | B2 | 9/2016 | Lux et al. | |
| 9,630,748 | B2 | 4/2017 | Keller | |
| D786,976 | S | 5/2017 | Keating | |
| D801,826 | S | 11/2017 | O'Connor et al. | |
| D811,896 | S | 3/2018 | Wigman et al. | |
| D812,490 | S | 3/2018 | Wigman et al. | |
| D821,223 | S | 6/2018 | Tan | |
| D826,043 | S | 8/2018 | Dacey | |
| D828,763 | S | 9/2018 | Tan | |
| D830,849 | S | 10/2018 | Tan | |
| 10,259,616 | B2 | 4/2019 | Korinek et al. | |
| D860,807 | S | 9/2019 | Sill | |
| D864,752 | S | 10/2019 | Tan | |
| D894,799 | S | 9/2020 | Burroughs | |
| D949,010 | S | 4/2022 | Sill | |
| D949,686 | S | 4/2022 | Tao | |
| 11,358,754 | B2 | 6/2022 | Sill | |
| 11,377,264 | B2 | 7/2022 | Tan | |
| D970,339 | S | 11/2022 | Tao | |
| 11,548,690 | B2 | 1/2023 | Mayer | |
| 2003/0215165 | A1 | 11/2003 | Hogan | |
| 2005/0041894 | A1 | 2/2005 | Hanson | |
| 2005/0047686 | A1* | 3/2005 | Elsaesser | B65D 33/1691 383/62 |
| 2006/0045390 | A1* | 3/2006 | Sill | B65D 33/004 383/29 |
| 2006/0072855 | A1 | 4/2006 | Shaw | |
| 2006/0196787 | A1 | 9/2006 | Lewis | |
| 2007/0292053 | A1 | 12/2007 | Lin et al. | |
| 2008/0191538 | A1 | 8/2008 | Shaw | |
| 2013/0315507 | A1 | 11/2013 | Vidal et al. | |
| 2015/0360821 | A1 | 12/2015 | Greenwood et al. | |
| 2017/0166357 | A1 | 6/2017 | Chandaria | |
| 2017/0166358 | A1 | 6/2017 | Kapoor | |
| 2019/0112116 | A1 | 4/2019 | Su et al. | |
| 2019/0352055 | A1* | 11/2019 | Tan | B65D 33/24 |
| 2021/0086950 | A1 | 3/2021 | Sill | |
| 2021/0114775 | A1* | 4/2021 | Tan | B65D 33/12 |
| 2022/0153478 | A1 | 5/2022 | Mayer | |
| 2022/0185545 | A1 | 6/2022 | Tao | |
| 2022/0250801 | A1 | 8/2022 | Tao | |

FOREIGN PATENT DOCUMENTS

| | | | | |
|---|---|---|---|---|
| DE | 2733041 | A1 | 2/1978 | |
| DE | 29500157 | U1 | 2/1995 | |
| DE | 19831584 | A1 | 1/2000 | |
| DE | 10-2009-007985 | A1 | 2/2010 | |
| EP | 0515086 | A1 | 11/1992 | |
| FR | 2838406 | A1 | 10/2003 | |
| GB | 487330 | A | 6/1938 | |
| GB | 28382562 | A | 6/2003 | |
| JP | 2017-061324 | A | 3/2017 | |
| JP | 2017186073 | A * | 10/2017 | |
| NL | 1040069 | C2 | 8/2014 | |
| WO | 2004071890 | A1 | 8/2004 | |
| WO | WO-2022081471 | A1 * | 4/2022 | B65D 31/10 |

OTHER PUBLICATIONS

Handle Cuffs: Announced (Aug. 14, 2020 (online). Site visited (Apr. 22, 2023). Available from URL: https://www.innopak.com/products/handle-cuffs/.

Innopak Handle Cuffs: Announced (May 28, 2020). Site visited (Apr. 22, 2023). Available from URL: https://www.amazon.com/Inno-Pak/dp/B089B46C78?th=1.

InnoPak Handled Paper Carry Out Bags: Announced [Oct. 28, 2020]. Site visited [Jun. 1, 2022]. Available from Internet URL: https://www.innopak.com/products/handled-paper-carry-out-bags/.

International Search Report and Written Opinion from International Application No. PCT/US2019/030891, dated Jul. 26, 2019, 13 pages.

* cited by examiner

TAMPER-EVIDENT BAG SEAL

RELATED APPLICATIONS

This application is a continuation-in-part of U.S. patent application Ser. No. 29/725,476, filed Feb. 25, 2020, the application of which is a continuation-in-part of U.S. patent application Ser. No. 29/707,037, filed Sep. 25, 2019.

This application is also a continuation-in-part of U.S. patent application Ser. No. 17/683,560, filed Mar. 1, 2022, the application of which is a continuation of U.S. patent application Ser. No. 29/725,476, filed Feb. 25, 2020, which is a continuation-in-part of U.S. patent application Ser. No. 29/707,037, filed Sep. 25, 2019.

The disclosures of the above applications are incorporated herein by reference in their entireties.

TECHNICAL FIELD

The subject matter of the invention relates generally to secure containers, and more particularly to a tamper-evident bag seal including a tear-away strip and vertical perforations.

BACKGROUND

Disposable containers for packaging, distributing, displaying or otherwise housing consumer items, such as food containers, are becoming increasingly important. For example, bags, such as paper bags, are used for distributing and/or carrying food items, such as take out or to-go food containers. Sometimes it is desirable that an item or items, such as food containers, be placed in, for example, a bag for ease of transport. Unfortunately, it is a frequent occurrence that the containers may be tampered with by persons who wish to access the item or items in the containers. In taking steps to avoid this invasion of the container, many approaches in the nature of security and/or safety have been utilized. However, some of these security attempts have been easily circumvented and others have been very expensive.

One of the desirable features of security packaging is the characteristic that any tampering with the package produces a "tamper-evident" condition. With a "tamper-evident" condition, a consumer can visually detect that the container has been tampered. Unfortunately, many security attempts have been unsuccessful in that it is not fully evident that the security of the container has been breached. Consequently, new approaches are needed for incorporating tamper-evident features into containers.

SUMMARY

In one embodiment, a tamper-evident bag seal is provided. The tamper-evident bag seal may include a body having a length and a width, the body may include a first panel and a second panel, the first and second panels each having a first side and second side; a fold line extending along the length of the body dividing the first panel and the second panel; a tear strip disposed along a length of at least one of the first panel and second panel; vertical separation lines disposed along each opposing end portion of at least one of the first panel and second panel; and a first adhesive strip disposed on the second side of the first panel and a second adhesive strip disposed on the second side of the second panel. The first side of each of the first and second panel may include an outward facing side and the second side of each of the first and second panel may include a bag facing side, and wherein the first and second adhesive strips may be configured to secure the second side of each of the first and second panels to respective first and second sides of a bag. The tear strip may further include a tear strip reinforcement backing, wherein the tear strip reinforcement backing may include a length of backing material disposed along a backside of the tear strip. One or both of the first adhesive strip and the second adhesive strip may include a removable adhesive liner disposed atop an adhesive layer of the one or both of the first adhesive strip and the second adhesive strip, wherein removal of the removable adhesive liner exposes an adhesive layer. The vertical separation lines may extend vertically between a bottom edge of its respective first panel or second panel and the tear strip. The vertical separation lines may include perforations. The vertical separation lines may include two or more vertical separation lines disposed along each opposing end portion of at least one of the first panel and second panel. The corresponding ones of vertical separation lines disposed on opposing end portions may be spaced a distance substantially equal to that of a width of a bag upon which the tamper-evident bag seal is to be installed on. The tear strip may be disposed between the fold line and the first adhesive strip of the first panel. The tear strip may be disposed between the fold line and the second adhesive strip of the second panel. The tamper-evident bag seal may further include an opening provided along the first fold and disposed between the first panel and the second panel and substantially centered along the length of the body. The opening may be configured for receiving one or more handles of a bag therethrough. The removable adhesive liner may have a portion whose length is greater than the length of the body of the tamper-evident seal. The tamper-evident bag seal may further include a tear line along either or both sides of the tear strip. The tamper-evident bag seal may further include a first inside score line disposed along a length of a first side of the tear strip and a second inside score line disposed along a length of a second side of the tear strip, and a first outside score line offset from and extending a length of the first inside score line and a second outside score line offset from and extending a length of the second inside score line, wherein the first and second inside score lines are score lines partially cut through from the second side of the first and/or second panel upon which they are disposed, and the first and second outside score lines are score lines partially cut through from the first side of the first and/or second panel upon which they are disposed. The first and second inside score lines may form the side boundaries of the tear strip and the first and second outside score lines may be offset from and flank their respective first and second inside score lines. The first and second inside score lines and the first and second outside score lines may be parallel with one another. The first and second inside score lines may be score lines cut about 50% through from the second side of the first and/or second panel upon which they are disposed, and the first and second outside score lines may score lines cut about 50% through from the first side of the first and/or second panel upon which they are disposed. The tamper-evident bag seal when installed on the bag and sealed thereon may be configured to secure a contents of the bag therein, and wherein the contents of the bag cannot be accessed via the tamper-evident bag seal without causing the tamper-evident bag seal to indicate a tamper-evident condition.

In another embodiment, a method of using a tamper-evident bag seal to secure an opening of a bag is provided. The method may include, providing a tamper-evident bag seal; positioning the tamper-evident bag seal about an opening of a bag, such that outside side portions of the bag, with side gussets folded in, are aligned with corresponding ones of the vertical separation lines of the tamper-evident bag seal; folding the tamper-evident bag seal along the fold line such that the first adhesive strip and second adhesive strip come into contact with their respective outer surfaces of the bag; and sealing the opening of the bag with the tamper-evident bag seal thereby securing the contents within the bag. The first and second panels of the tamper-evident bag seal may be adhered to respective first and second sides of the bag via first and second adhesive strips of the first and second panels, and wherein portions of the first and second panels that overhang a width of the bag, may be adhered together via the first and second adhesive strips. The method may further include, upon sealing the opening of the bag with the tamper-evident bag seal the contents of the bag cannot be accessed via the tamper-evident bag seal without causing the tamper-evident bag seal to indicate a tamper-evident condition.

In yet another embodiment, a method of accessing contents of a bag secured with a tamper-evident bag seal installed thereon is provided. The method may include, providing a bag with contents therein and a tamper-evident bag seal installed thereon; removing a tear strip of the tamper-evident bag seal; tearing corresponding ones of the vertical separation lines disposed on the tamper-evident bag seal and that are aligned with outside most side edges of the bag; unfolding the first panel or second panel of the tamper-evident bag seal that includes the tear strip along the fold line; unfolding side gussets of the bag and opening a top opening of the bag; and accessing the contents within the bag. The contents of the bag cannot be accessed via the tamper-evident bag seal without causing the tamper-evident bag seal to indicate a tamper-evident condition

BRIEF DESCRIPTION OF THE DRAWINGS

Figure 1:
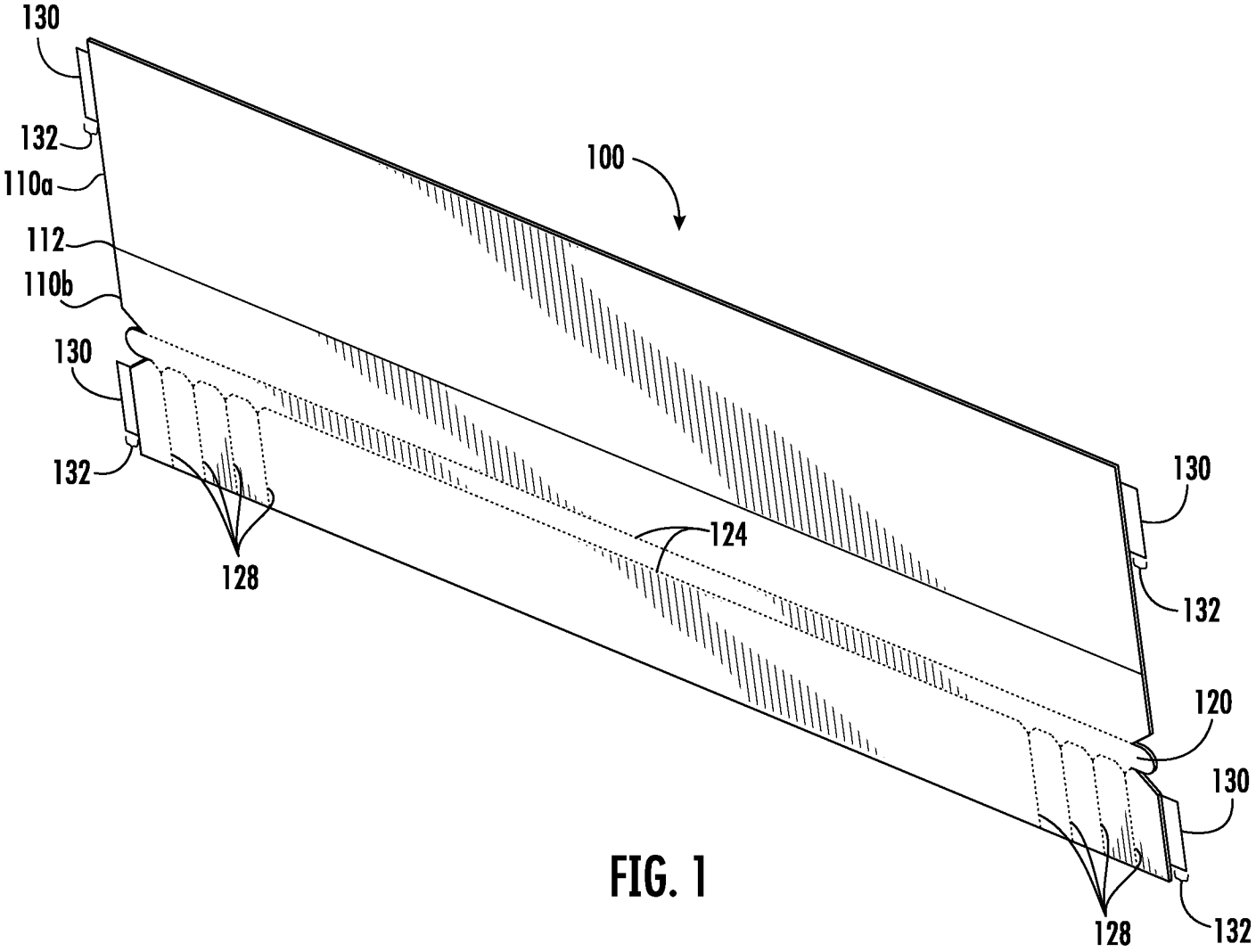
Figure 2:
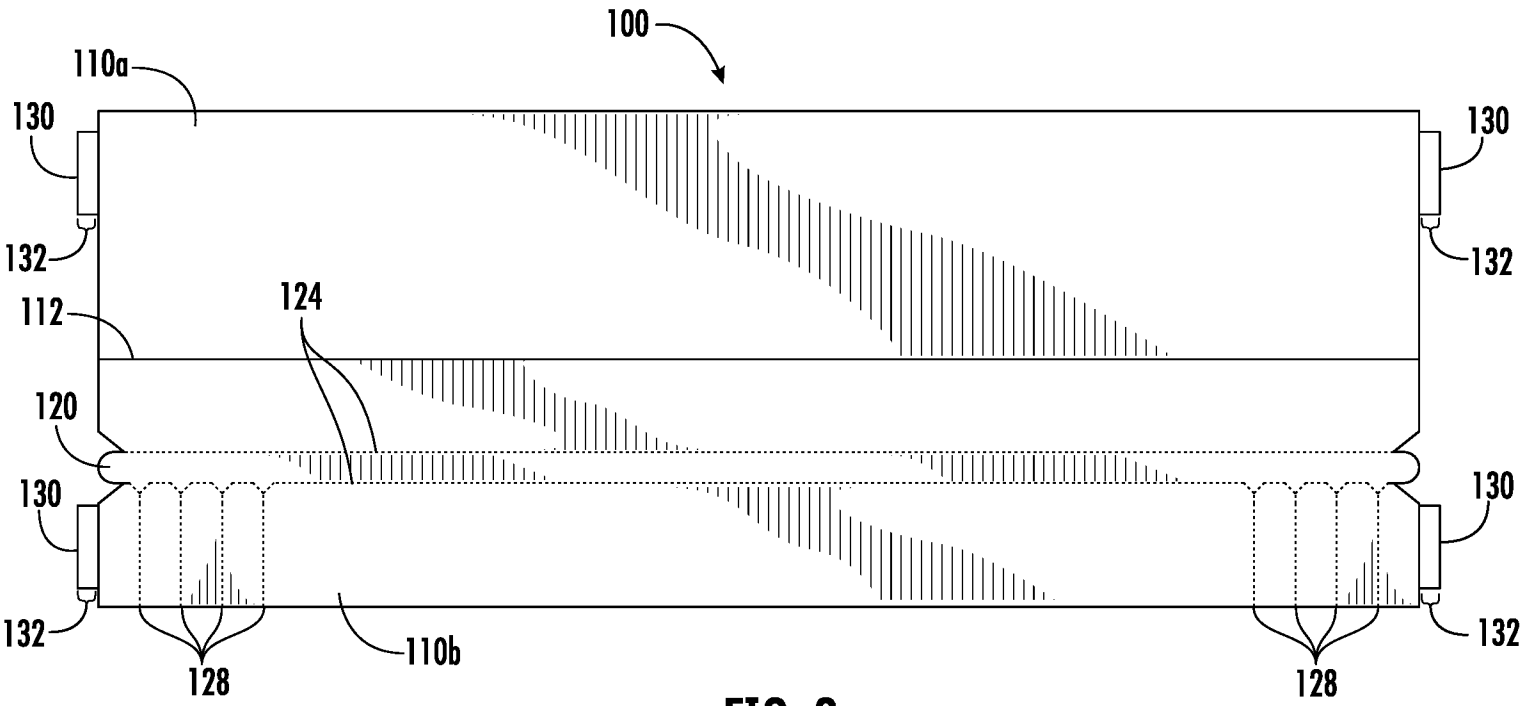
Figure 3:
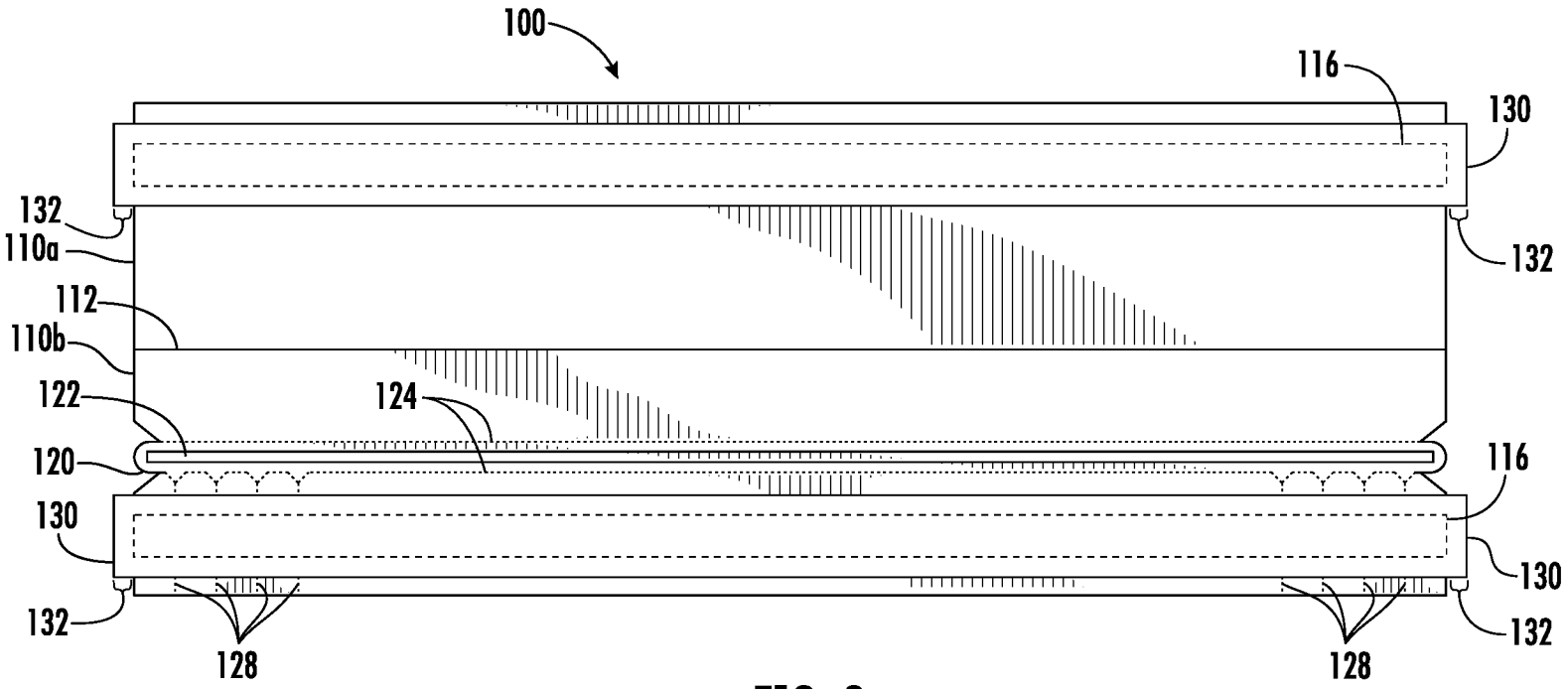
Figure 4:
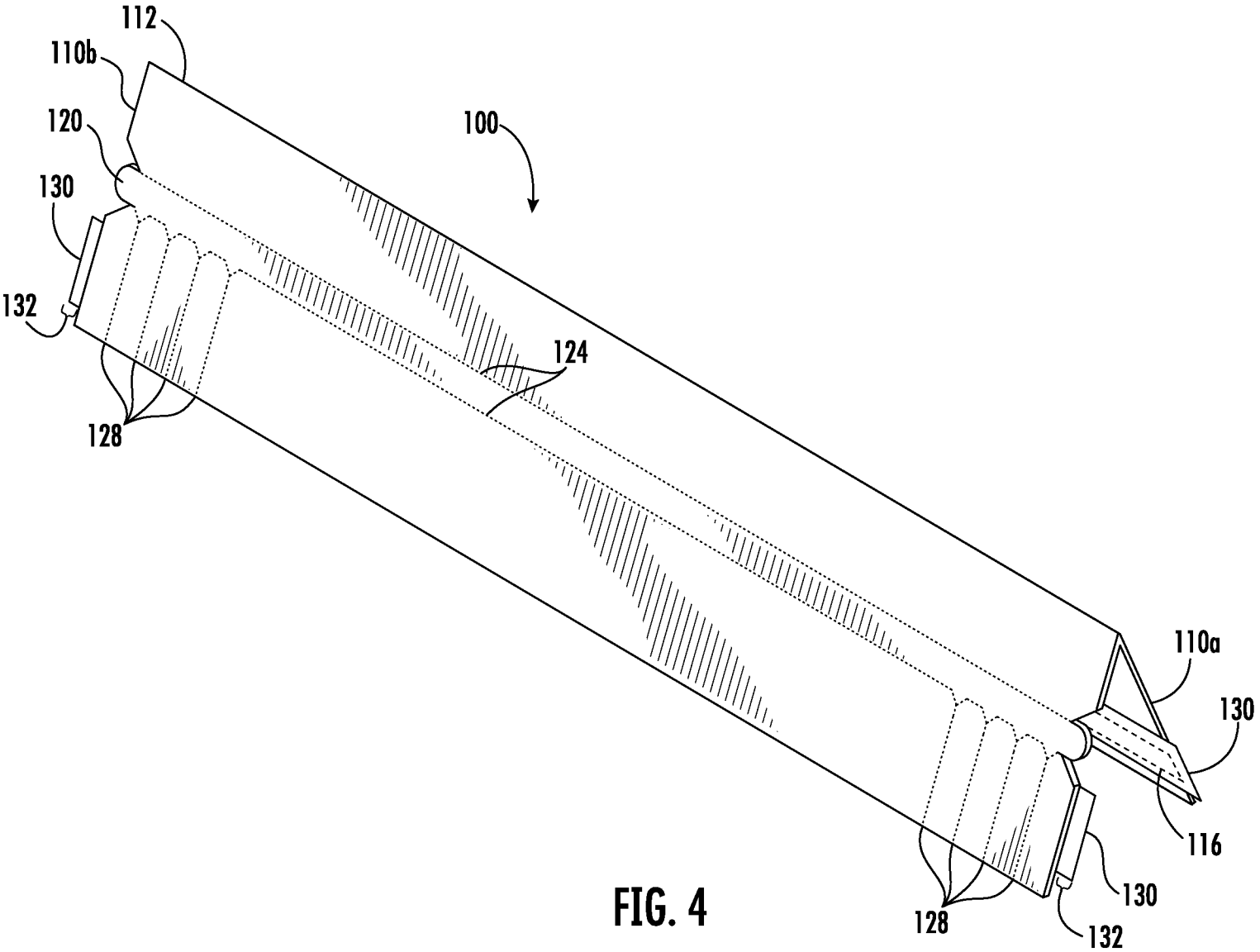
Figure 5:
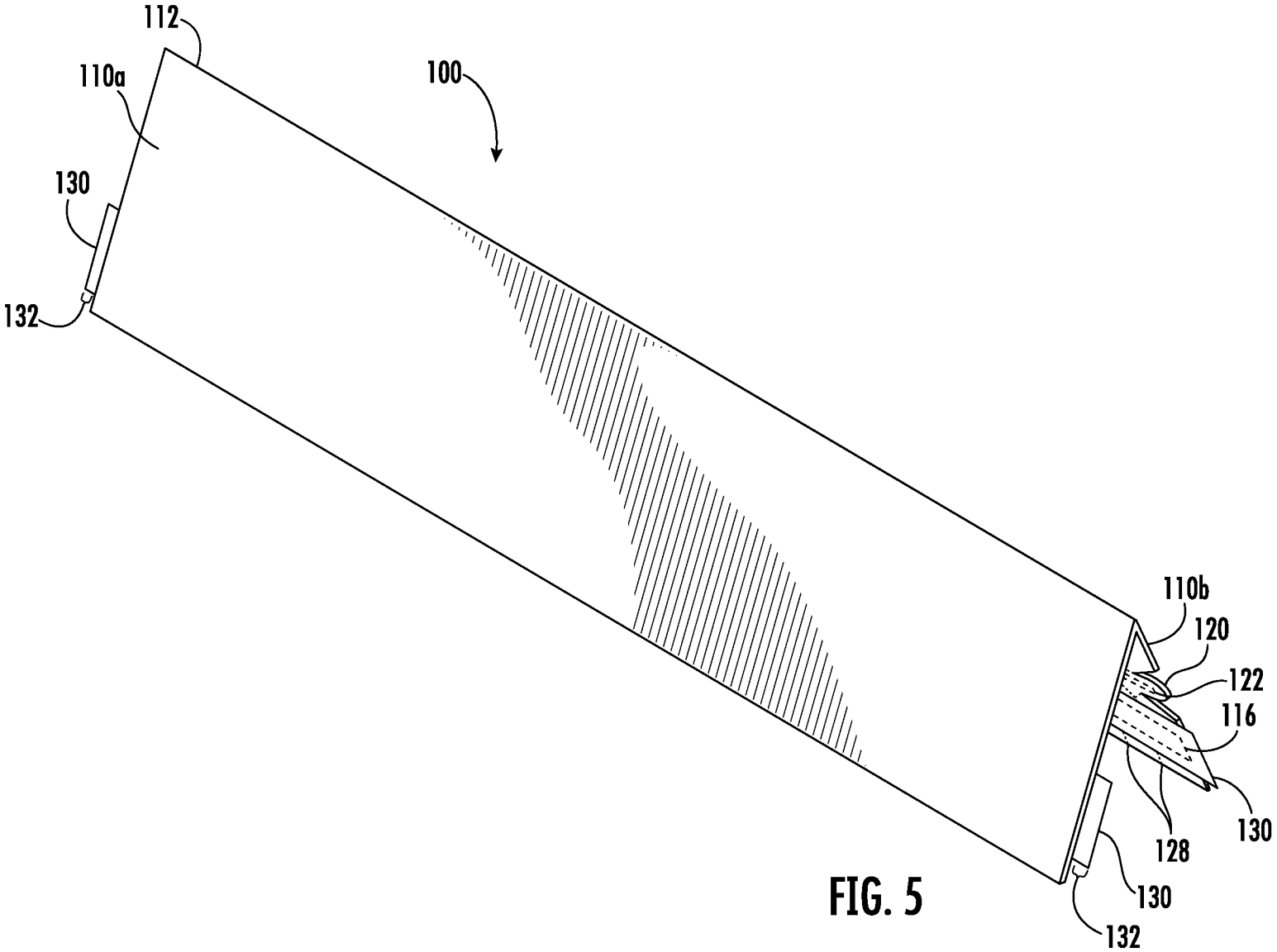
Figure 6:
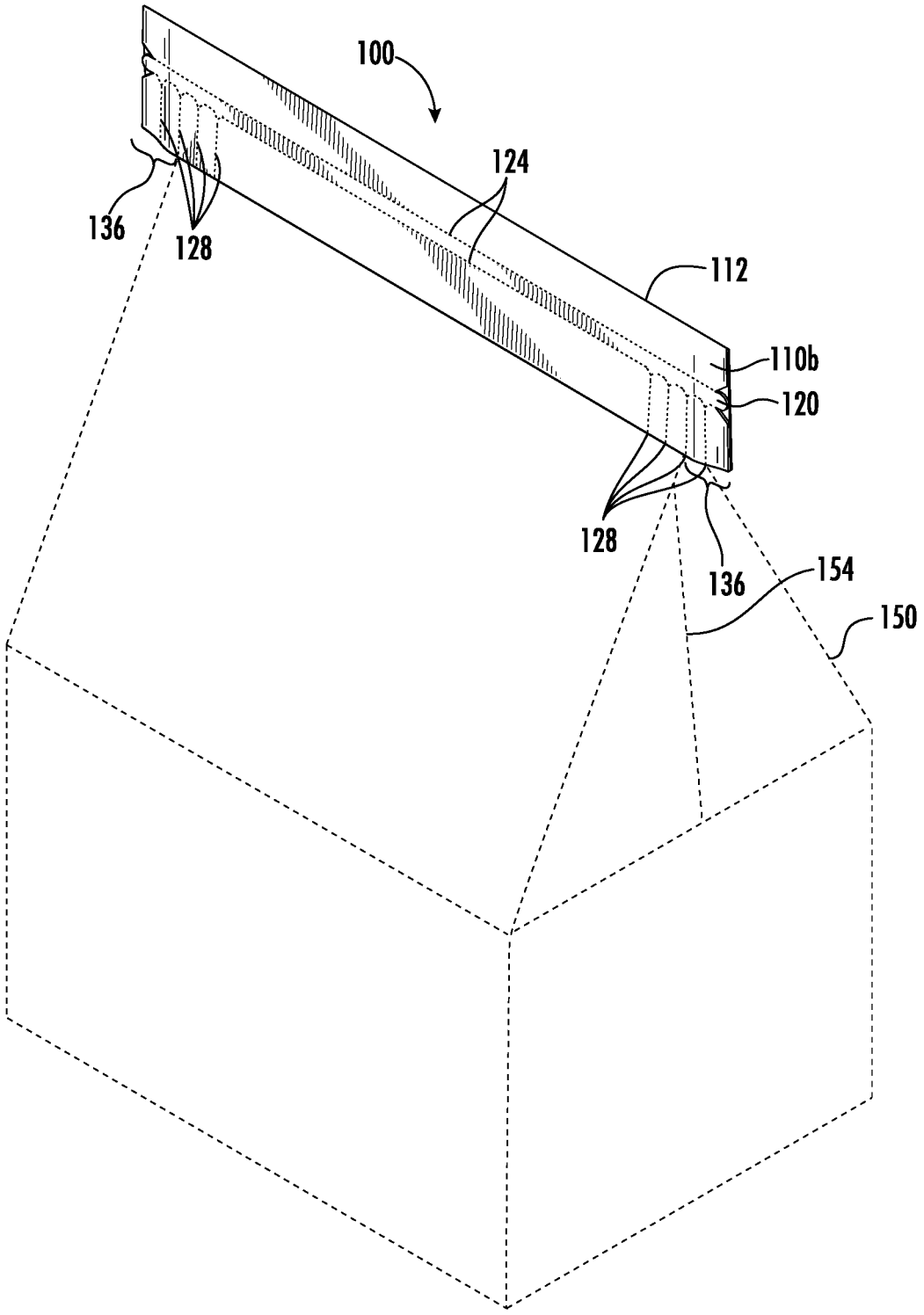
Figure 7:
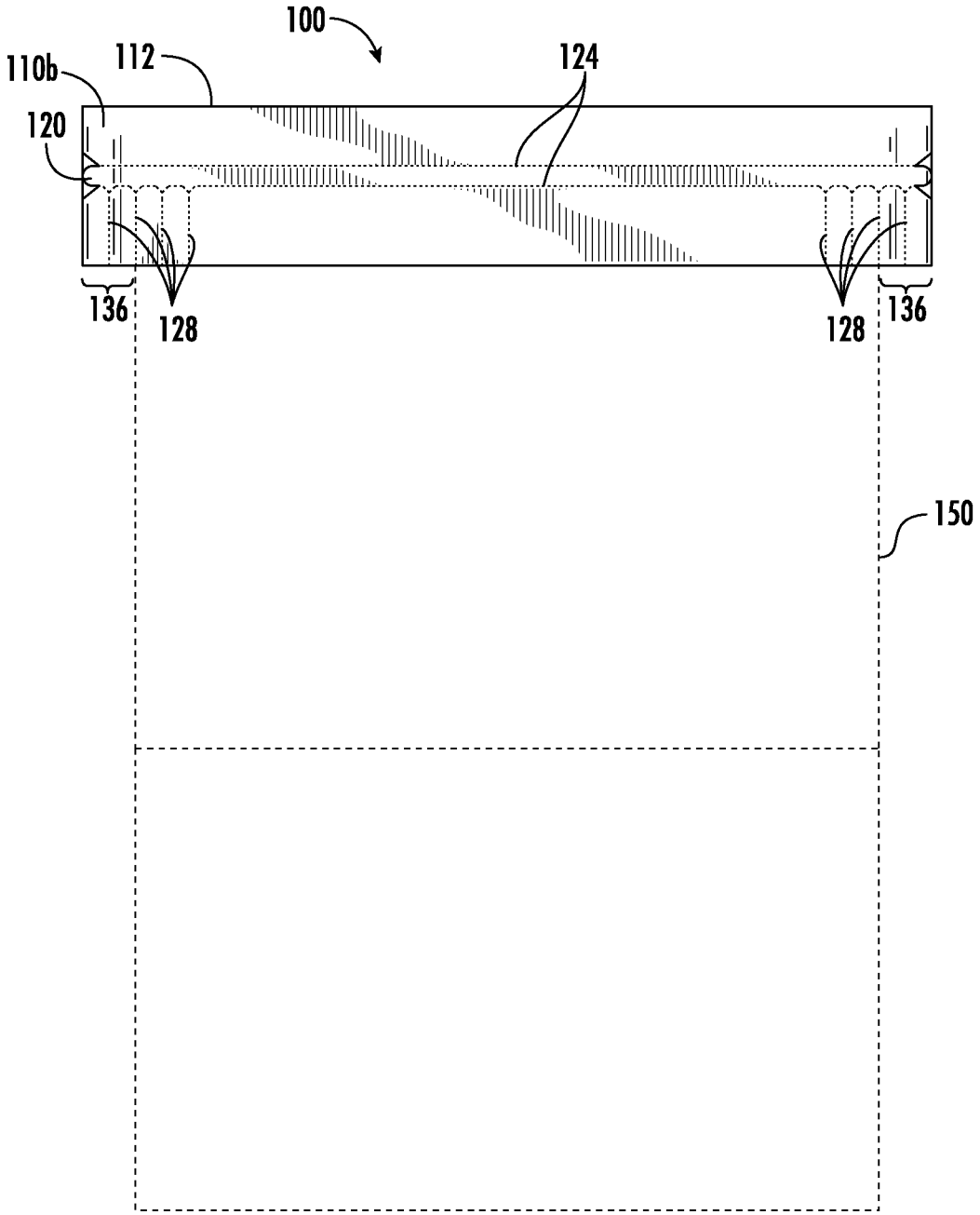
Figure 8:
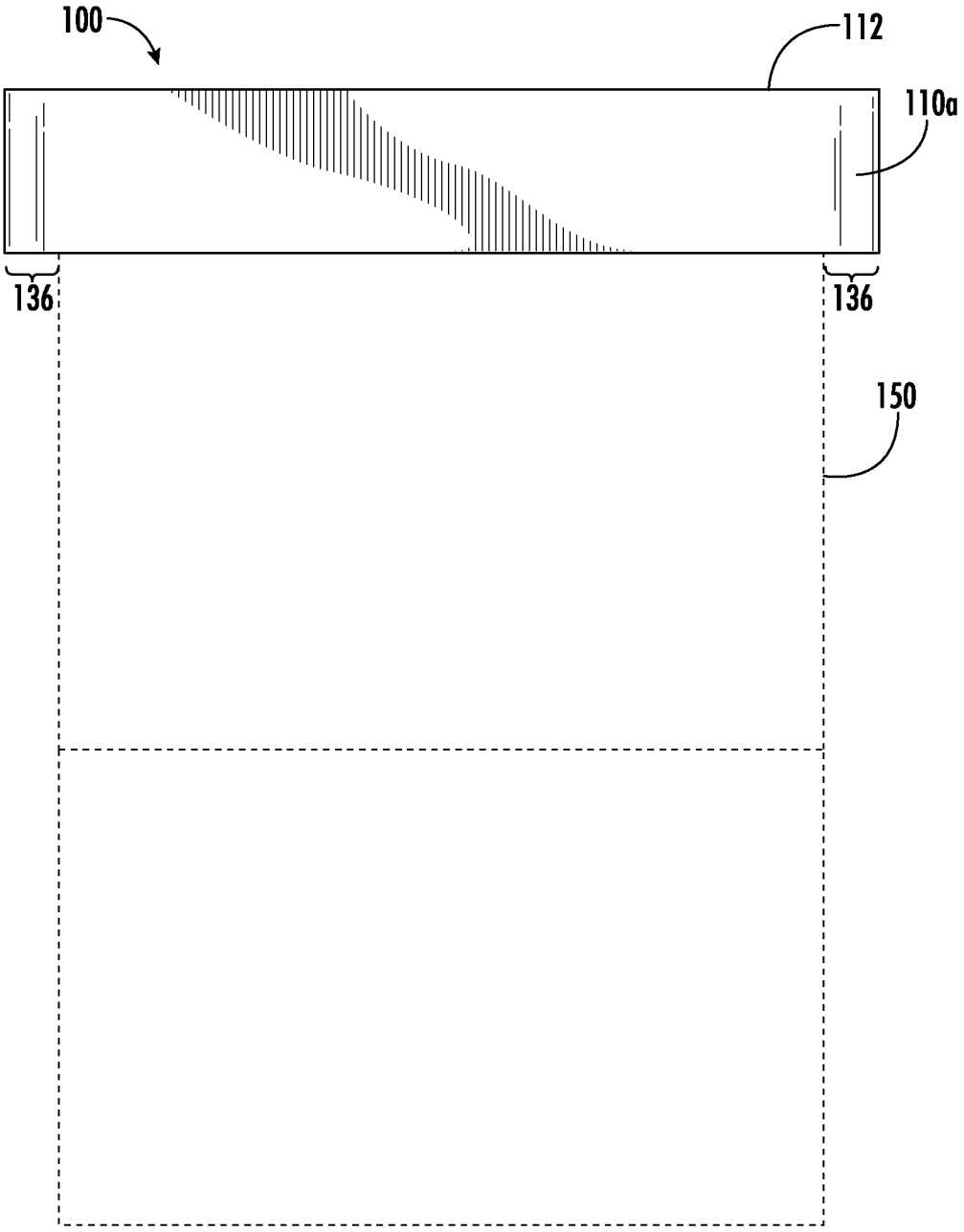
Figure 9:
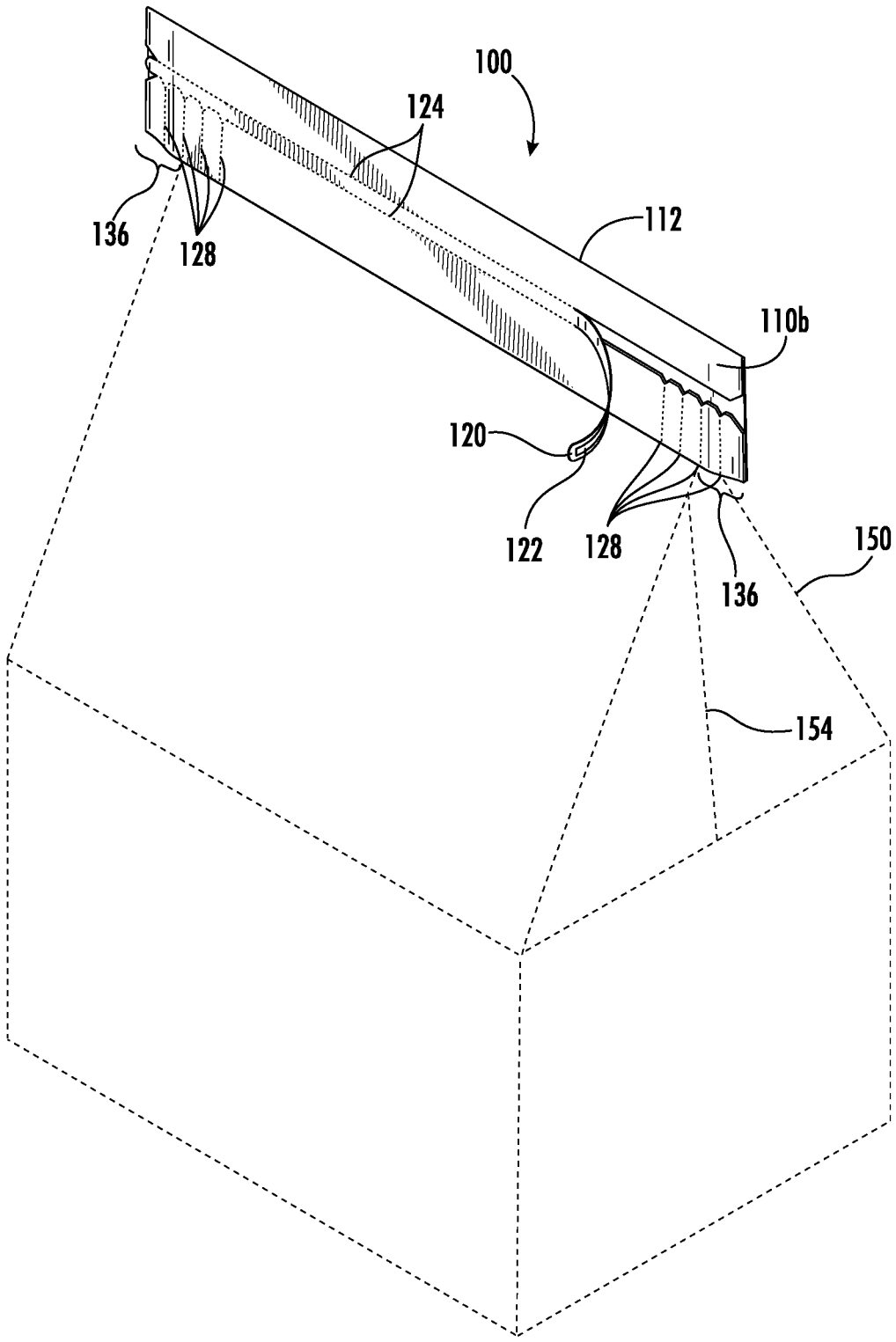
Figure 10:
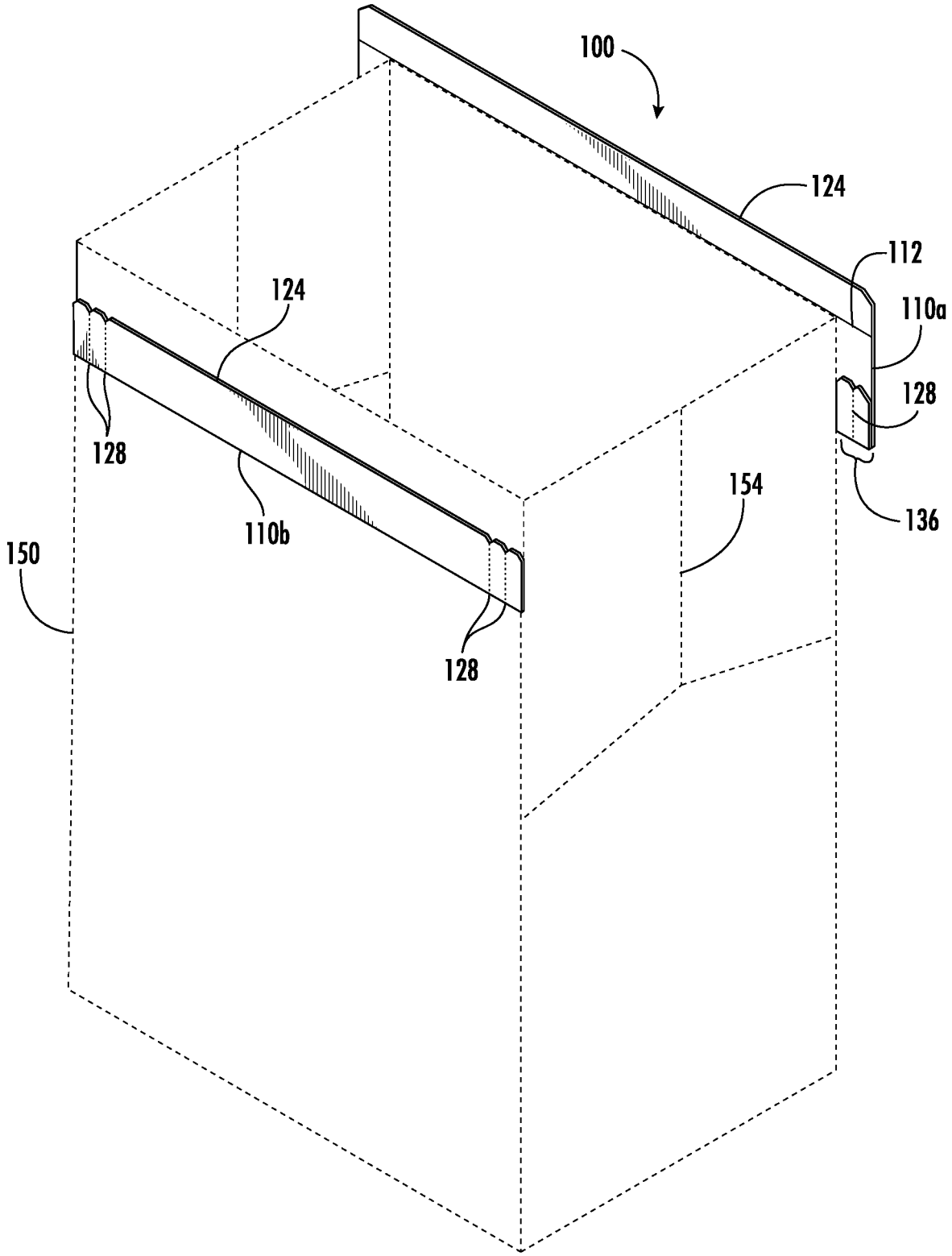
Figure 11:
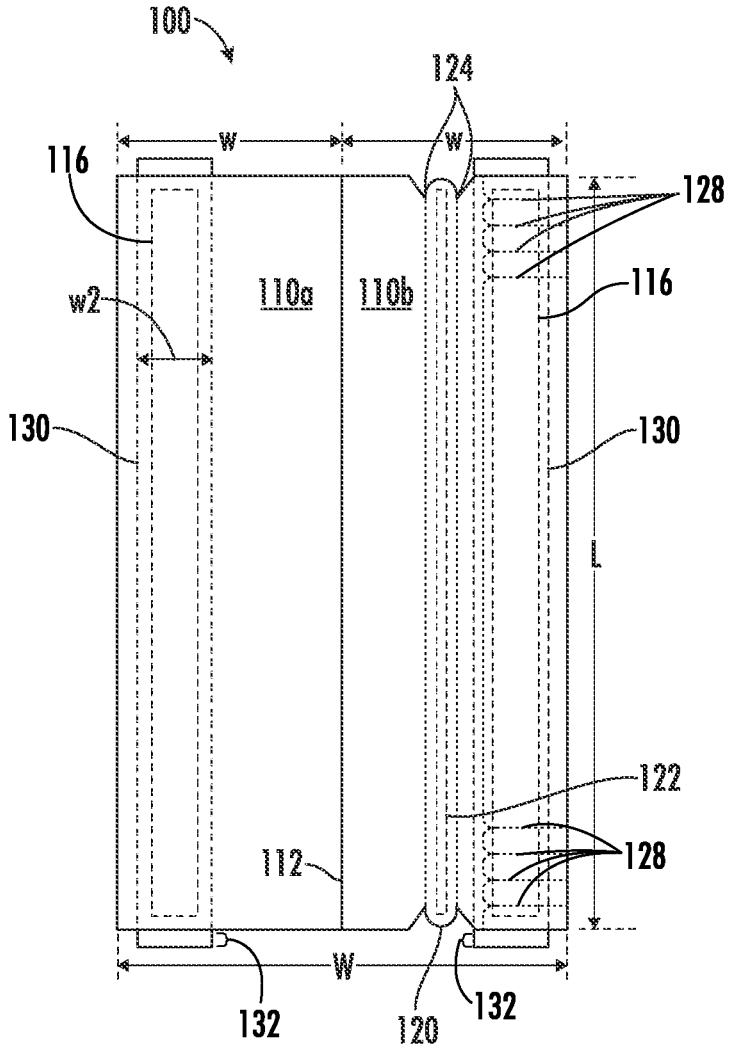
Figure 12:
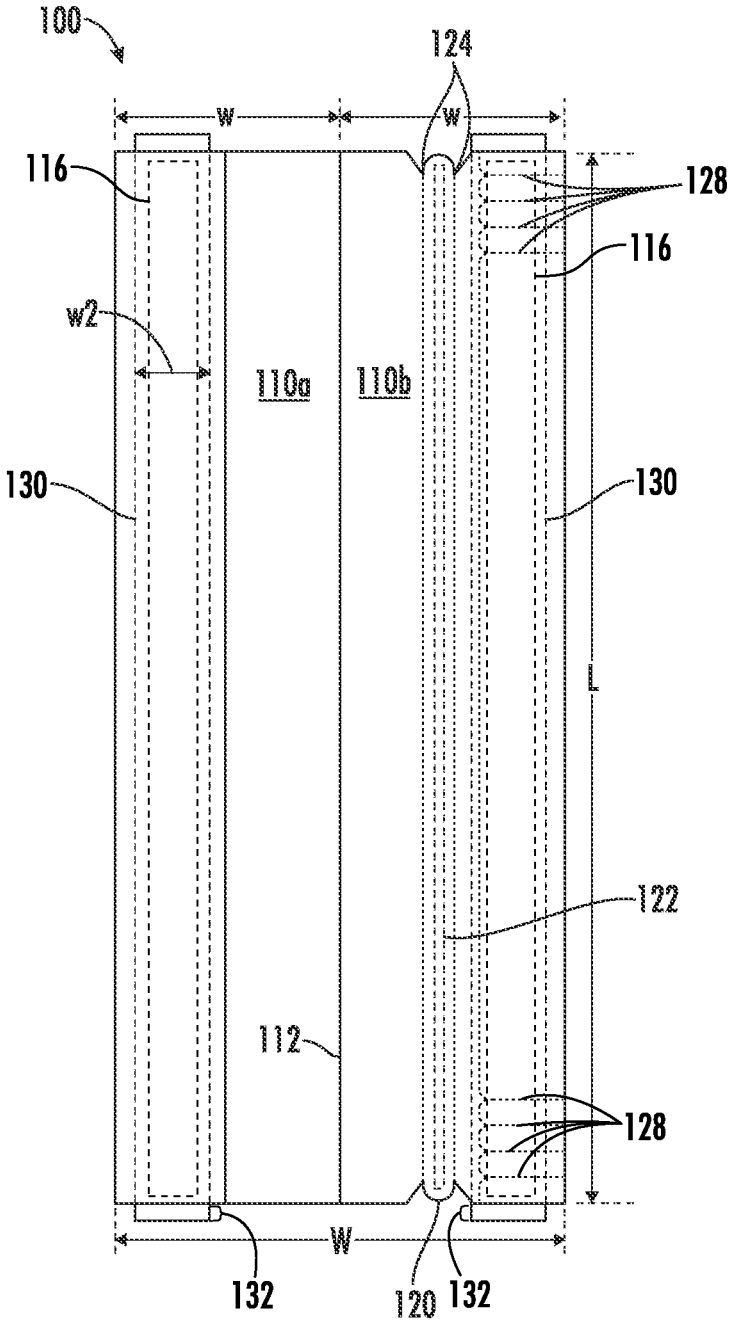
Figure 13:
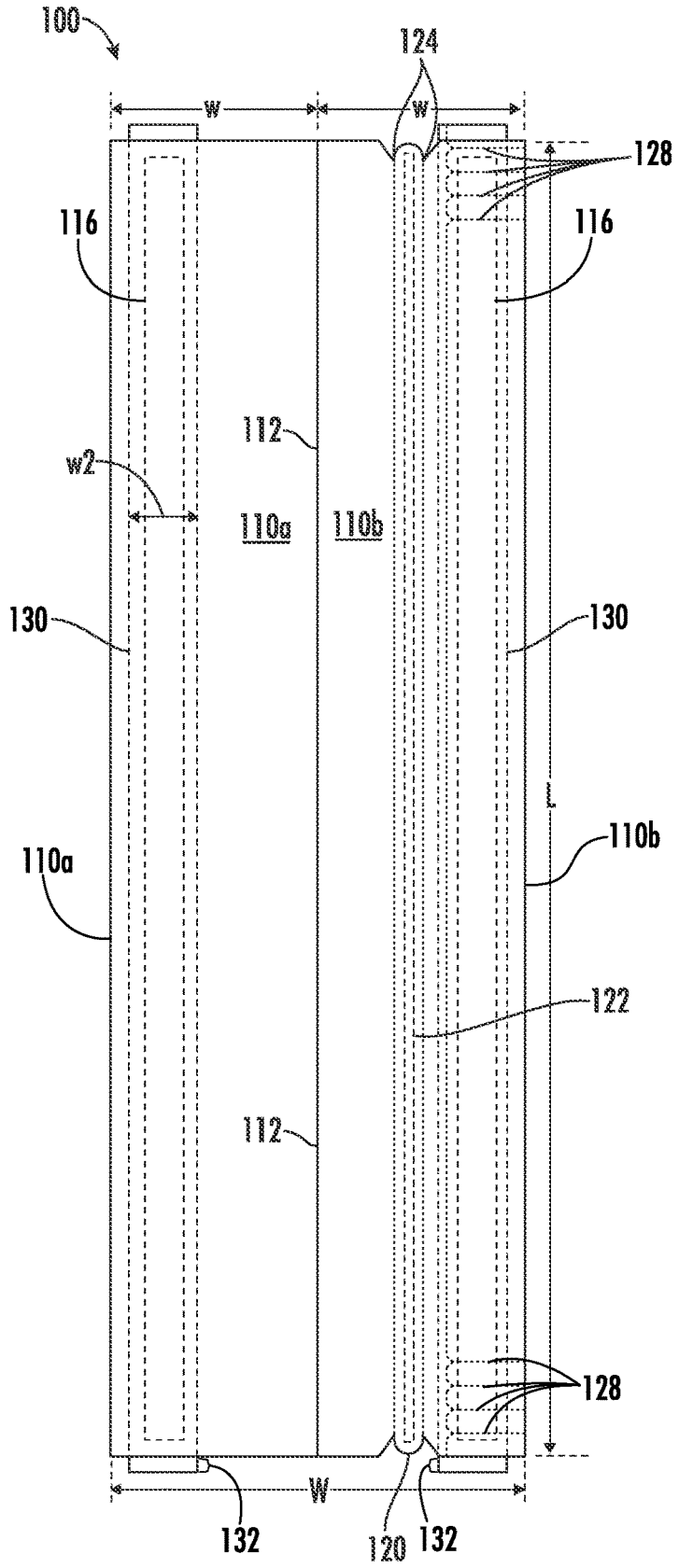
Figure 14:
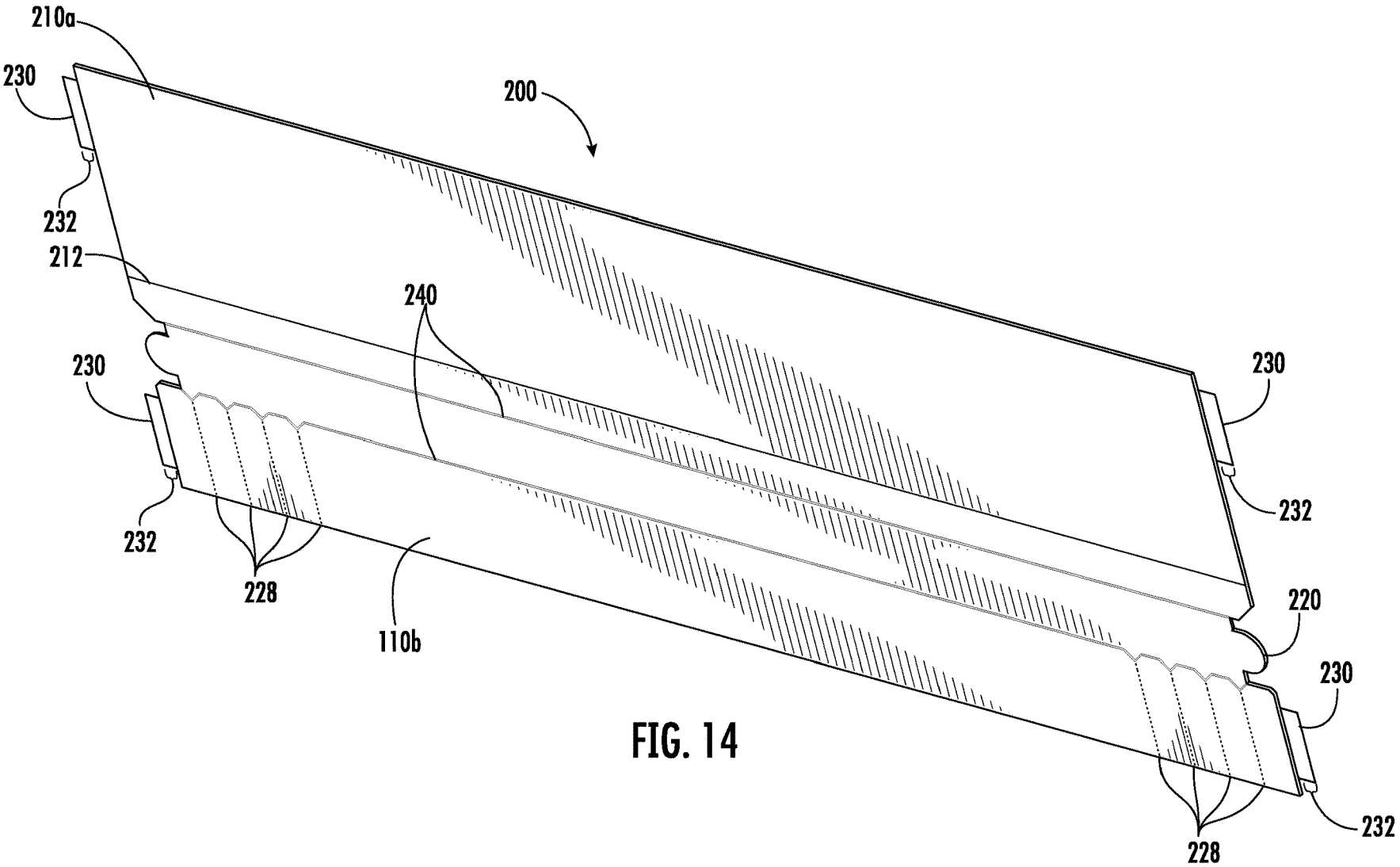
Figure 15:
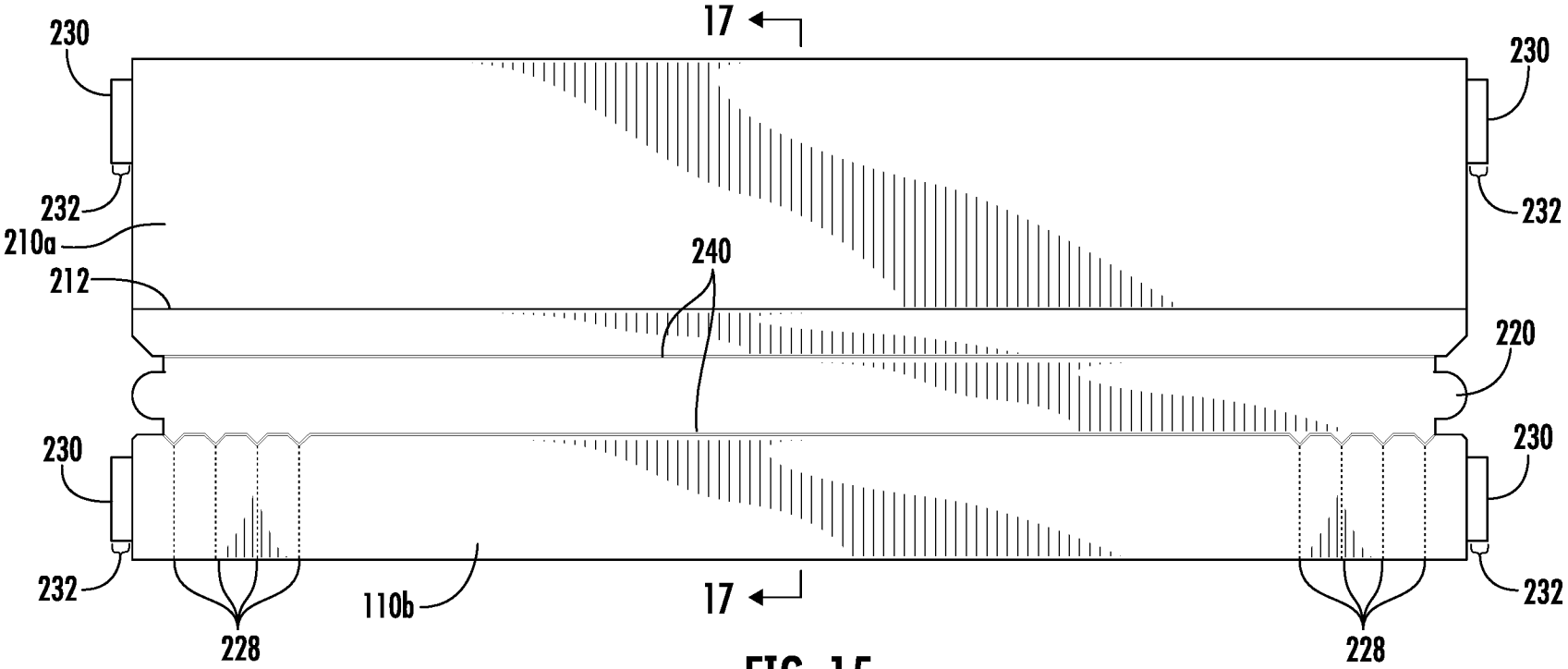
Figure 16:
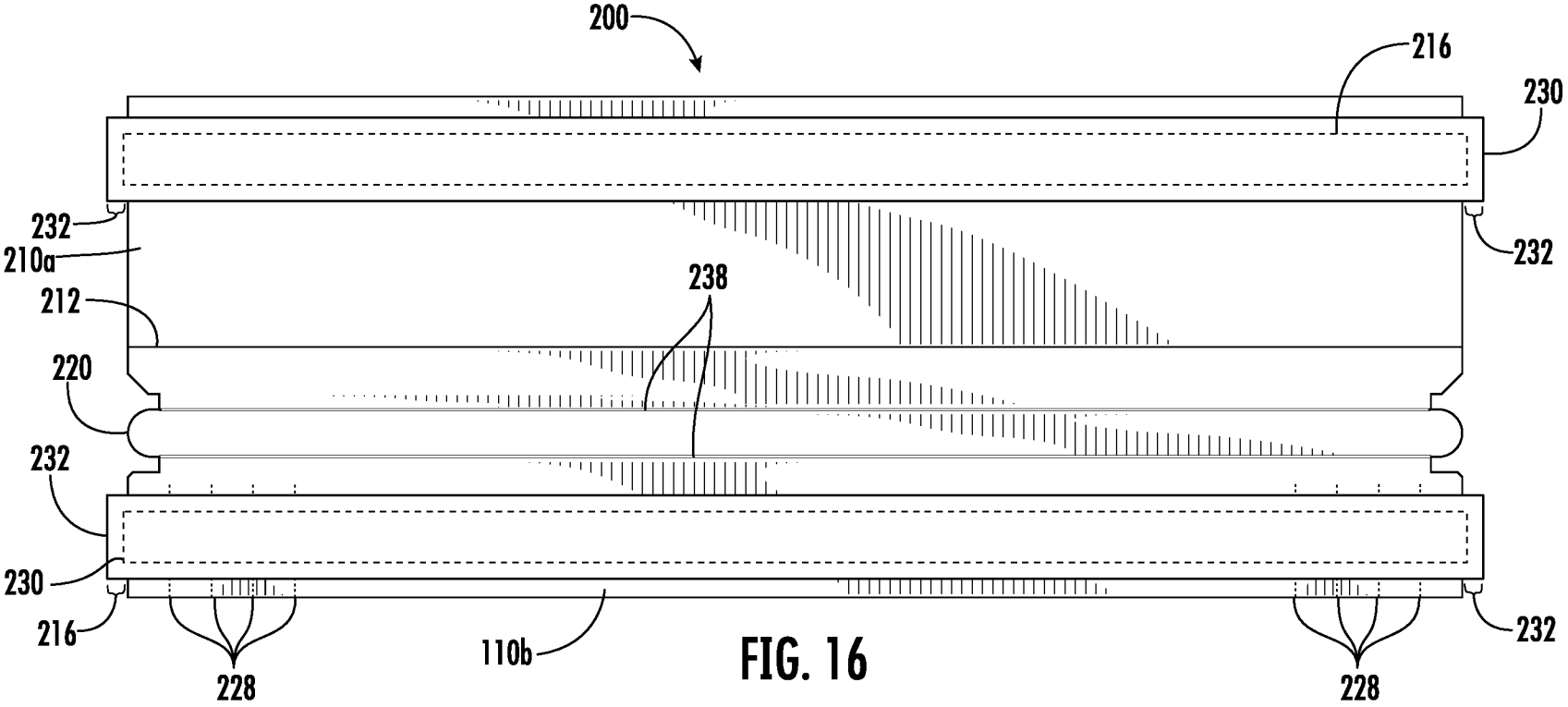
Figure 17:
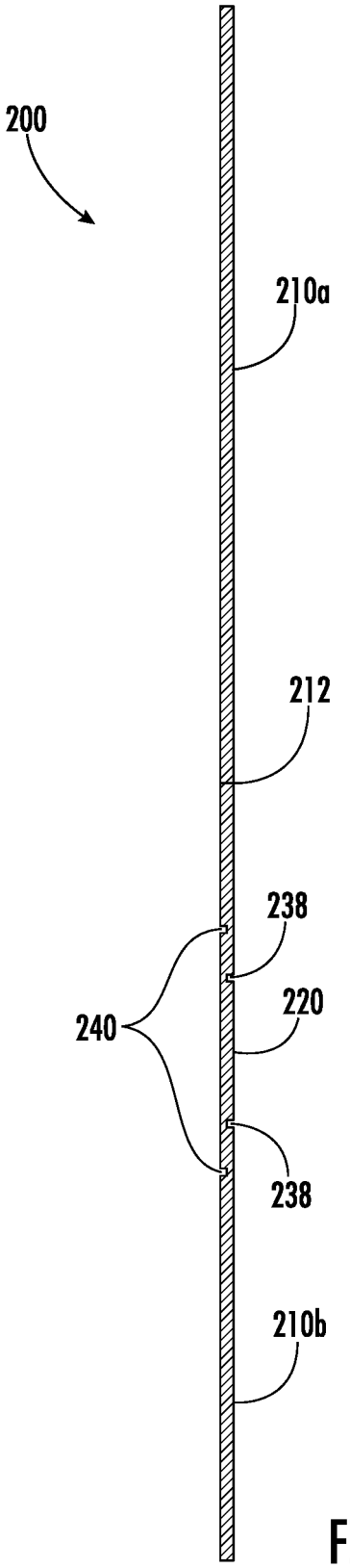
Figure 18:
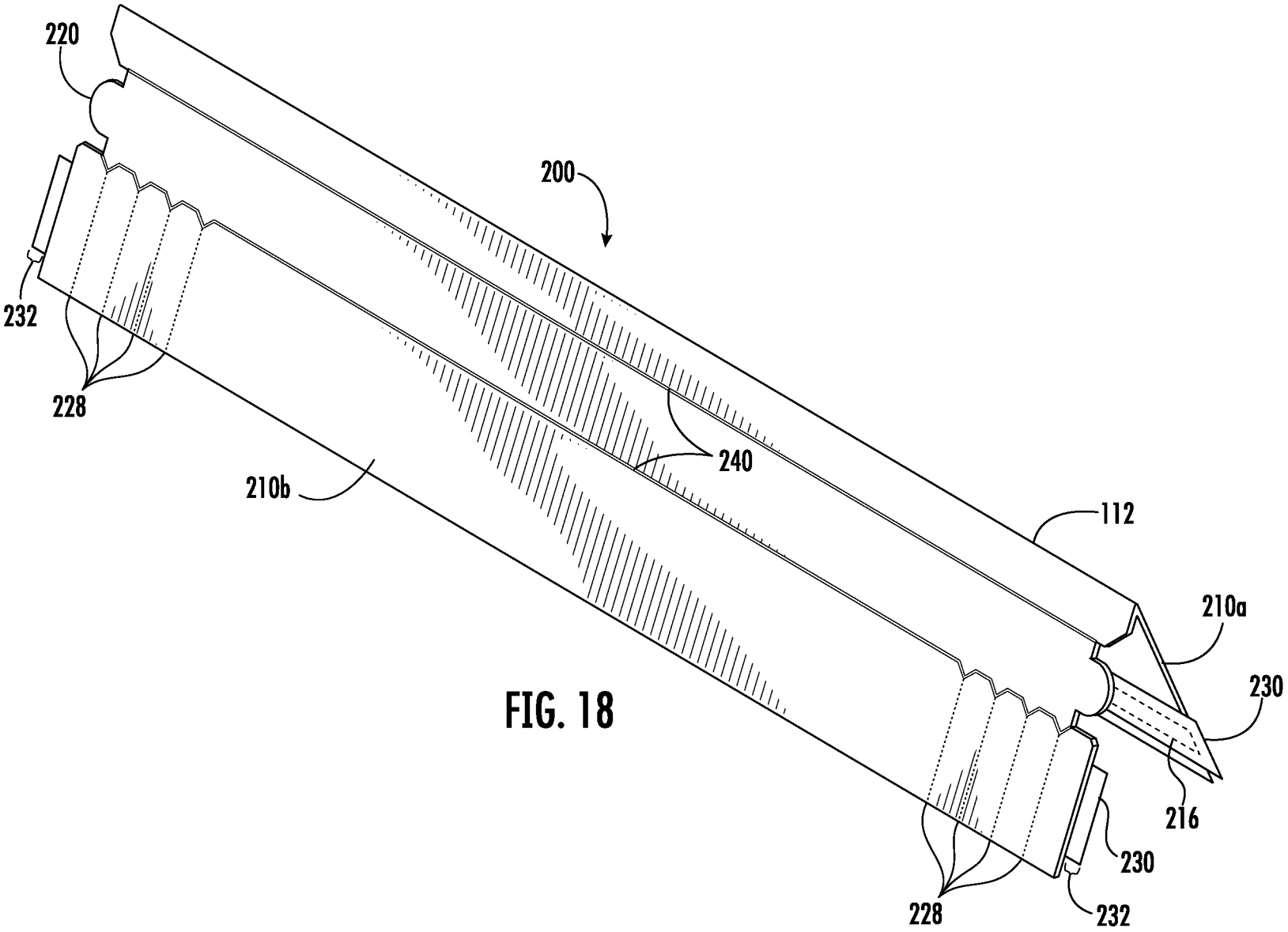
Figure 19:
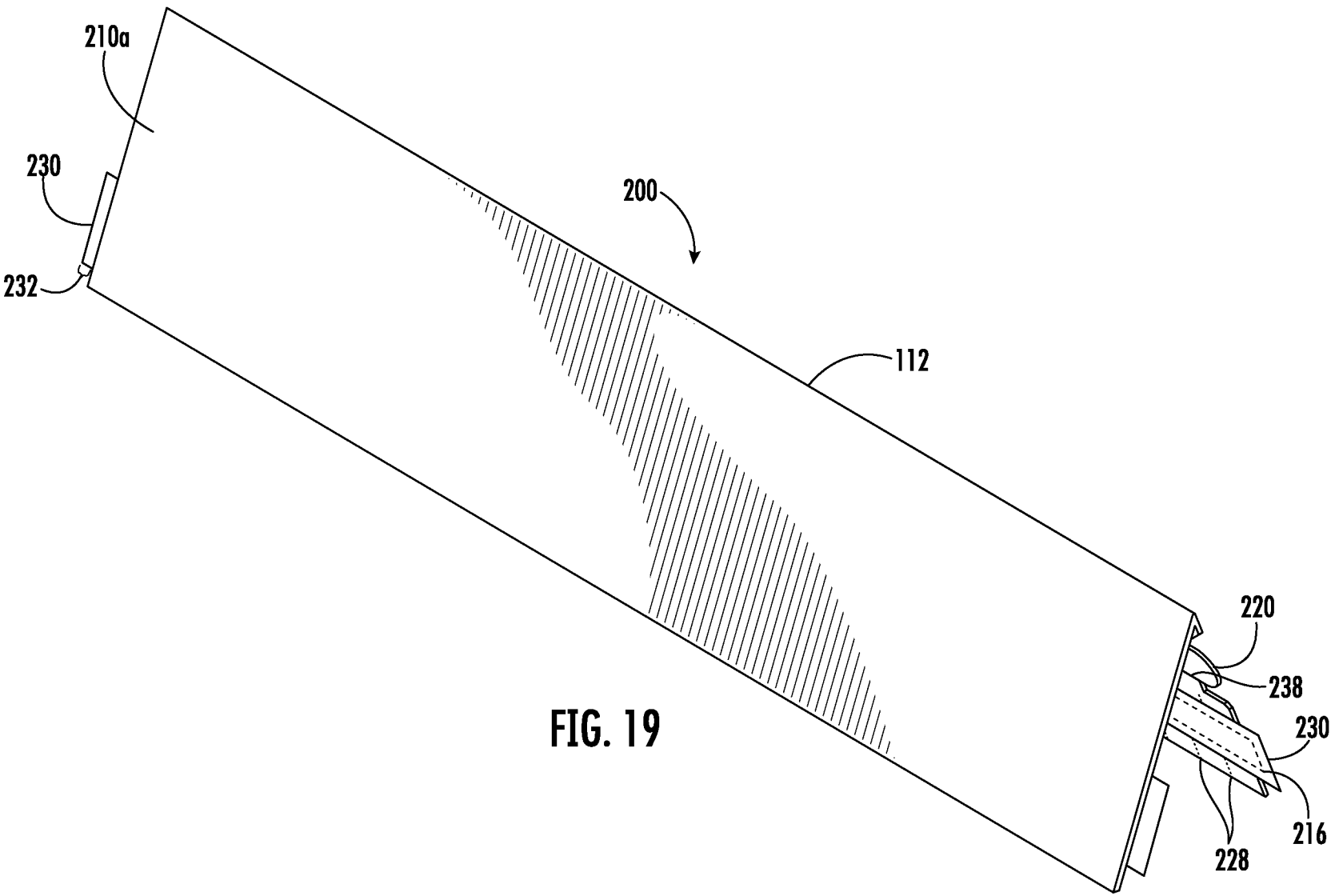
Figure 20:
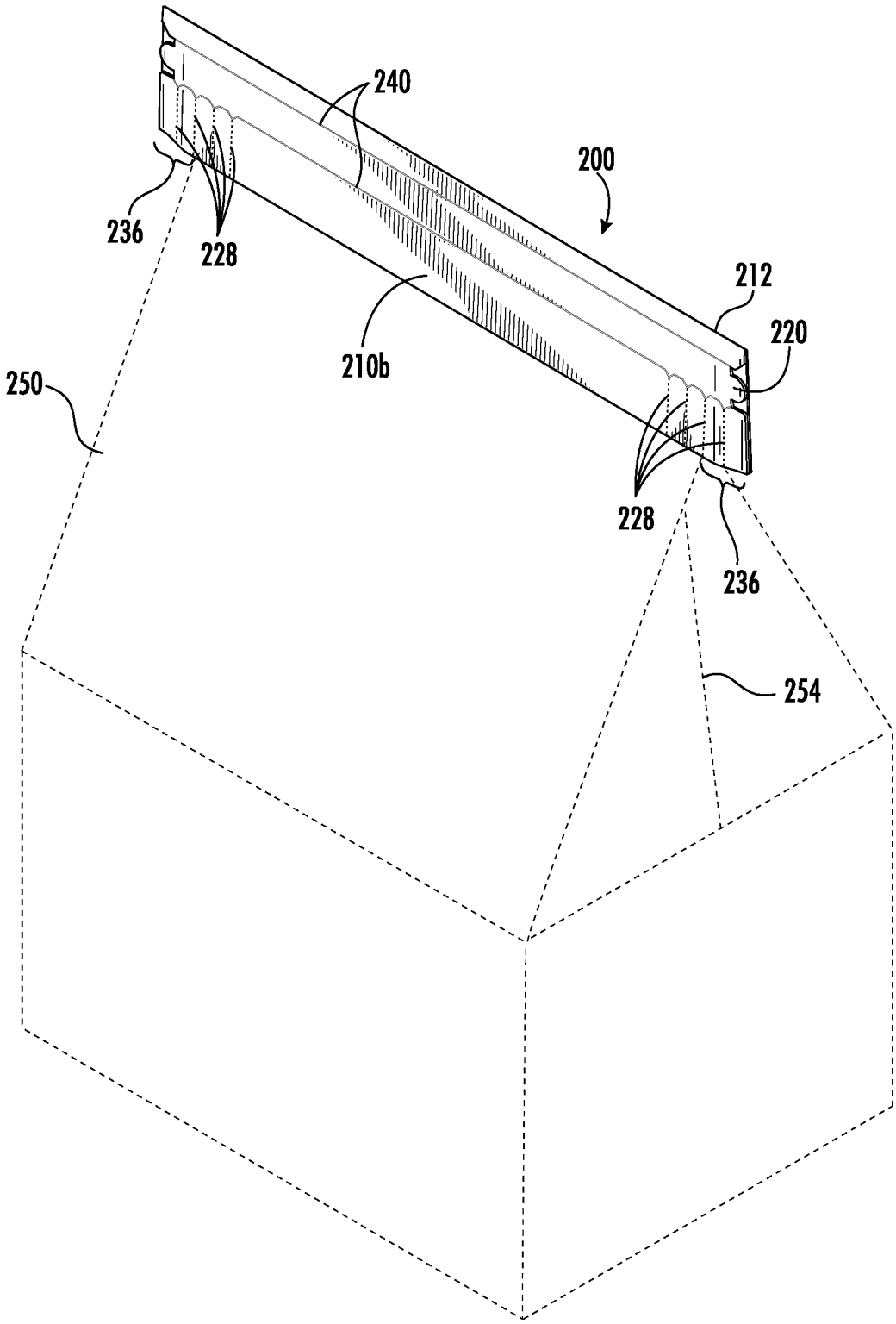
Figure 21:
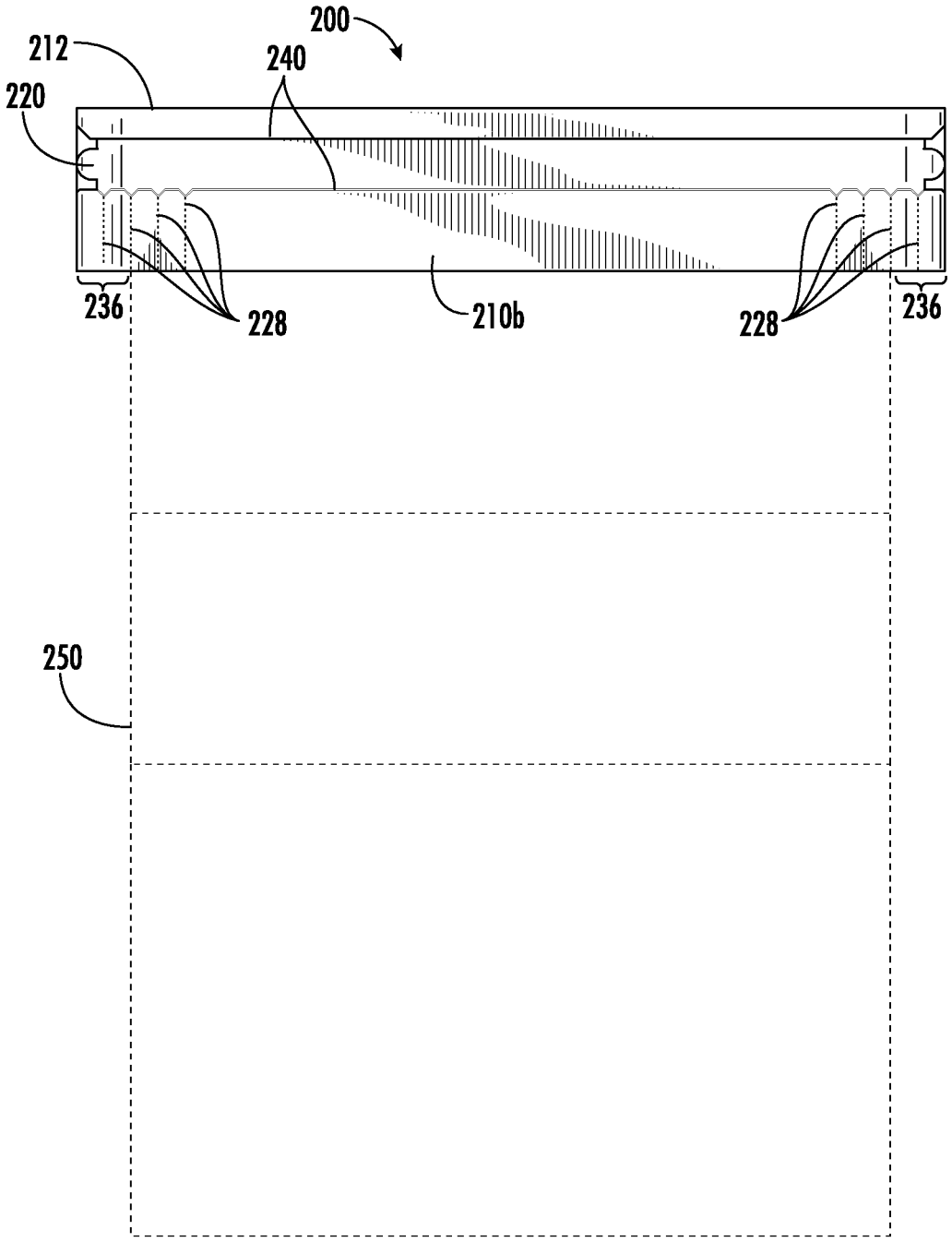
Figure 22:
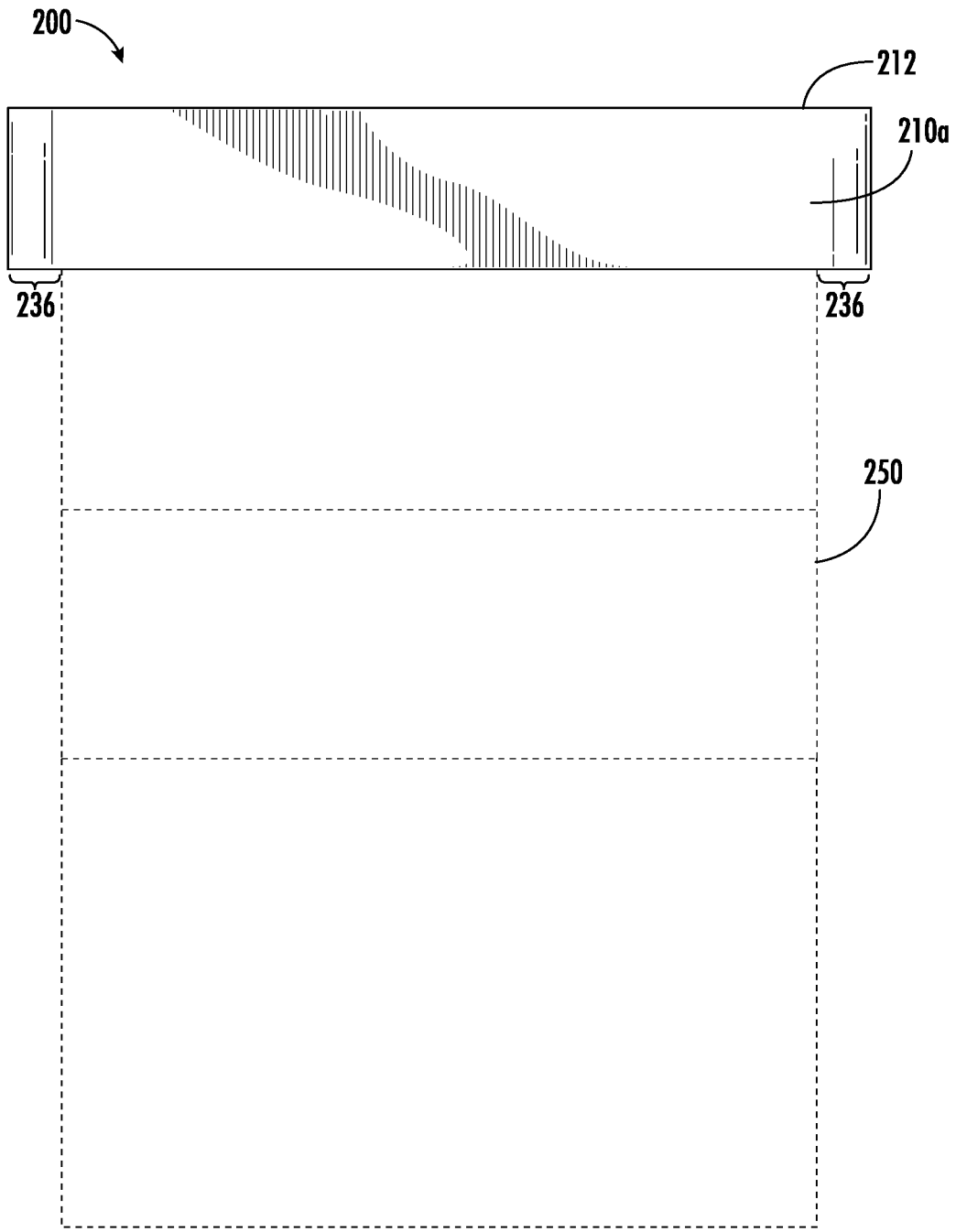
Figure 23:
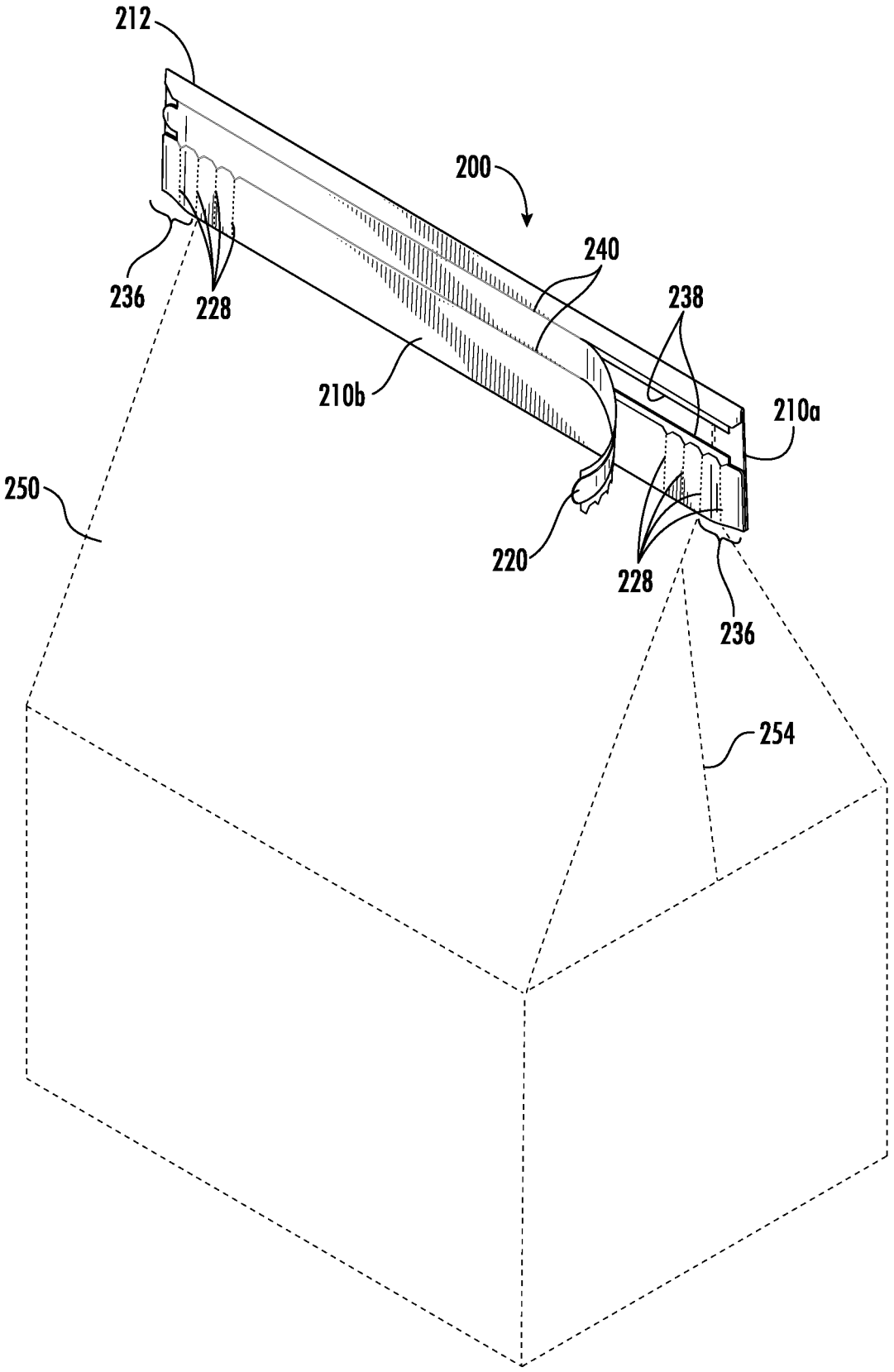
Figure 24:
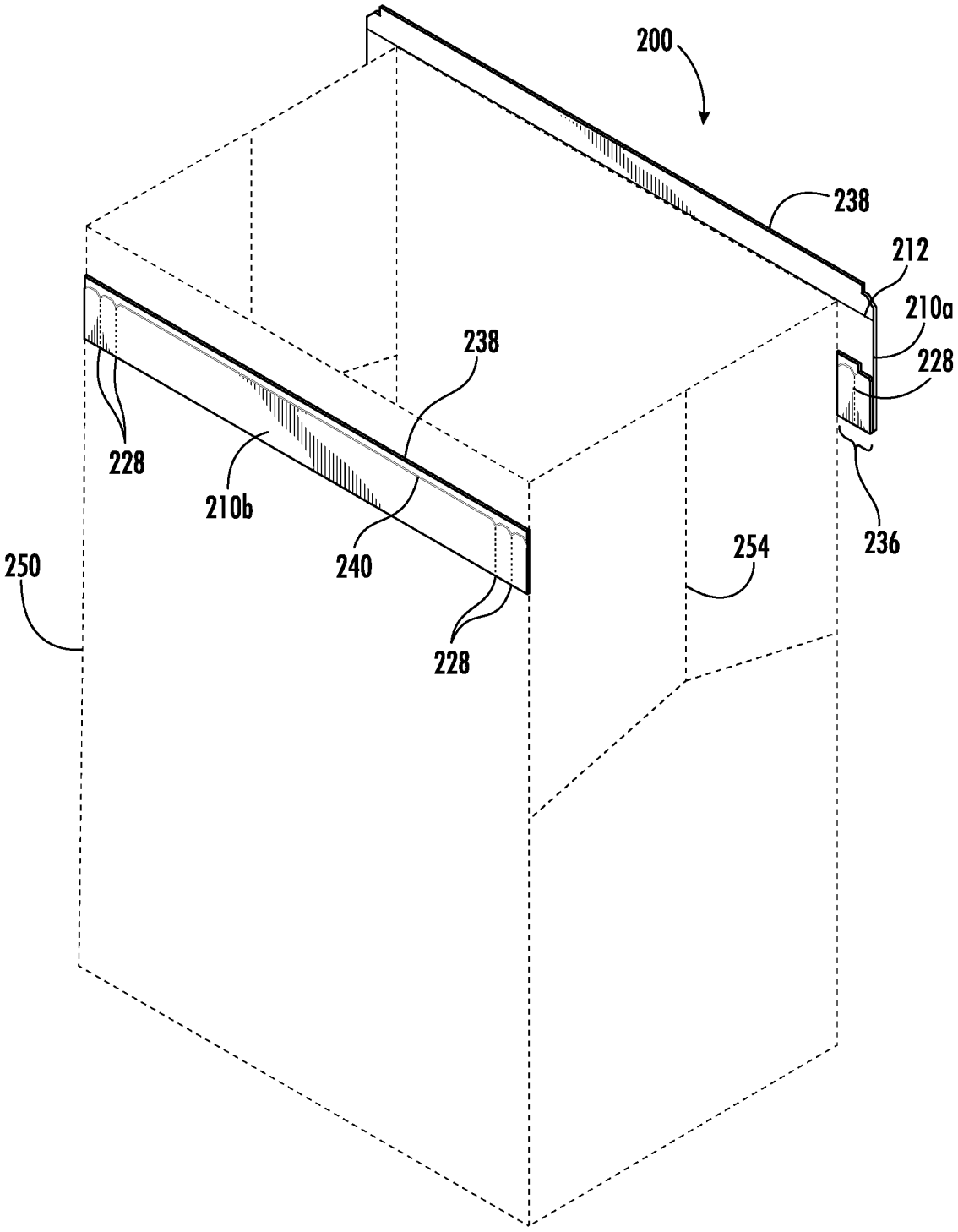
Figure 25:
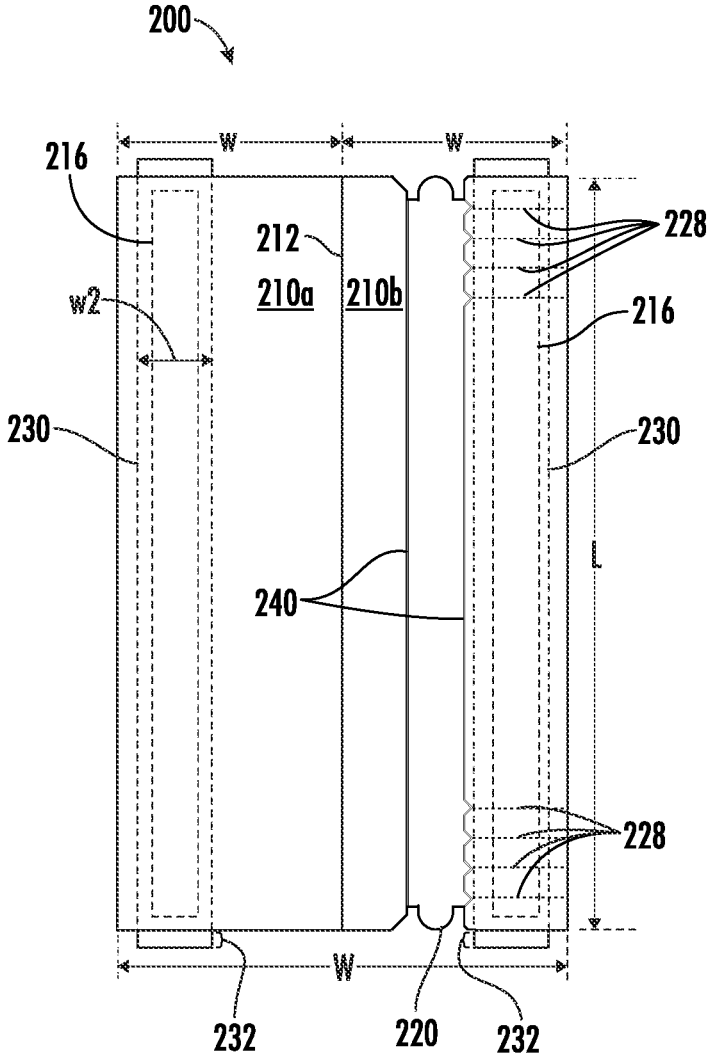
Figure 26:
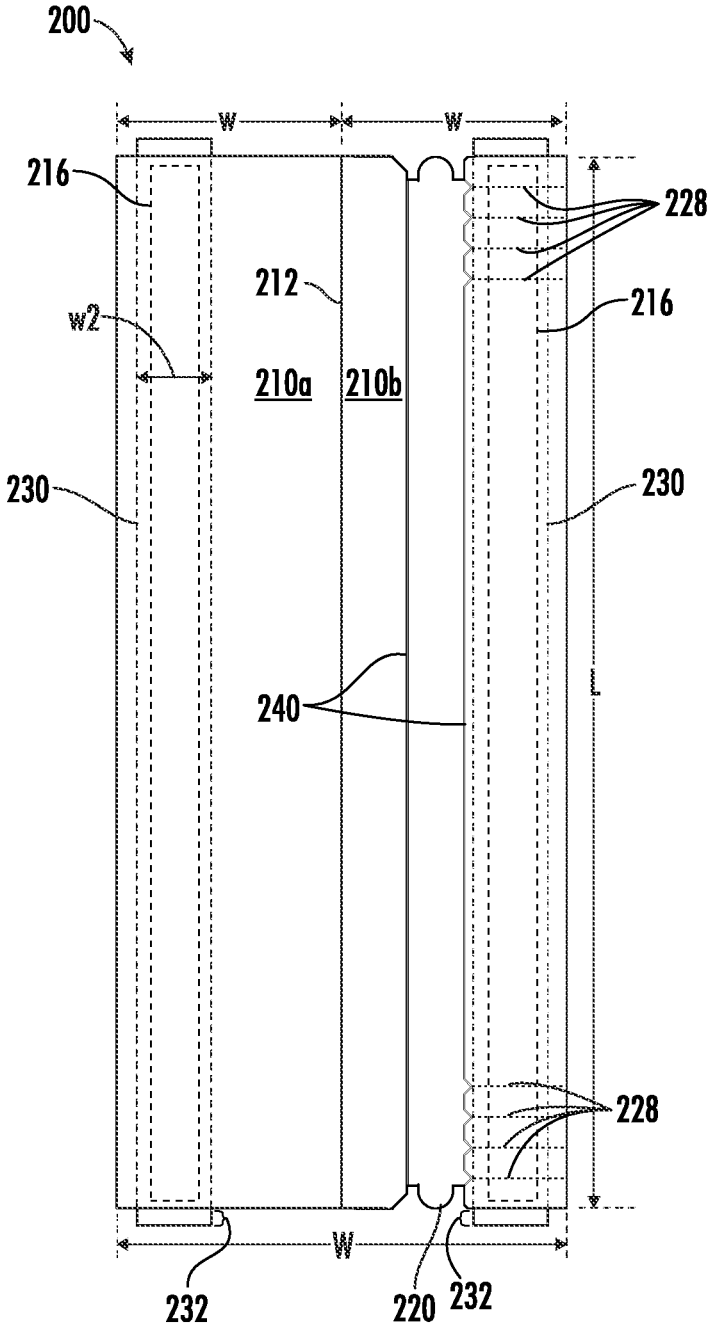
Figure 27:
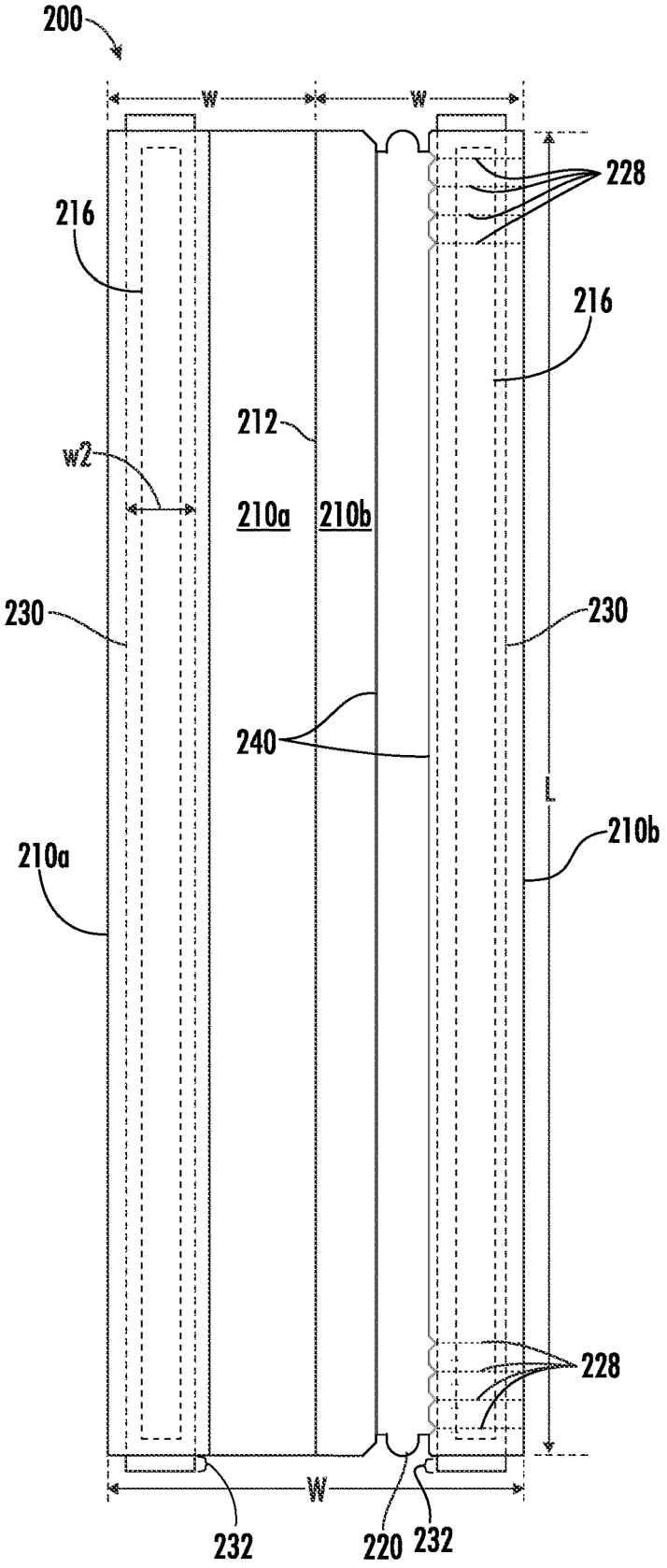
Figure 28:
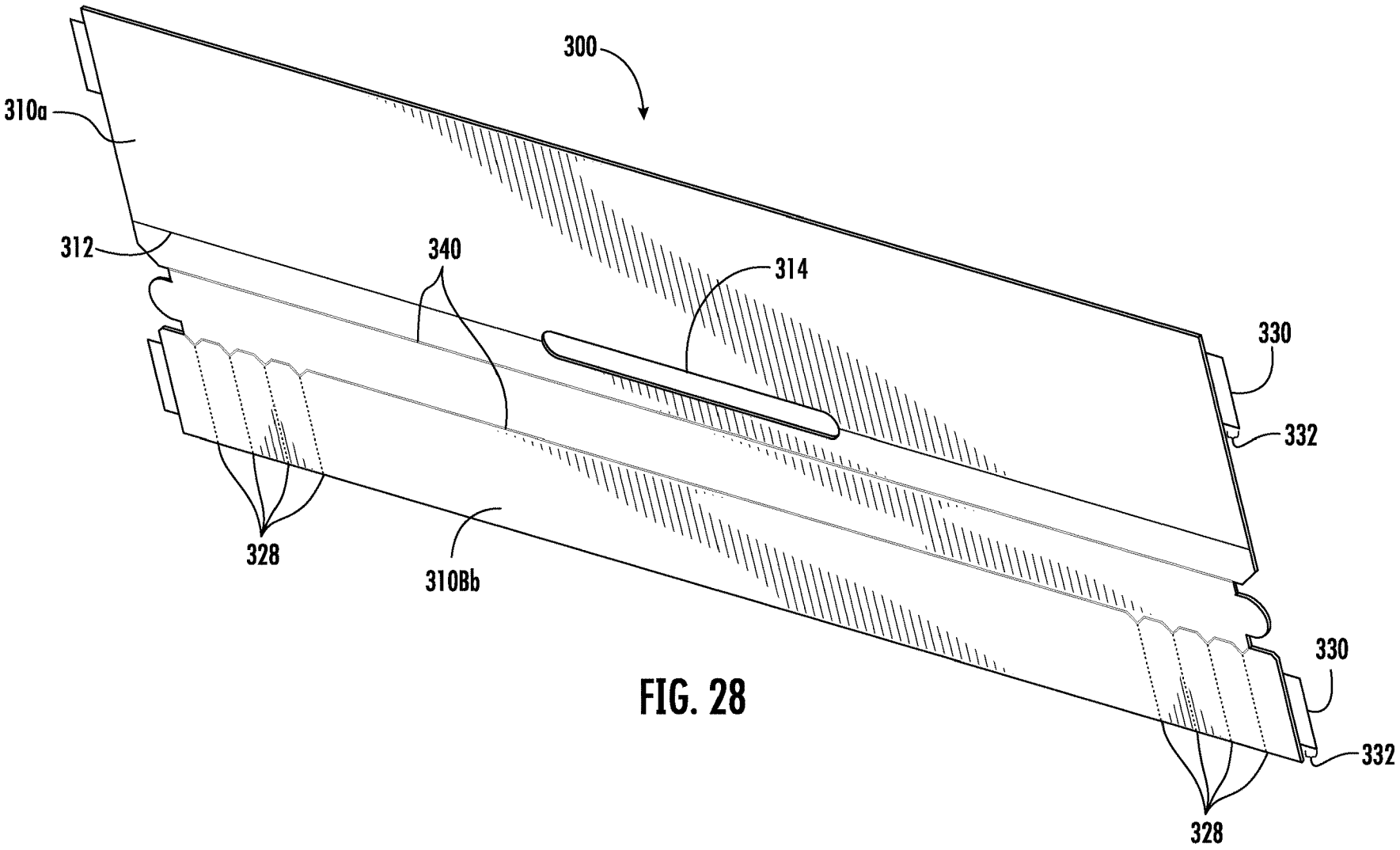
Figure 29:
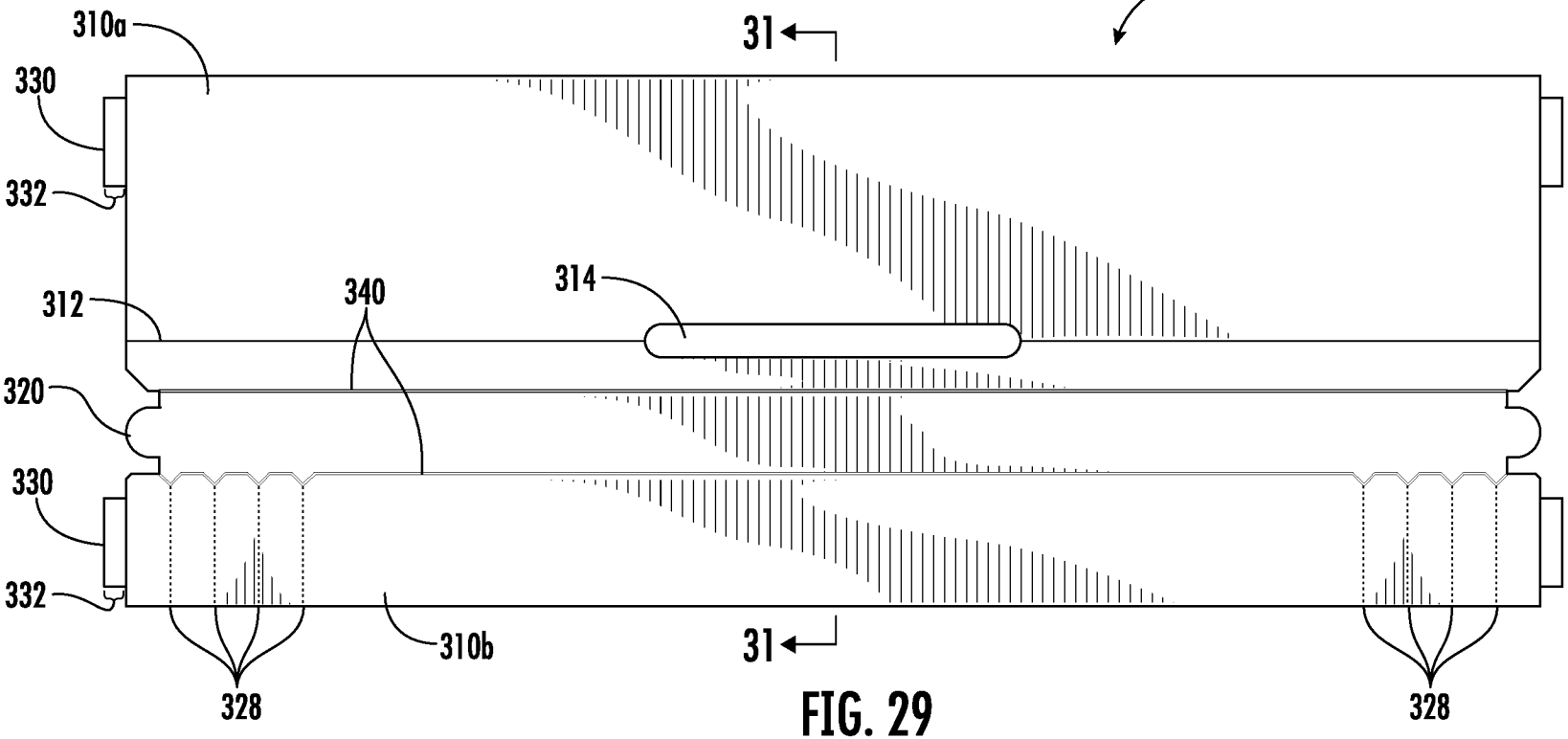
Figure 30:
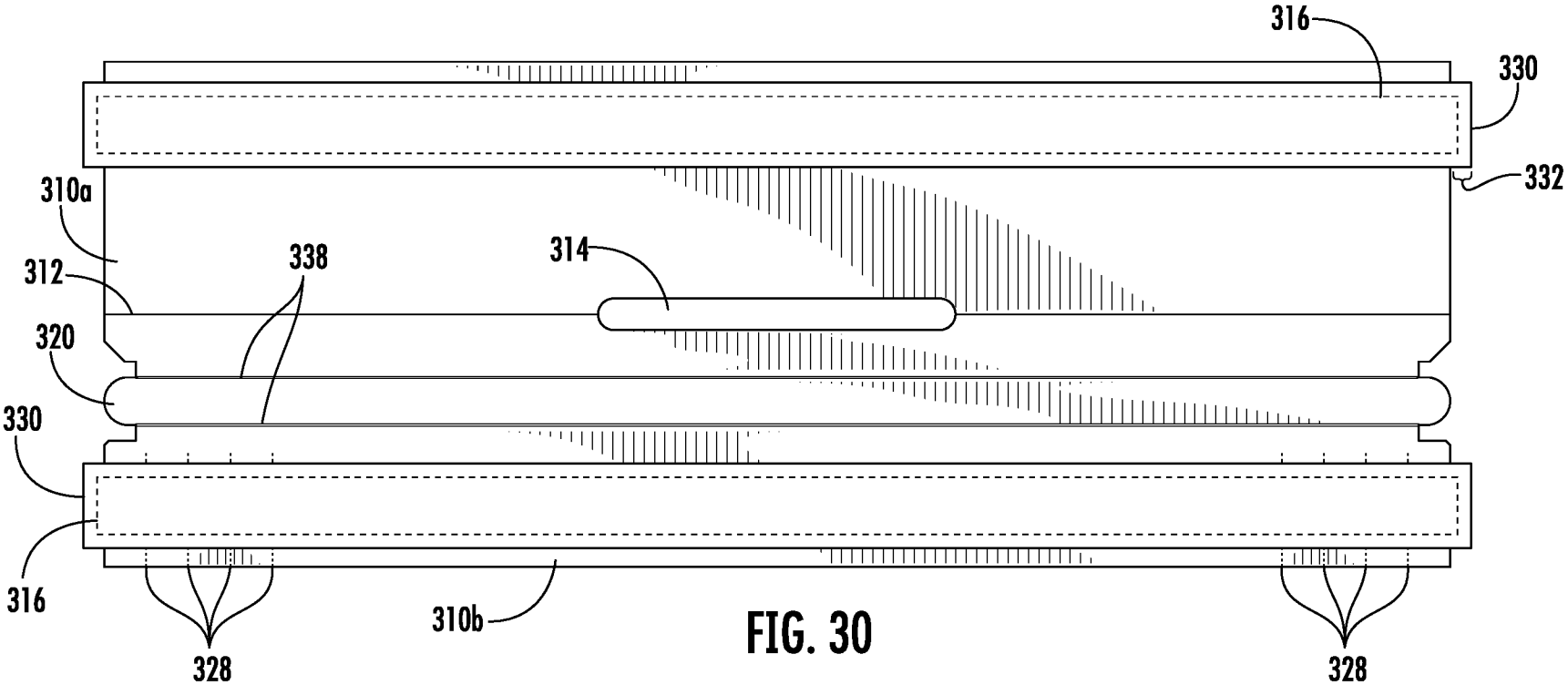
Figure 31:
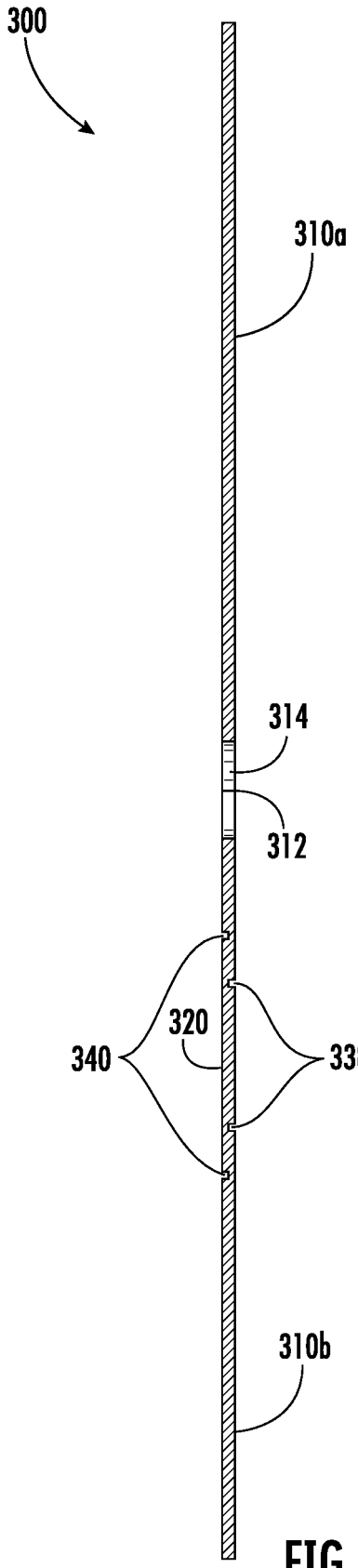
Figure 32:
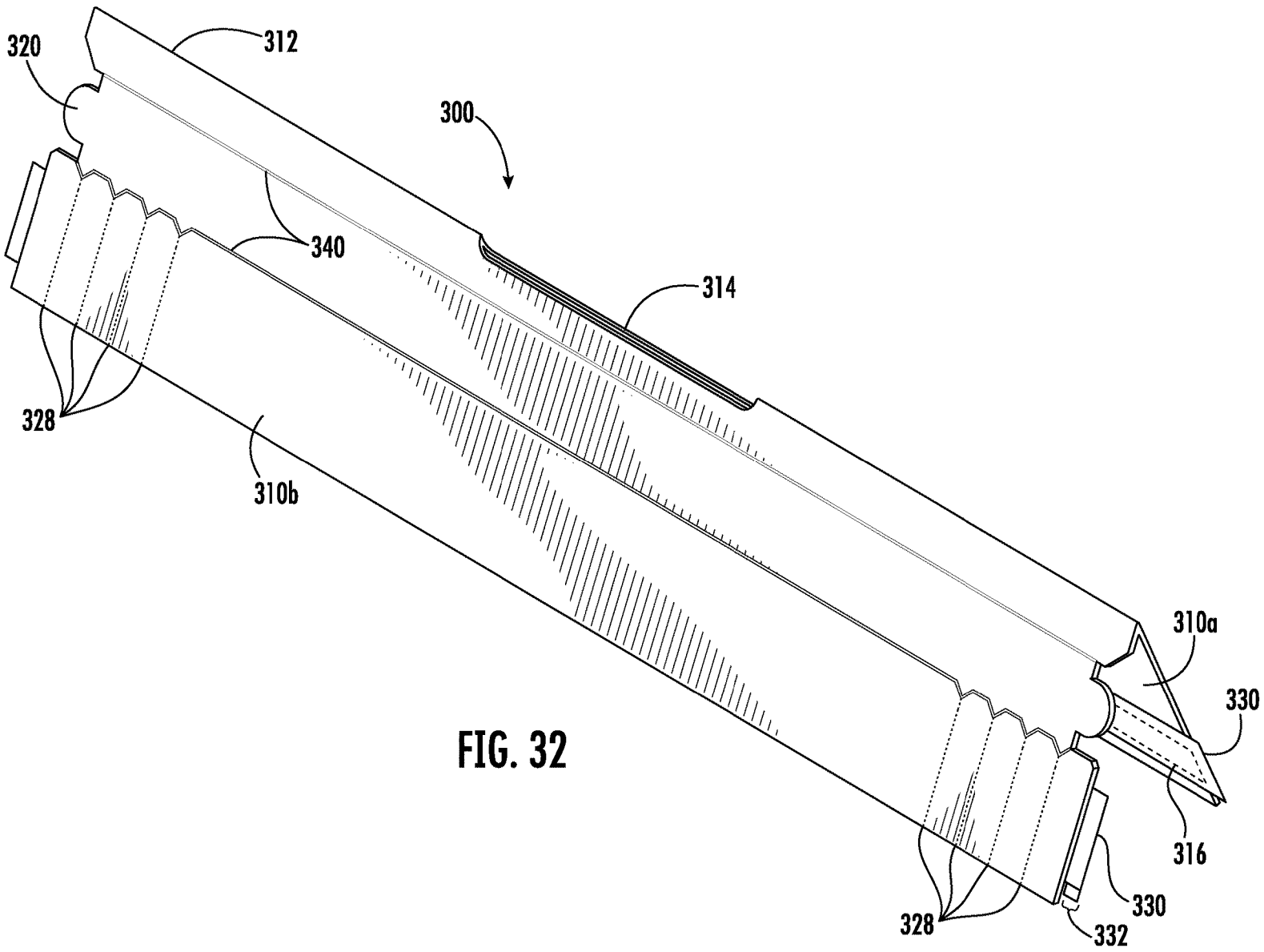
Figure 33:
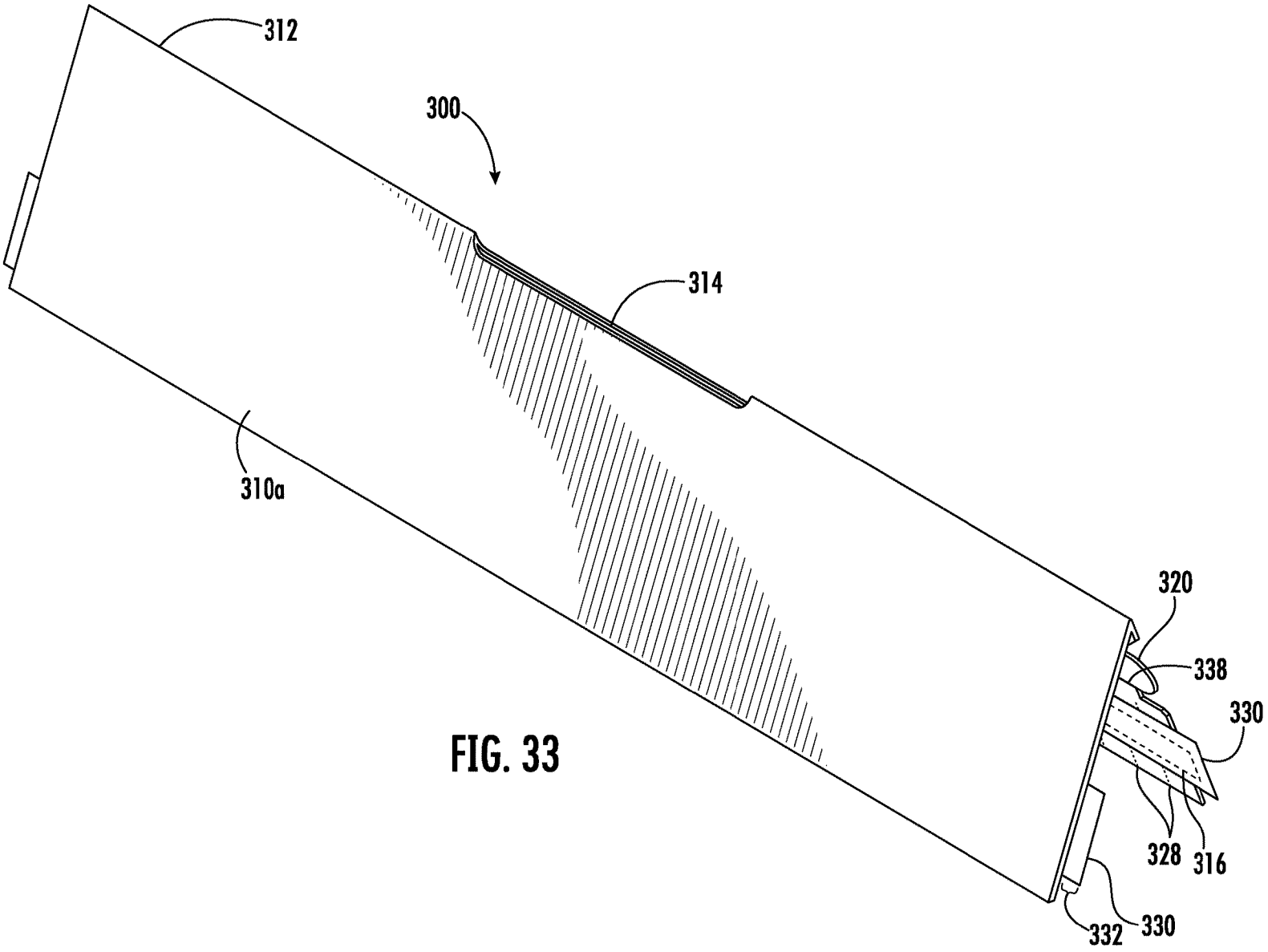
Figure 34:
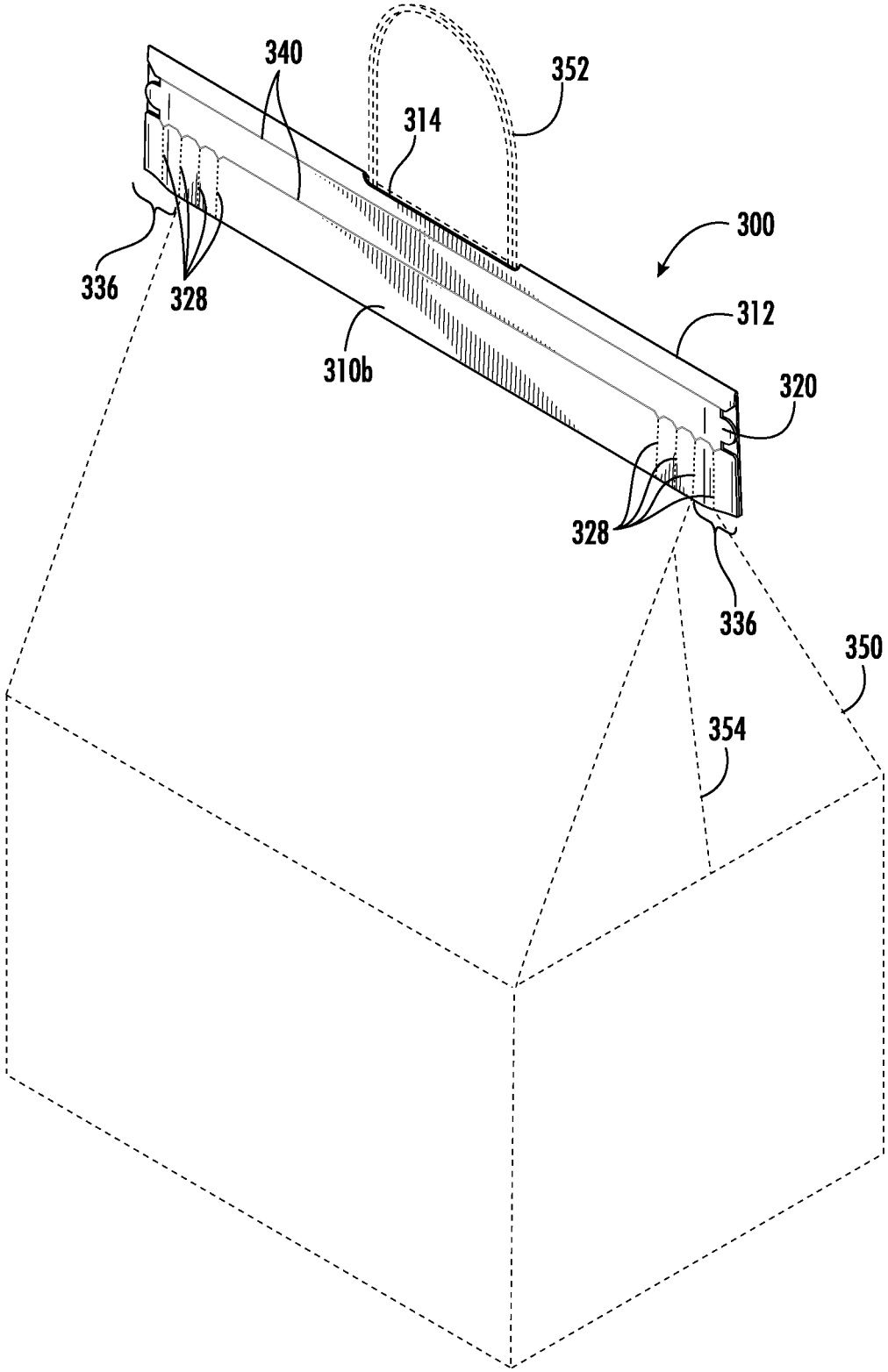
Figure 35:
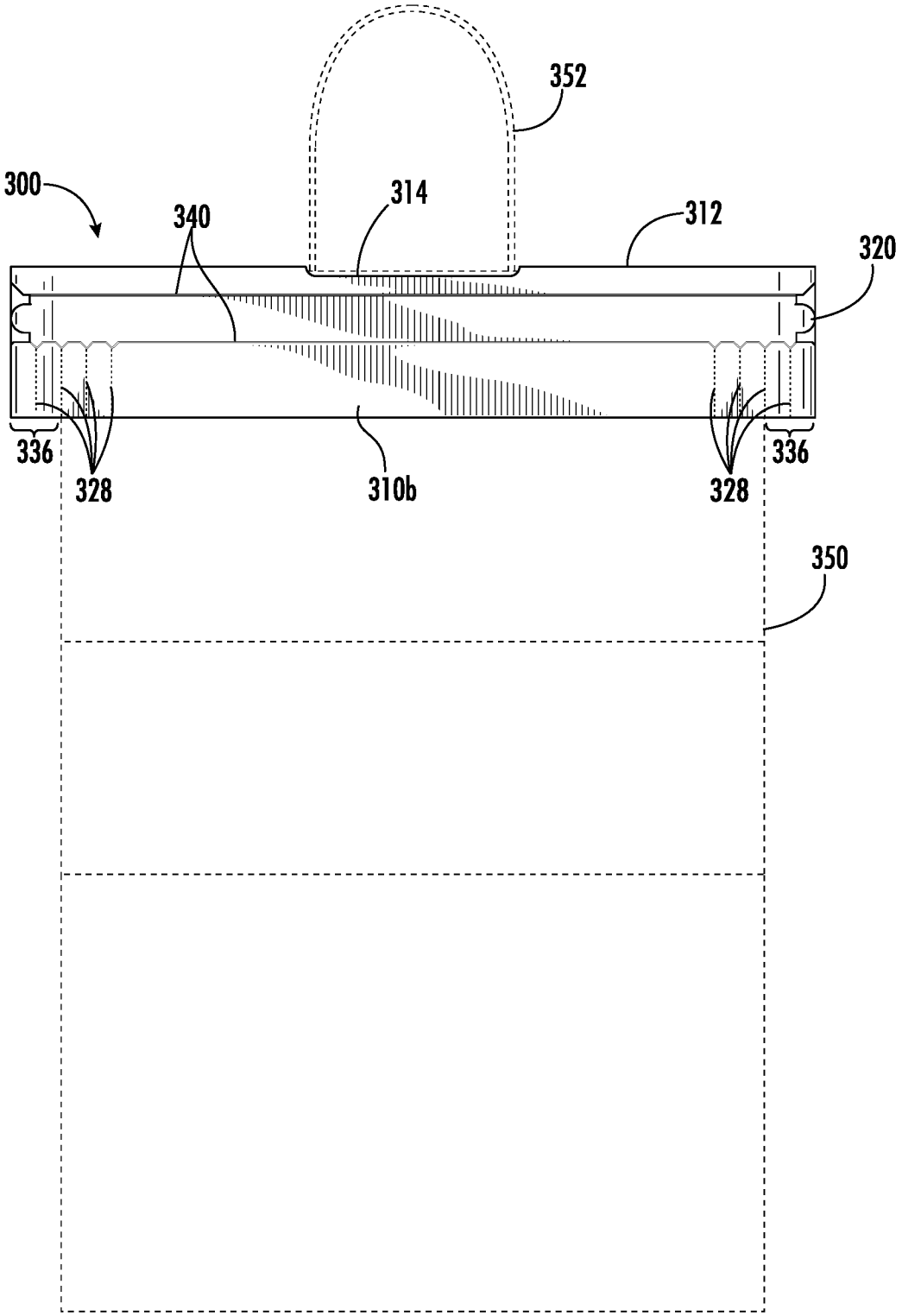
Figure 36:
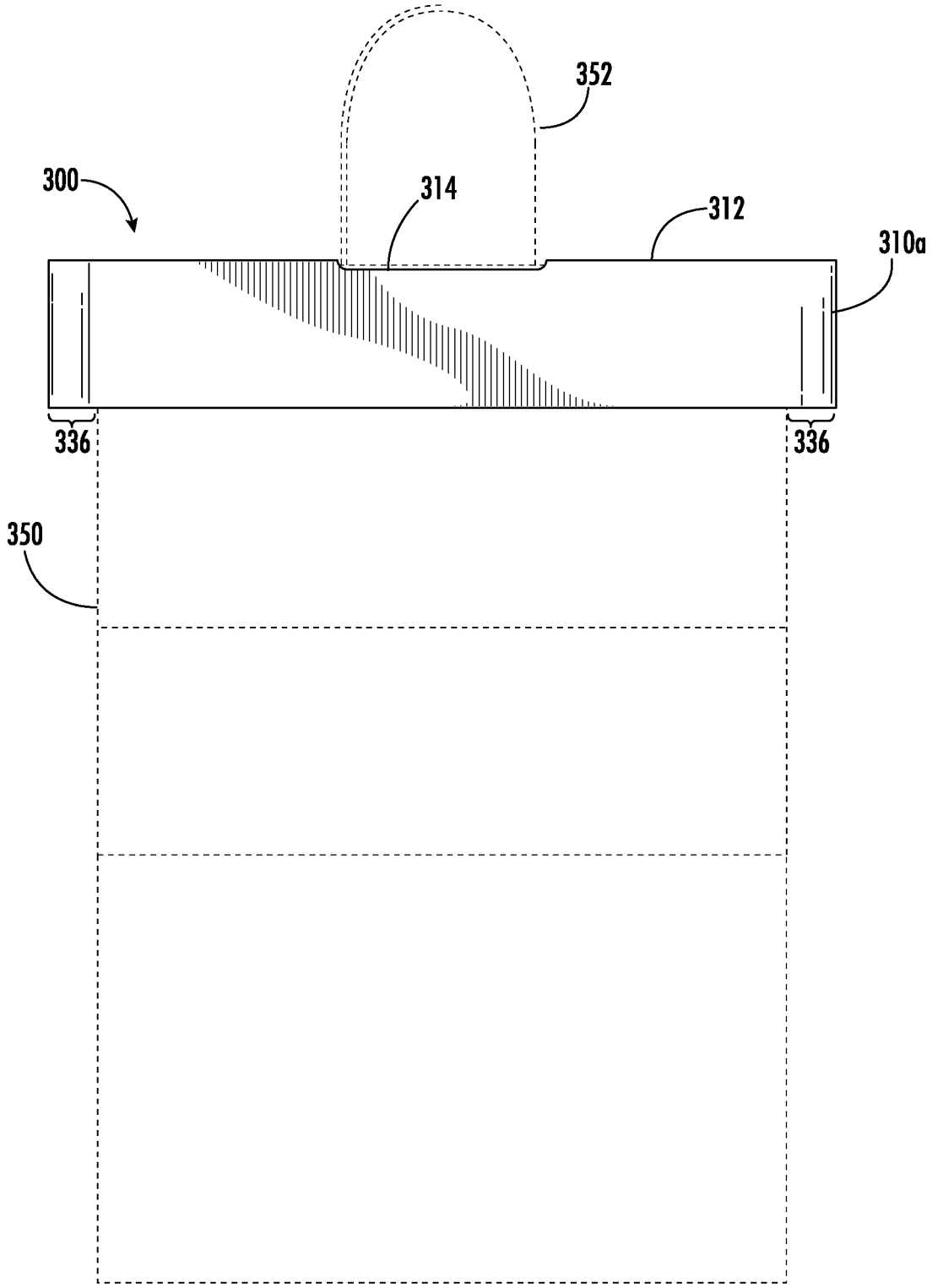
Figure 37:
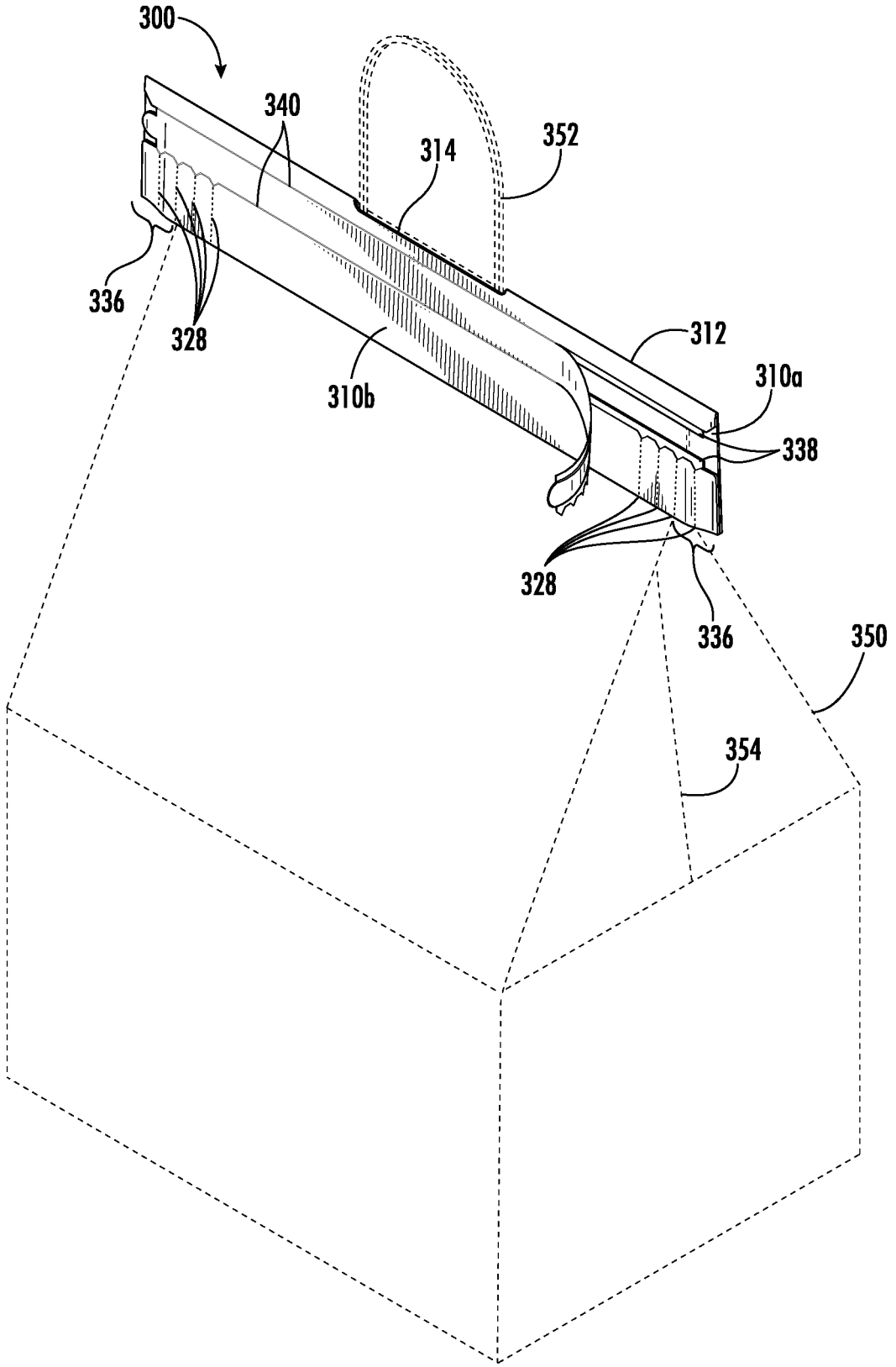
Figure 38:
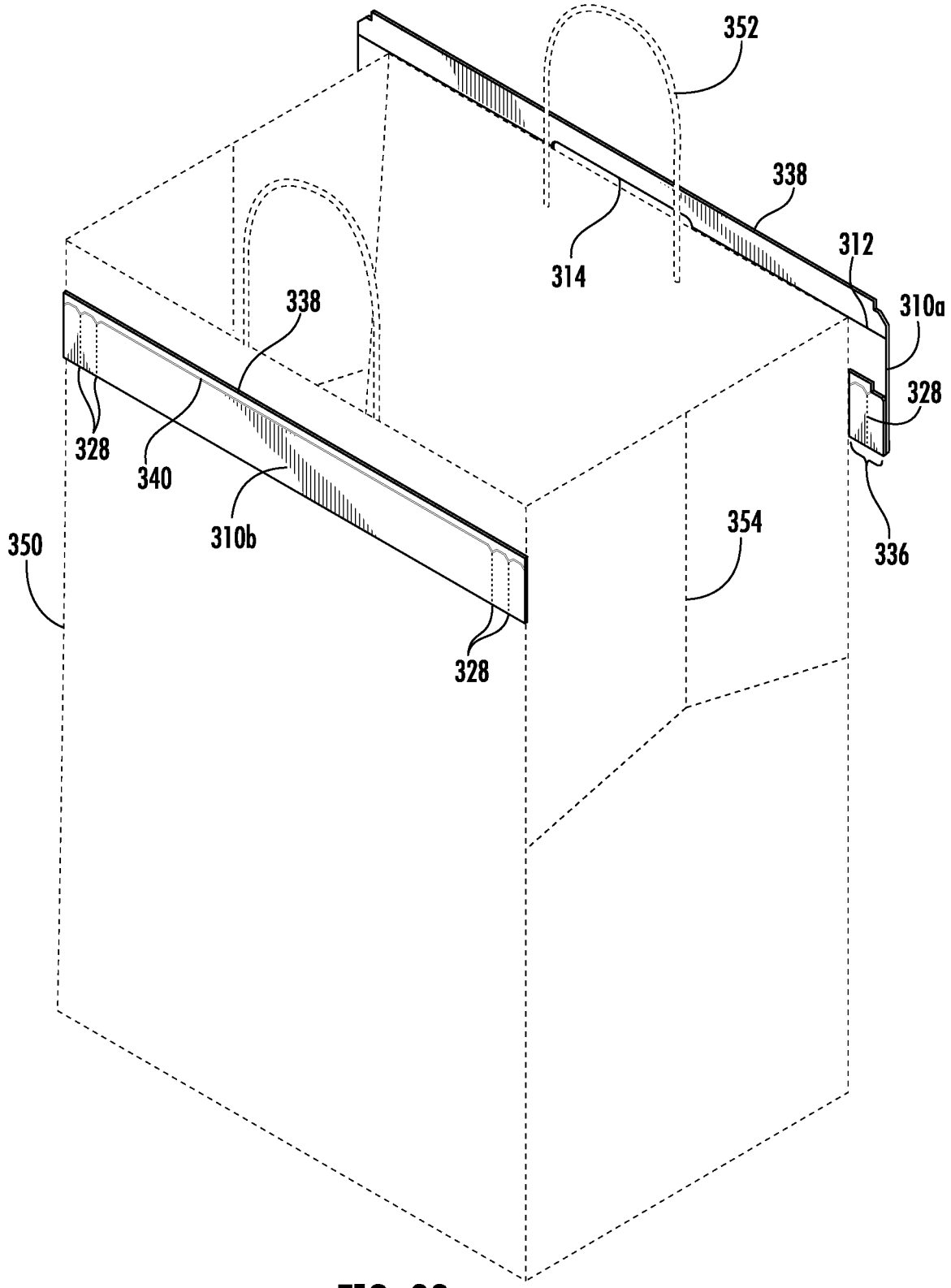
Figure 39:
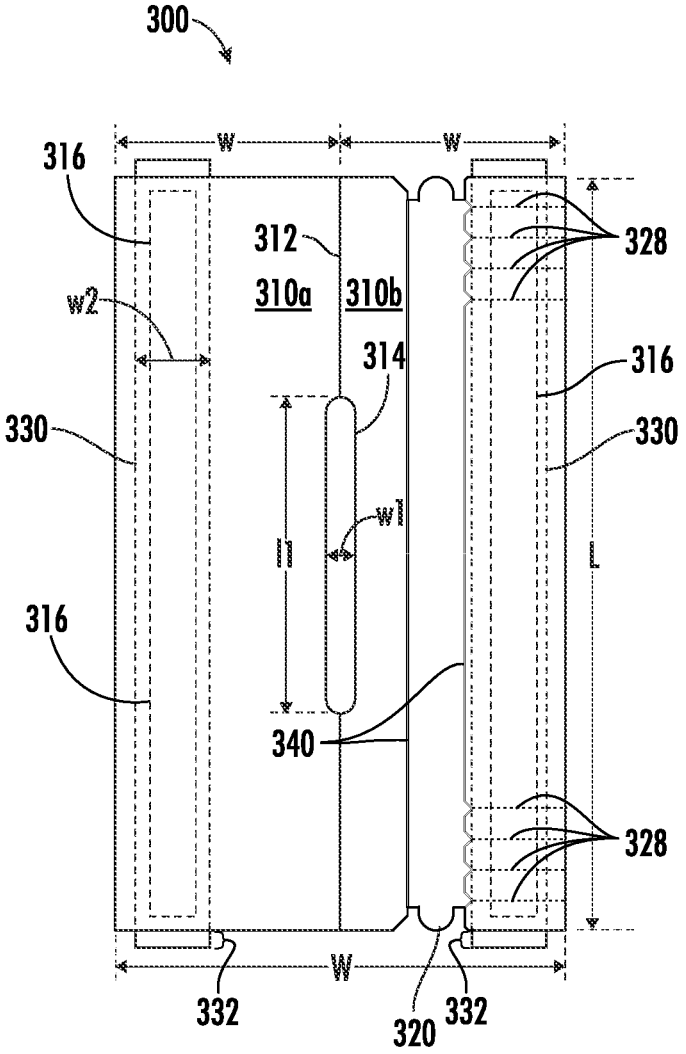
Figure 40:
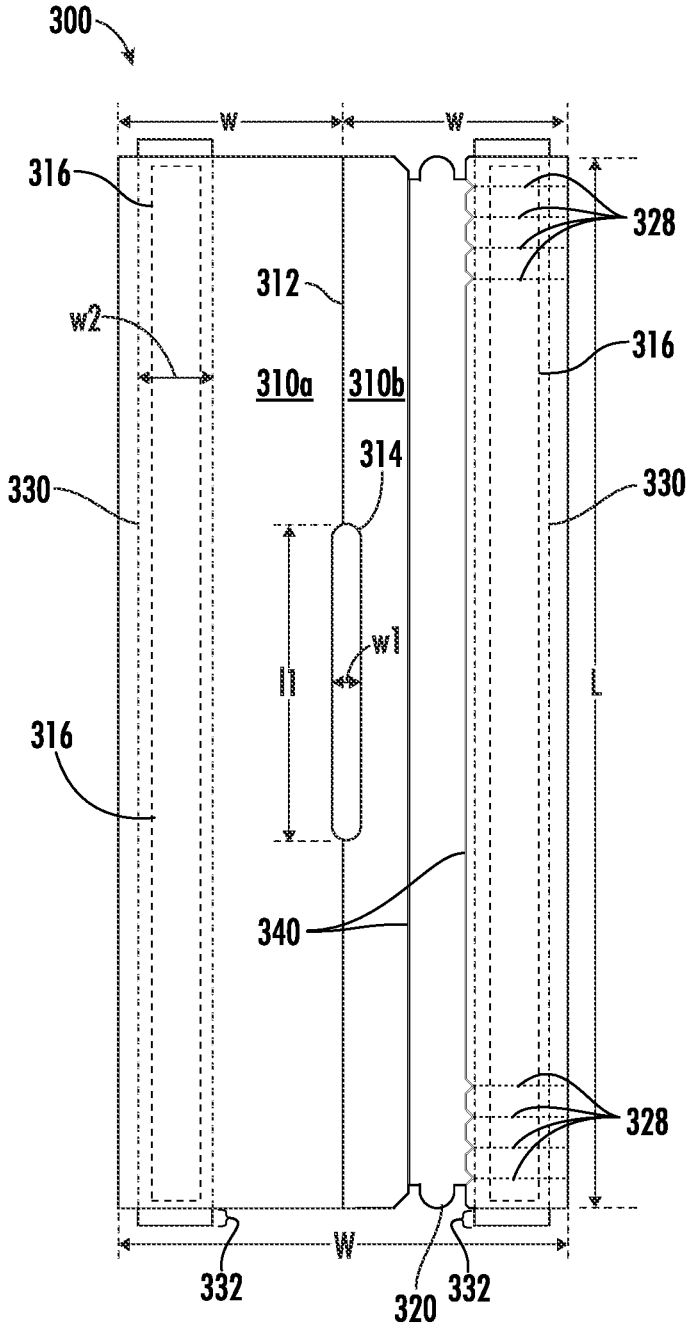
Figure 41:
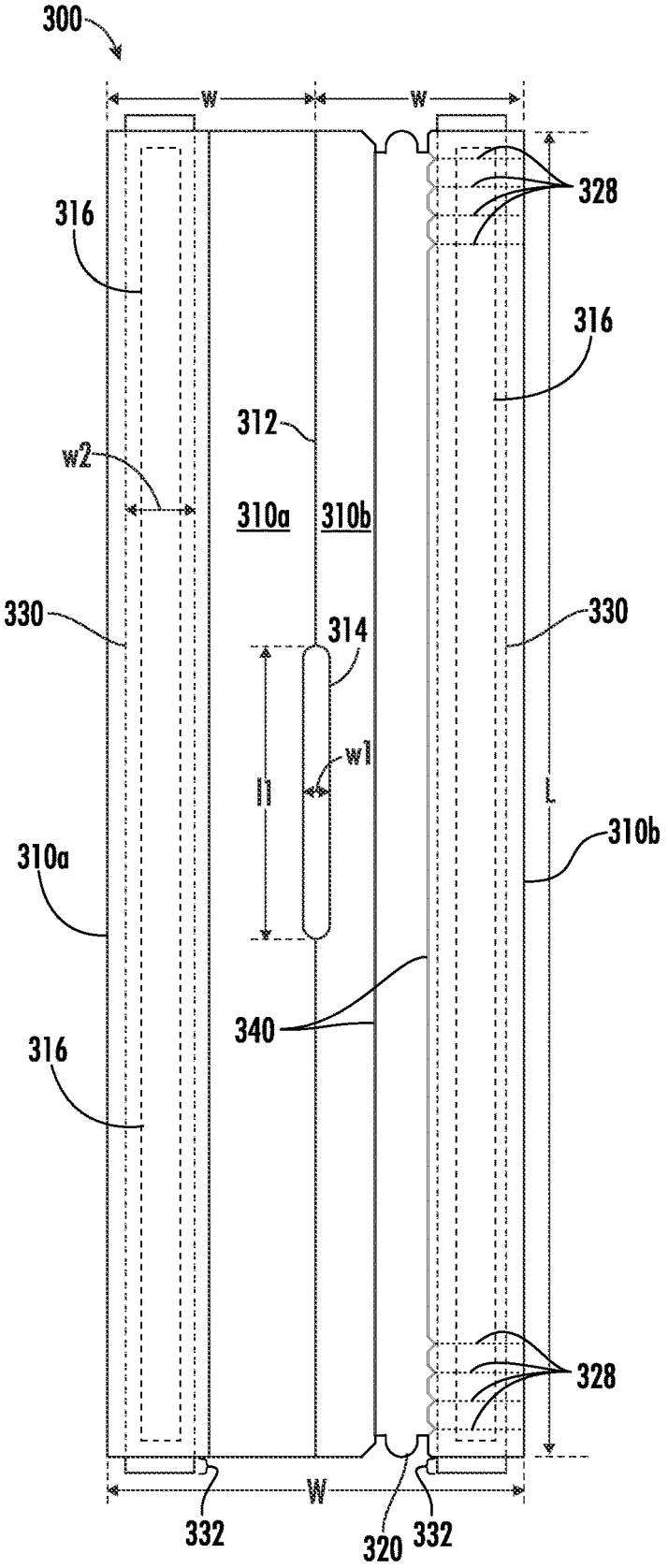
Figure 42A:
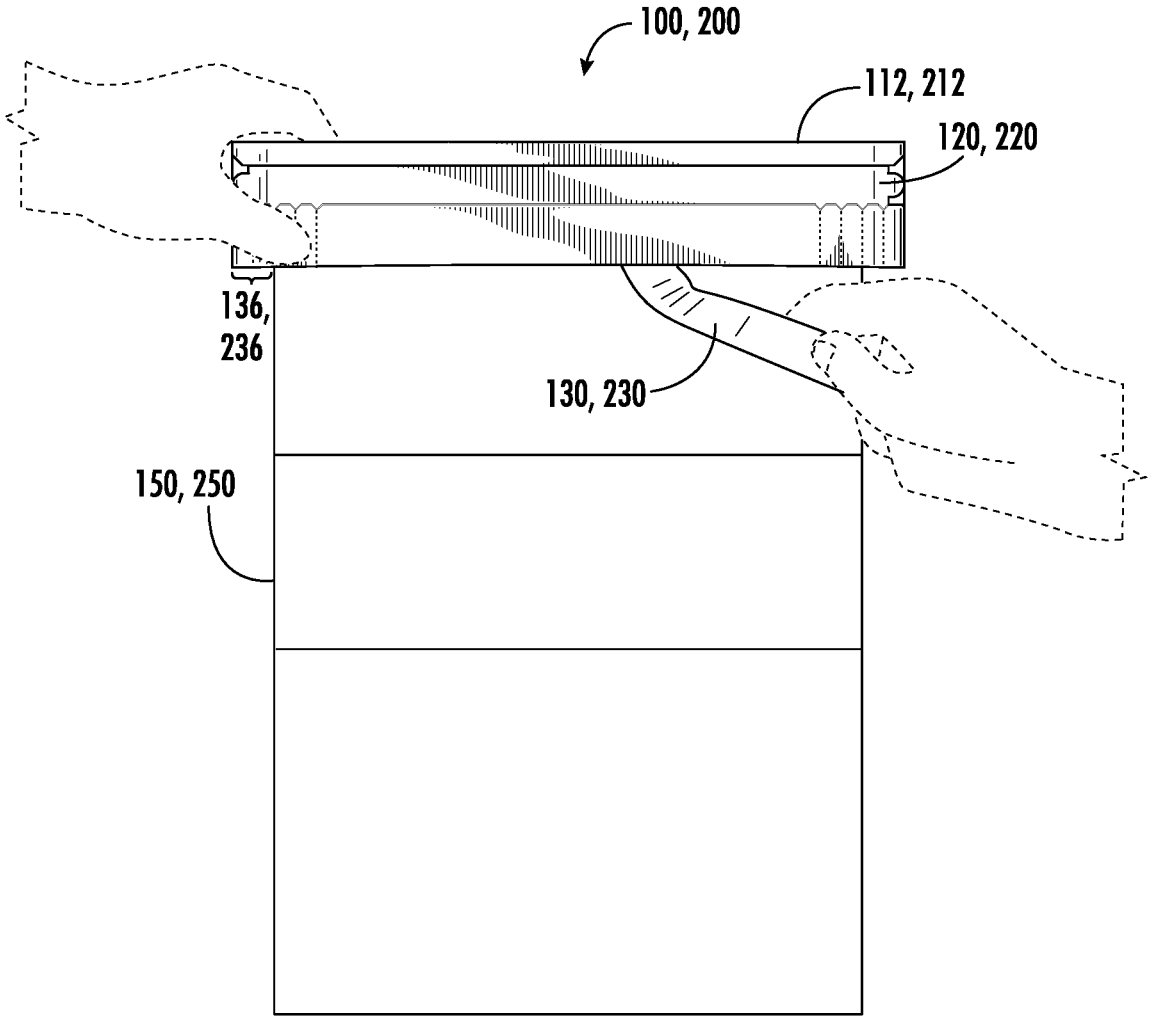
Figure 42B:
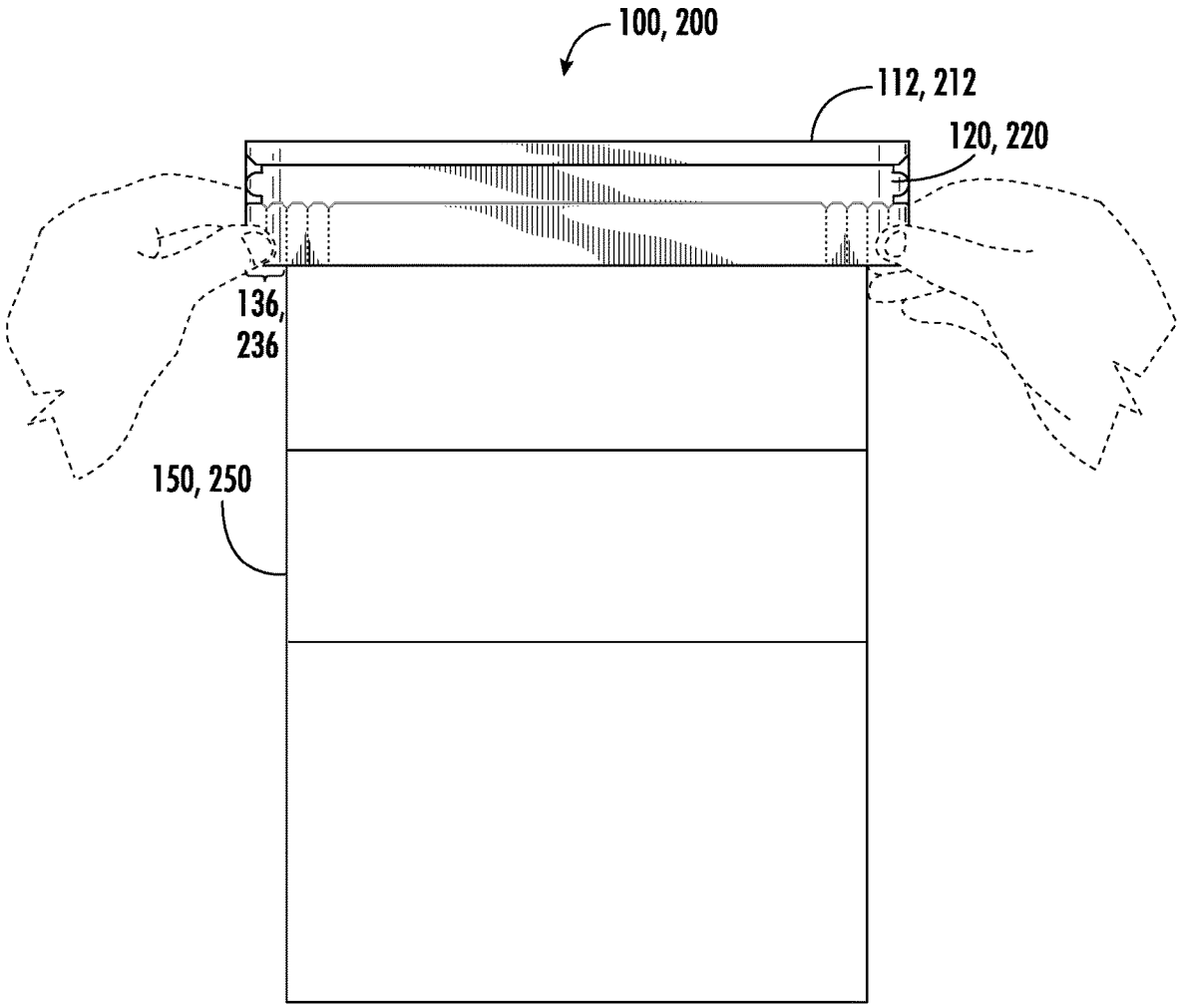
Figure 43A:
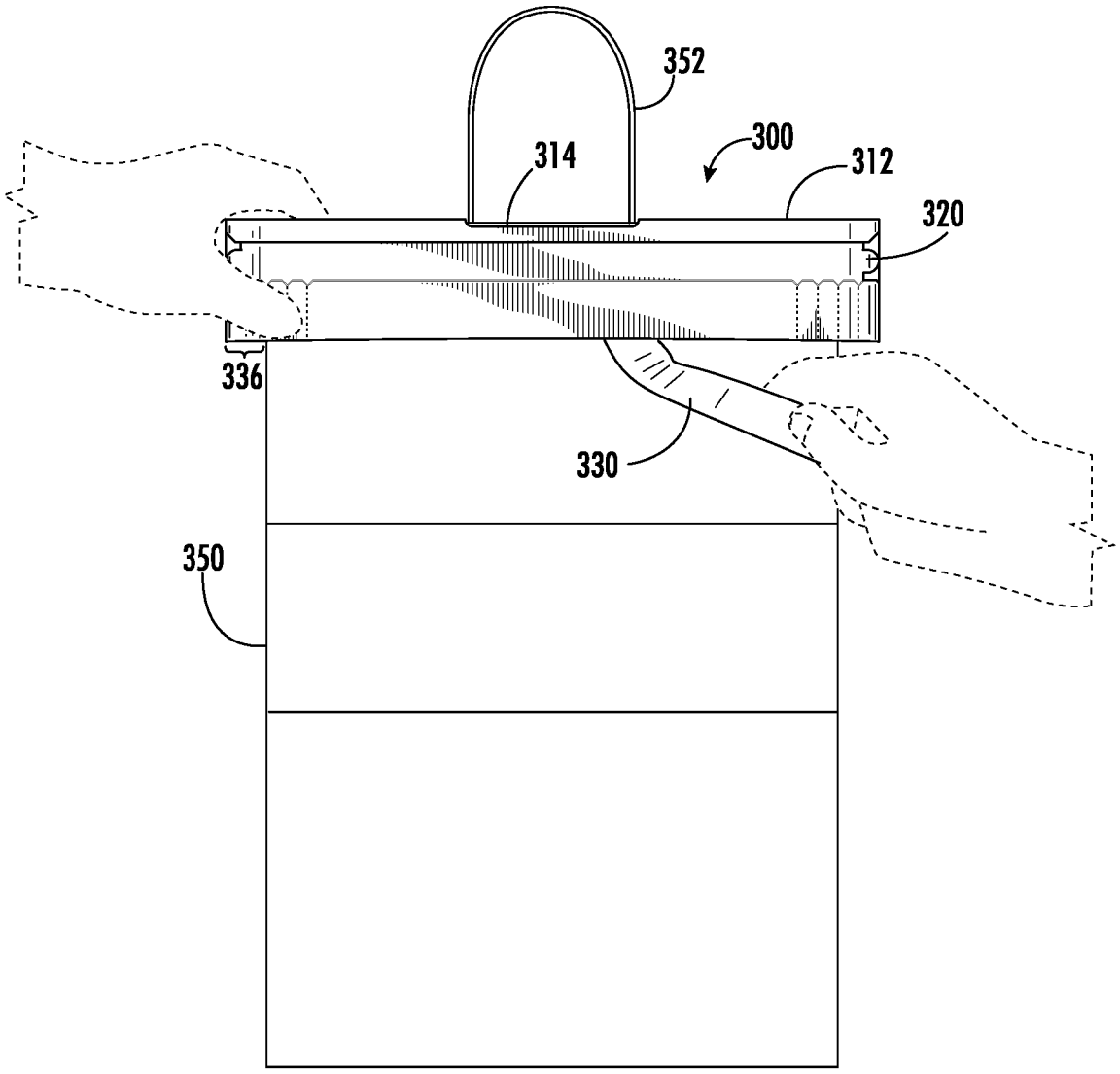
Figure 43B:
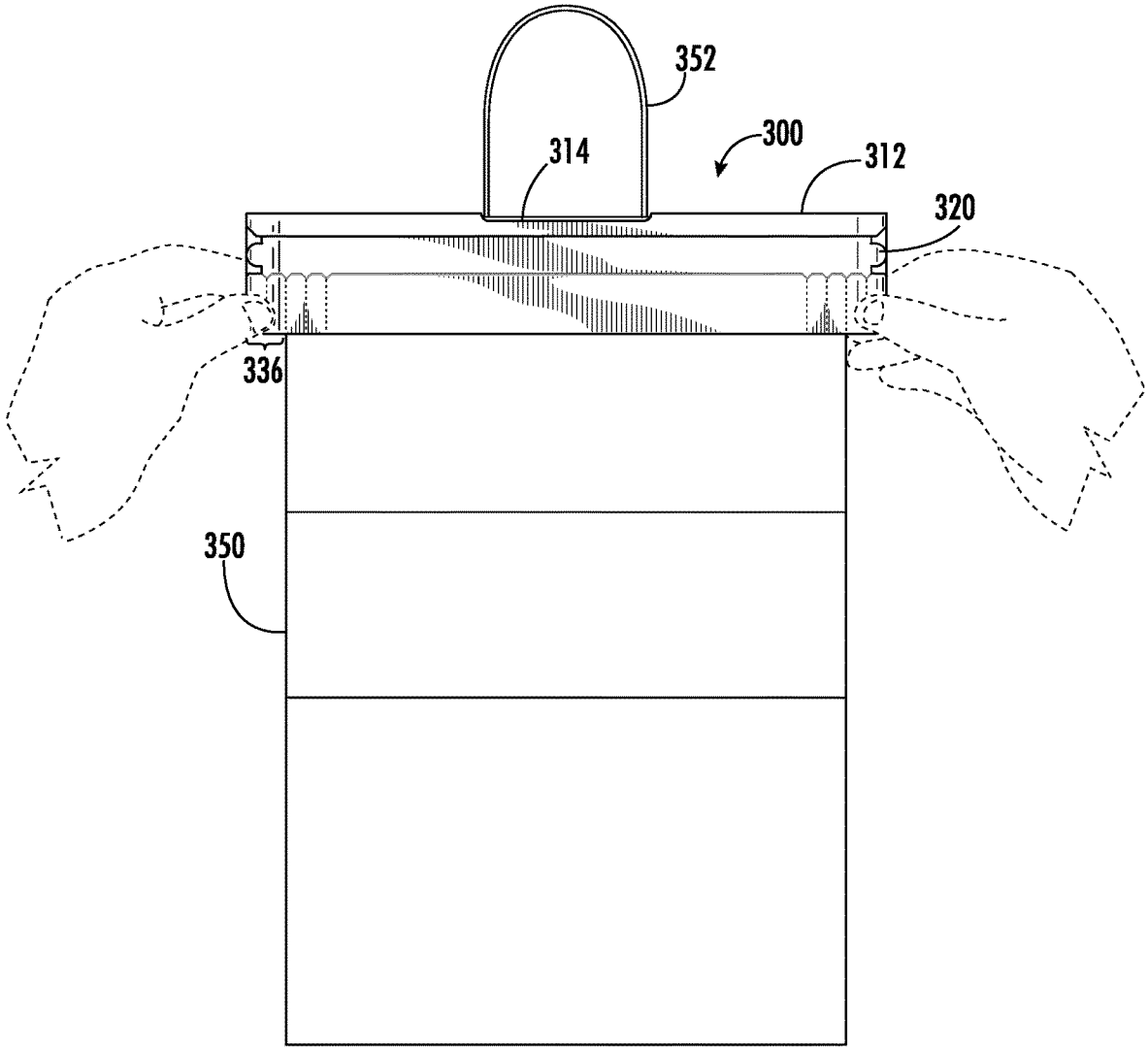
Figure 44:
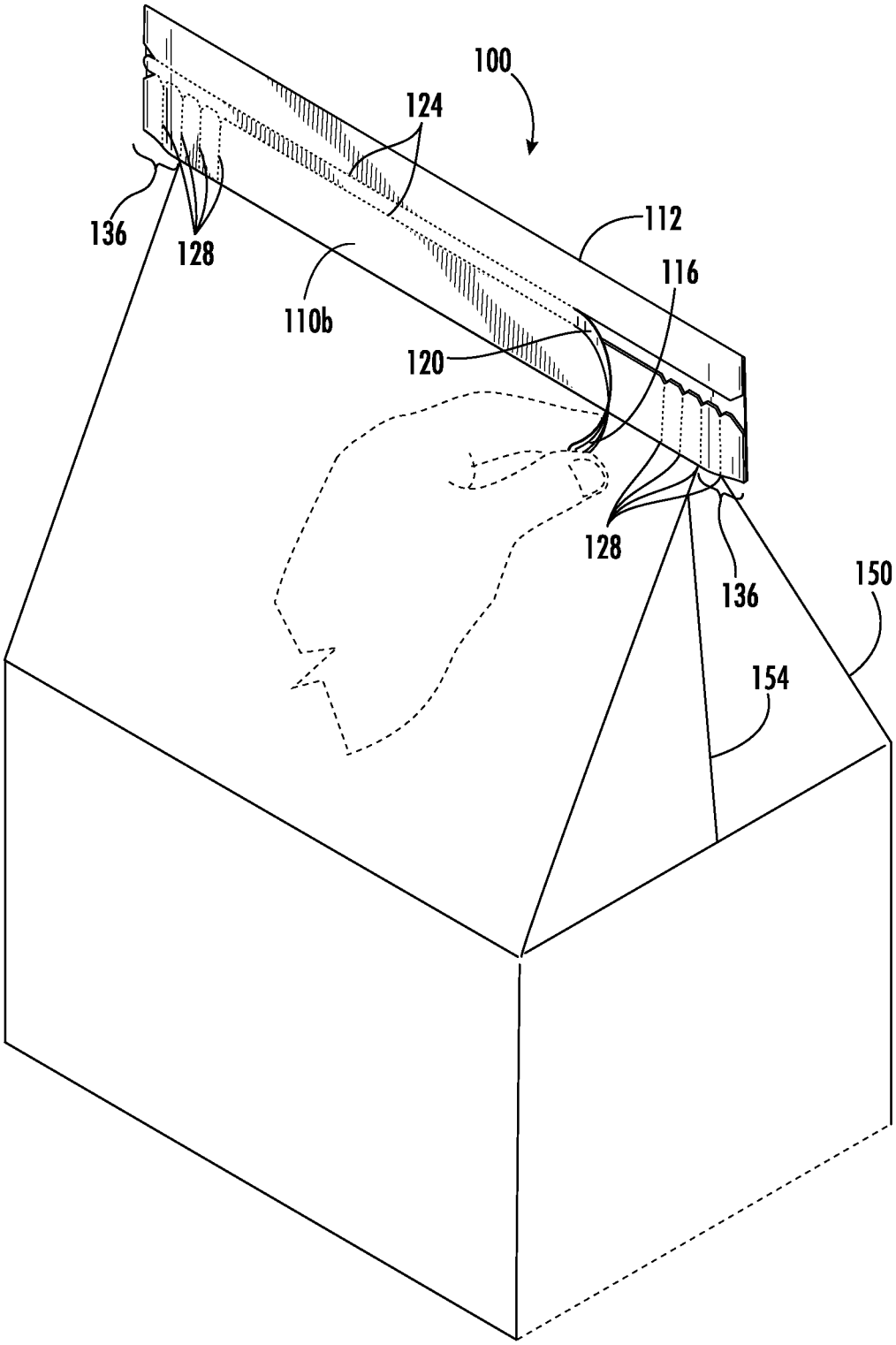
Figure 45:
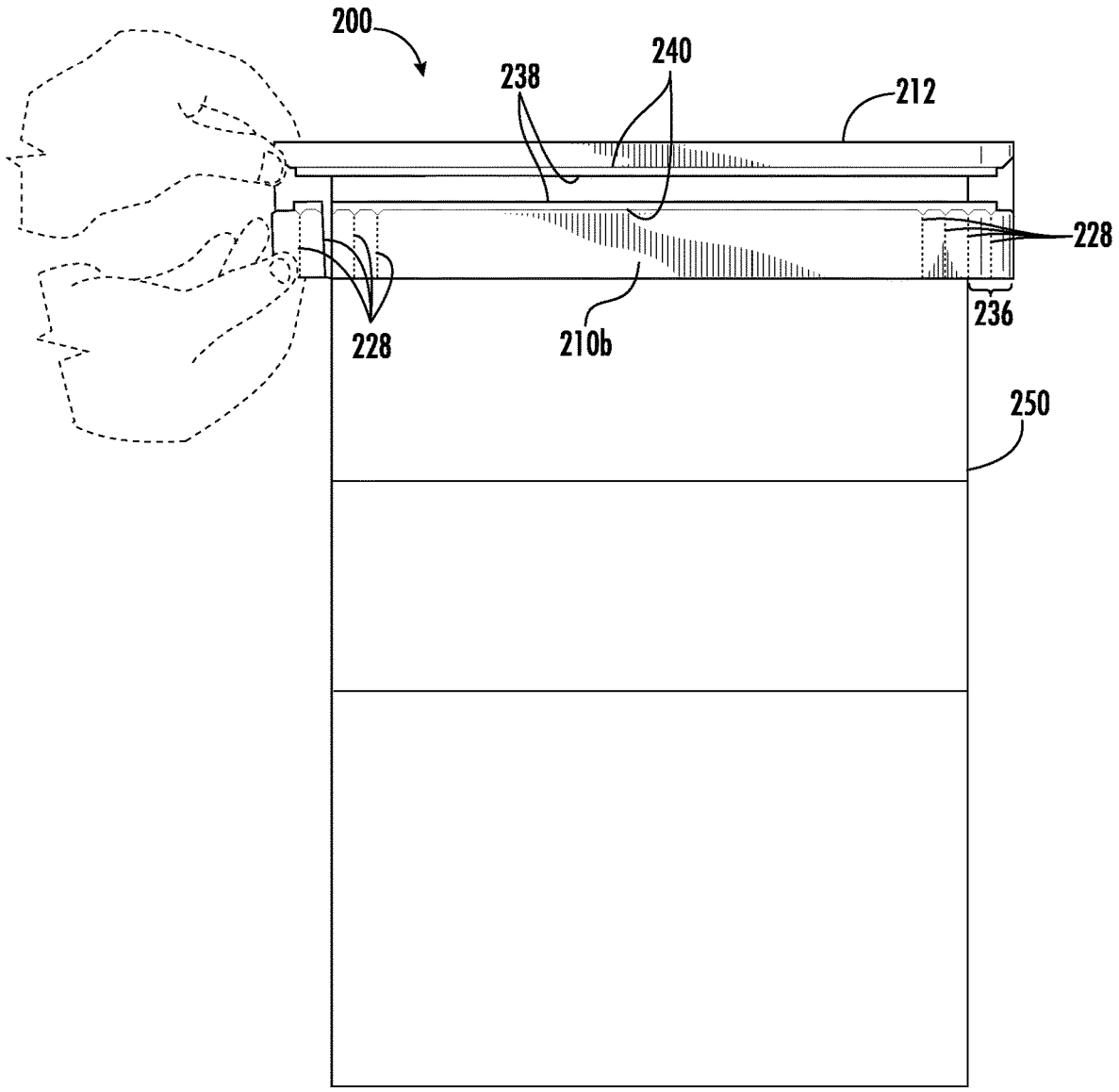
Figure 46:
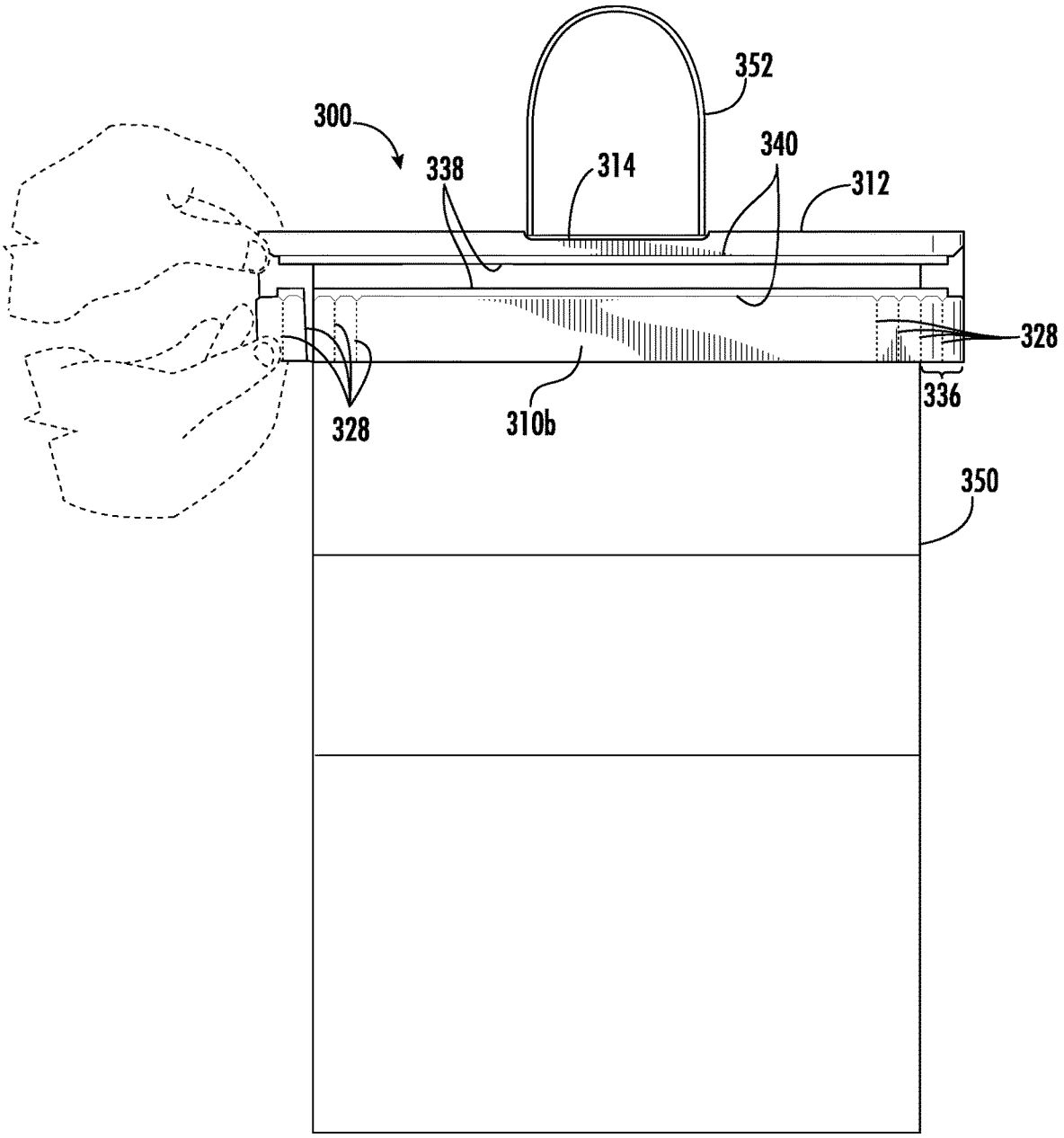

Having thus described the subject matter of the invention in general terms, reference will now be made to the accompanying Drawings, which are not necessarily drawn to scale, and wherein:

FIG. 1 is a perspective view of a tamper-evident bag seal in an unfolded pre-installed state, in accordance with an embodiment of the invention;

FIG. 2 is a top plan view thereof;

FIG. 3 is bottom plan view thereof;

FIG. 4 is a front perspective view of an example of the tamper-evident bag seal of FIG. 1 shown in a semi-folded pre-installed state, in accordance with an embodiment of the invention;

FIG. 5 is a rear perspective view of an example of the tamper-evident bag seal of FIG. 1 shown in a semi-folded pre-installed state, in accordance with an embodiment of the invention;

FIG. 6 is a front perspective view of the tamper-evident bag seal of FIG. 1 shown as installed on a bag in a sealed configuration, in accordance with an embodiment of the invention;

FIG. 7 is a front elevation view thereof;

FIG. 8 is a rear elevation view thereof;

FIG. 9 is a perspective view of the tamper-evident bag seal of FIG. 1 shown as installed on a bag in a partially unsealed and tampered evident configuration, in accordance with an embodiment of the invention;

FIG. 10 is a perspective view of the tamper-evident bag seal of FIG. 1 shown as installed on a bag in a fully unsealed and tampered evident configuration, in accordance with an embodiment of the invention;

FIGS. 11 through 13 illustrate schematic views of examples of the tamper-evident bag seal of FIG. 1 showing different sizes thereof for use with different sized bags, in accordance with embodiments of the invention;

FIG. 14 is a perspective view of a tamper-evident bag seal in an unfolded pre-installed state showing an alternate embodiment, in accordance with an embodiment of the invention;

FIG. 15 is a top plan view thereof;

FIG. 16 is bottom plan view thereof;

FIG. 17 is a cross-sectional view along line 17-17 of FIG. 15;

FIG. 18 is a front perspective view of an example of the tamper-evident bag seal of FIG. 14 shown in a semi-folded pre-installed state, in accordance with an embodiment of the invention;

FIG. 19 is a rear perspective view of an example of the tamper-evident bag seal of FIG. 14 shown in a semi-folded pre-installed state, in accordance with an embodiment of the invention;

FIG. 20 is a front perspective view of the tamper-evident bag seal of FIG. 14 shown as installed on a bag in a sealed configuration, in accordance with an embodiment of the invention;

FIG. 21 is a front elevation view thereof;

FIG. 22 is a rear elevation view thereof;

FIG. 23 is a perspective view of the tamper-evident bag seal of FIG. 14 shown as installed on a bag in a partially unsealed and tampered evident configuration, in accordance with an embodiment of the invention;

FIG. 24 is a perspective view of the tamper-evident bag seal of FIG. 14 shown as installed on a bag in a fully unsealed and tampered evident configuration, in accordance with an embodiment of the invention;

FIGS. 25 through 27 illustrate schematic views of examples of the tamper-evident bag seal of FIG. 14 showing different sizes thereof for use with different sized bags, in accordance with embodiments of the invention;

FIG. 28 is a perspective view of a tamper-evident bag seal in an unfolded pre-installed state showing an alternate embodiment, in accordance with an embodiment of the invention;

FIG. 29 is a top plan view thereof;

FIG. 30 is bottom plan view thereof;

FIG. 31 is a cross-sectional view along line 31-31 of FIG. 39;

FIG. 32 is a front perspective view of an example of the tamper-evident bag seal of FIG. 28 shown in a semi-folded pre-installed state, in accordance with an embodiment of the invention;

FIG. 33 is a rear perspective view of an example of the tamper-evident bag seal of FIG. 28 shown in a semi-folded pre-installed state, in accordance with an embodiment of the invention;

FIG. 34 is a front perspective view of the tamper-evident bag seal of FIG. 28 shown as installed on a bag in a sealed configuration, in accordance with an embodiment of the invention;

FIG. 35 is a front elevation view thereof;

FIG. 36 is a rear elevation view thereof;

FIG. 37 is a perspective view of the tamper-evident bag seal of FIG. 28 shown as installed on a bag in a partially unsealed and tampered evident configuration, in accordance with an embodiment of the invention;

FIG. 38 is a perspective view of the tamper-evident bag seal of FIG. 28 shown as installed on a bag in a fully unsealed and tampered evident configuration, in accordance with an embodiment of the invention;

FIGS. 39 through 41 illustrate schematic views of examples of the tamper-evident bag seal of FIG. 28 showing different sizes thereof for use with different sized bags, in accordance with embodiments of the invention;

FIGS. 42A-42B and 43A-43B illustrate a user at various stages of installing the tamper-evident bag seal, in accordance with an embodiment of the invention; and FIGS. 44, 45, and 46 illustrate a user in the process of accessing contents within a bag sealed with a tamper-evident bag seal installed thereon, in accordance with an embodiment of the invention.

DETAILED DESCRIPTION

The subject matter of the invention now will be described more fully hereinafter with reference to the accompanying Drawings, in which some, but not all embodiments of the subject matter of the invention are shown. Like numbers refer to like elements throughout. The subject matter of the invention may be embodied in many different forms and should not be construed as limited to the embodiments set forth herein; rather, these embodiments are provided so that this disclosure will satisfy applicable legal requirements. Indeed, many modifications and other embodiments of the subject matter of the invention set forth herein will come to mind to one skilled in the art to which the subject matter of the invention pertains having the benefit of the teachings presented in the foregoing descriptions and the associated Drawings. Therefore, it is to be understood that the subject matter of the invention is not to be limited to the specific embodiments disclosed and that modifications and other embodiments are intended to be included within the scope of the appended claims.

In some embodiments, the subject matter of the invention provides a tamper-evident bag seal including a tear-away strip and vertical perforations, and related methods of use thereof.

In some embodiments, the tamper-evident bag seal is provided as an add-on device to an existing bag that otherwise does not include a tamper-evident feature. Once installed on the bag, the tamper-evident bag seal provides a tamper-evident sign or indicator that shows that the bag has been opened and potentially that the contents of the bag have been accessed/tampered with. The tamper-evident bag seal may be, for example, a paper or paperboard panel (or any other suitable material) that folds over the handles of an existing bag and is secured to the sides of the bag. The tamper-evident bag seal may be provided in different sizes (e.g., small, medium and large) that correlate to different size bags and/or bag handle sizes. The tamper-evident bag seal may be used with non-handle bags, or with bags having handles, including several different handle configurations, such as, but not limited to, plastic, plastic rope, plastic ribbon, injection molded plastic, paper, and rope handles, or alternatively no handles.

The tamper-evident bag seal may include, for example, a fold-over panel or card that has an adhesive strip, such as, but not limited to, adhesive strips/beads, double sided tape, or other suitable material/technique, on each side of the fold-over card, i.e., on what would be the bag facing side of the fold-over card. Further, at least one of the fold-over panels or cards may include a tear-away strip (or perforated tear strip), such as a horizontal mailer style pull strip. The fold-over card may also include one or more vertical perforations along opposing side portions of at least one side of the fold-over card. The vertical perforations would correlate with varied bag widths. In some embodiments, the fold-over card may include an opening for fitting over handles of the bag for use with handled bags. In some embodiments, the fold-over card may be solid, without a handle opening for use with bags without handles.

In use, after contents (e.g., food) are placed into the bag, the fold-over card that fits the bag may be fitted over the top portion of the bag to cover the opening of the bag. Once installed over the top portion of the bag and covering the opening, an adhesive liner may be removed from each side of the card exposing the adhesive layer of the adhesive strip, and then the sides of fold-over card may be folded downward into contact with sides of the bag and secured thereto, and the overhanging portions of the fold-over card that extend past the edges of the bag are adhered to one another. Accordingly, the tamper-evident bag seal is used to seal the bag until the tear-away strip (or perforated tear strip), and vertical perforations, are torn away and allowing access to the contents.

Referring to FIGS. 1-5 illustrate various views of an example tamper-evident bag seal 100 including a tear-away strip 120 and vertical separation lines, such as vertical perforations 128, in a pre-installed and untampered with state.

Referring to FIGS. 6-8 illustrate various views of an example of tamper-evident bag seal 100 including tear-away strip 120 and vertical perforations 128 that is fully installed on a bag 150 and in a sealed and untampered with state. In this state, bag 150 is in a "secure" condition because tear-away strip 120 and vertical perforations 128 of tamper-evident bag seal 100 is fully intact. That is, a "tamper-evident" condition is not present because tear-away strip 120 and/or vertical perforations 128 have not been compromised.

Referring to FIG. 9 illustrates an example of tamper-evident bag seal 100 installed on a bag 150 with tear-away strip 120 partially removed. In this state, a "tamper-evident" condition is present because tear-away strip 120 has been at least partially compromised. Referring to FIG. 10 illustrates an example of tamper-evident bag seal 100 installed on a bag 150 with tear-away strip 120 fully removed and one or more of the vertical perforations 128 compromised. In this state, a "tamper-evident" condition is present because tear-away strip 120 has been fully removed and one or more of the vertical perforations 128 are compromised.

Referring to FIGS. 11-13 illustrate other non-limiting examples of different size tamper-evident bag seals 100, including tear-away strip 120 vertical perforations 128 in a pre-installed and untampered with state.

Referring to FIGS. 14-19 illustrate various views of an example tamper-evident bag seal 200 including a tear-away strip 220 and vertical perforations 228 in a pre-installed and untampered with state.

Referring to FIGS. 20-22 illustrate various views of an example of tamper-evident bag seal 200 including tear-away strip 220 and vertical perforations 228 that is fully installed on a bag 250 and in a sealed and untampered with state. In this state, bag 250 is in a "secure" condition because tear-away strip 220 and vertical perforations 228 of tamper-evident bag seal 200 is fully intact. That is, a "tamper-evident" condition is not present because tear-away strip 220 and/or vertical perforations 228 have not been compromised.

Referring to FIG. 23 illustrates an example of tamper-evident bag seal 200 installed on a bag 250 with tear-away strip 220 partially removed. In this state, a "tamper-evident" condition is present because tear-away strip 220 has been at least partially compromised.

Referring to FIG. 24 illustrates an example of tamper-evident bag seal 200 installed on a bag 250 with tear-away strip 220 fully removed and one or more of the vertical perforations 228 compromised. In this state, a "tamper-evident" condition is present because tear-away strip 220 has been fully removed and one or more of the vertical perforations 228 are compromised.

Referring to FIGS. 25-27 illustrate other non-limiting examples of different size tamper-evident bag seals 200, including tear-away strip 220 vertical perforations 228 in a pre-installed and untampered with state.

Referring to FIGS. 28-33 illustrate various views of an example tamper-evident bag seal 300 including a tear-away strip 320 and vertical perforations 328 in a pre-installed and untampered with state.

Referring to FIGS. 34-36 illustrate various views of an example of tamper-evident bag seal 300 including tear-away strip 320 and vertical perforations 328 that is fully installed on a bag 350 and in a sealed and untampered with state. In this state, bag 350 is in a "secure" condition because tear-away strip 320 and vertical perforations 328 of tamper-evident bag seal 300 is fully intact. That is, a "tamper-evident" condition is not present because tear-away strip 320 and/or vertical perforations 328 have not been compromised.

Referring to FIG. 37 illustrates an example of tamper-evident bag seal 300 installed on a bag 350 with tear-away strip 320 partially removed. In this state, a "tamper-evident" condition is present because tear-away strip 320 has been at least partially compromised.

Referring to FIG. 38 illustrates an example of tamper-evident bag seal 200 installed on a bag 350 with tear-away strip 320 fully removed and one or more of the vertical perforations 328 compromised. In this state, a "tamper-evident" condition is present because tear-away strip 320 has been fully removed and one or more of the vertical perforations 328 are compromised.

Referring to FIGS. 39-41 illustrate other non-limiting examples of different size tamper-evident bag seals 300, including tear-away strip 320 vertical perforations 328 in a pre-installed and untampered with state.

Referring to FIGS. 42A-42B illustrate an example of a user at various stages of installing the tamper-evident bag seal (100, 200) on a bag (150, 250).

Referring to FIGS. 43A-43B illustrate an example of a user at various stages of installing the tamper-evident bag seal (300) on a bag (350).

Referring to FIG. 44 illustrates an example of a user in the process of accessing contents from within a bag 150 sealed with a tamper-evident bag seal 100 installed thereon.

Referring to FIG. 45 illustrates an example of a user in the process of accessing contents from within a bag 250 sealed with a tamper-evident bag seal 200 installed thereon.

Referring to FIG. 46 illustrates an example of a user in the process of accessing contents from within a bag 350 sealed with a tamper-evident bag seal 300 installed thereon.

With reference to FIGS. 1-13, in one non-limiting example, tamper-evident bag seal 100 may be made of paperboard or any other suitable material, and may be of varying thicknesses based on application. In one non-limiting example, tamper-evident bag seal 100 may be made of paperboard, and may be in the range of about 0.012-inches thick (or any other suitable thickness greater than or less than 0.012 inches). Tamper-evident bag seal 100 may include two panels or flaps 110 (e.g., 110*a*, 110*b*) divided by a fold 112. An adhesive strip 116, such as, but not limited to, adhesive strips/beads, double sided tape, and/or other suitable adhesive technique, mechanism, and/or material, may be provided on a bag facing side of each of the two panels or flaps 110. Tamper-evident bag seal 100 may further include a tear-away strip 120, such as, but not limited to, for example, a mailer style pull strip. The tear-away strip 120 may be provided about midway of at least one of the two panels or flaps 110 and may extend horizontally along the length of the panel or flap 110 on which it is provided. The tear-away strip 120 may be a perforated tear strip and may have a tear line 124 on one or both sides thereof. In one example, the perforated tear strip may alternatively be a scored tear strip with score lines replacing tear lines 124. The tear line 124 does not necessarily have to be a perforated or scored tear line, but rather could be any suitable technique, mechanism, and/or material for providing a weakened tear or separation line.

Tamper-evident bag seal 100 may further include vertical separation lines, such as vertical perforations 128, disposed along opposing end portions of at least one of the panels or flaps 110. The vertical perforations 128 may extend vertically from a bottom edge of its respective panel or flap 110 up to tear-away strip 120. In one example, the vertical perforations 128 extend up to the tear line 124 most proximate thereto, i.e., the edge facing tear line 124 of the tear-away strip 120, and may intersect the tear line 124. The vertical perforations 128 may be scored with score lines instead of perforated lines replacing the perforations. The vertical perforations 128 do not necessarily have to be a perforated or scored, but could be replaced with any suitable technique, mechanism, and/or material for providing a weakened tear/separation line. In one embodiment, the vertical perforations 128 would correlate with varied bag widths. In one example, when installed on a bag 150, respective vertical perforations 128 on opposing end portions of a panel or flap 110 would align with, or be slightly past, its respective outer edge of the bag 150. In one example, vertical perforations 128 are parallel with, and spaced a distance from one another. In one non-limiting example, tamper-evident bag seal 100 may include four (4) vertical perforations 128 spaced apart from one another on each of the opposing end portions of one or both of the panels or flaps 110 (e.g., on one or both of flaps 110*a* and/or 110*b*), for example, the vertical perforations 128 on each of the opposing end portions of their respective panel or flap 110 may be spaced in the range of about ½ inch apart. The tamper-evident bag seal 100 is not limited to four (4) vertical perforations 128 on each opposing end portion of one or both of the panels or flaps 110, and in alternative embodiments may include less than or more than four (4) vertical perforations 128 on each opposing end portion of one or both of the panels or flaps 110. Further, the spacing between adjacent vertical perforations 128 is not limited to being in the range of about ½ inch apart, but could be spaced less than or more than ½ inch apart.

In one example, tamper-evident bag seal 100 may be foldable along fold 112, as shown for example in FIGS. 4 and 5.

In one non-limiting example, tear-away strip 120 may be provided about midway of flap 110*a*. In another non-limiting example, tear-away strip 120 may be provided about midway of flap 110*b*. In yet another non-limiting example, both flaps 110*a* and 110*b* include a tear-away strip 120. Further, tear-away strip 120 is not limited to being provided about midway of flap 110, but may be provided at any point thereon. For added strength, a length of tear strip backing 122 may be provided along tear-away strip 120 (e.g., along the bag facing side of tear-away strip 120). Tear strip backing 122 may be formed, for example, of a thin cast polypropylene backing, such as, but not limited to, 2.35 mil poly material, a line of adhesive material, or any other suitable material. Tear strip backing 122 may be provided as a reinforcing element for tearing tear-away strip 120, for example, to help tear-away strip 120 to be removed as a single continuous strip. In some embodiments, tamper-evident bag seal 100 may be absent tear strip backing 122.

Tamper-evident bag seal 100 may be provided as an add-on device to an existing bag that otherwise does not include a tamper-evident feature, such as bag 150 that does not otherwise include a tamper-evident feature.

The tear-away strip 120 and/or vertical perforations 128 are the mechanism for gaining access to and fully opening bag 150, and wherein tear-away strip 120 and vertical perforations 128, are also the tamper-evident feature of tamper-evident bag seal 100, wherein when either or both of tear-away strip 120 and/or vertical perforations 128 are compromised the tamper-evident bag seal 100 is in a tamper-evident state.

Referring now to FIGS. 11-13 are plan views of non-limiting examples of different sized tamper-evident bag seals 100 for use with different sized bags. Generally, tamper-evident bag seal 100 may have an overall length L and an overall width W. Further, each panel or flap 110 may have a width w. Adhesive strip 116 may be, for example, a strip or beads of adhesive material, double sided tape, 2 ply, 4 ply, or other suitable type tape, and/or other suitable adhesive technique, mechanism, and/or material; and may include a removable adhesive liner 130, such as, but not limited to calendared paper, or other suitable material, the removal of which may expose an adhesive layer of the adhesive strip 116. Additionally, the length of removable adhesive liner 130 and/or adhesive strip 116, may be greater than L, providing an extended portion 132. The extended portion 132 may extend a distance beyond at least one end of one or both of panels or flaps 110 of tamper-evident bag seal 100. In one non-limiting example, the length of the extended portion 132 of the removable adhesive liner 130 and/or adhesive strip 116 may be in the range of, but not limited to, about 0.25 inches. Having a length of removable adhesive liner 130 and/or adhesive strip 116, extending a distance beyond at least one end of one or both of panels or flaps 110 of tamper-evident bag seal 100, preferably allows a user to more easily grasp the extended portion 132 of the removable adhesive liner 130, for example, during installation to remove it thereby exposing the adhesive layer to allow the tamper-evident bag seal 100 to be sealed to a bag 150, as shown, for example, in FIG. 42A.

In the example shown in FIG. 11, tamper-evident bag seal 100 may be designed to fit on a bag about 8-inches wide. In this example, tamper-evident bag seal 100 may have an overall length L of about, but not limited to, 10 inches and an overall width W of about, but not limited to, 6 inches. Further, each panel or flap 110 may have a width w of about, but not limited to, 3 inches. Further, removable adhesive liner 130, in one non-limiting example, may have a width w2 in the range of, but not limited to, about 0.75 inches to about 1 inch, and adhesive strip 116 may have a width narrower than that of the removable adhesive liner 130.

Further, tear-away strip 120 may have a length substantially the same as that of the overall length of the tamper-evident bag seal 100, and may be in the range of, but not limited to, about ⅜ inches wide. Additionally, the tear lines 124 on each side of tear-away strip 120 may be in the range of, but not limited to, about 0.0625-inch×0.0625-inch perforation, or other suitable dimension, or may alternatively be score lines, or other suitable mechanism, technique, and/or material to form a weakened/separation line. Tear strip backing 122 may be about the same length as that of tear-away strip 120, and may be about, but not limited to, 0.125 inches wide. Further, in this example, an opposing pair of corresponding vertical perforations 128 would be space about 8-inches, or slightly more apart, such that they substantially align with the outside edges of the 8-inch wide bag 150.

In the example shown in FIG. 12, tamper-evident bag seal 100 may be designed to fit on a bag in the range of, but not limited to, about 10-inch to about 11-inch wide. In this example, the dimensions of tamper-evident bag seal 100 may be substantially the same as those described hereinabove with reference to FIG. 11 except that the overall length L may be in the range of, but not limited to, about 13 inches. Further, in this example, a first opposing pair of corresponding vertical perforations 128 may be space about 10-inches, or slightly more apart, and a second opposing pair of corresponding vertical perforations 128 may be space about 11-inches, or slightly more apart, such that they substantially align with the outside edges of the 10-inch or 11-inch wide bag 150, respectively.

In the example shown in FIG. 13, tamper-evident bag seal 100 may be designed to fit on a bag in the range of, but not limited to, about 12-inch to 14-inch wide. In this example, the dimensions of tamper-evident bag seal 100 are substantially the same as those described hereinabove with reference to FIG. 11 except that the overall length L may be in the range of, but not limited to, about 16 inches. Further, in this example, a first opposing pair of corresponding vertical perforations 128 may be space about 12-inches, or slightly more apart, and a second opposing pair of corresponding vertical perforations 128 may be space about 14-inches, or slightly more apart, such that they substantially align with the outside edges of the 12-inch or 14-inch wide bag 150, respectively.

Tamper-evident bag seal 100 is not limited to the examples shown in FIGS. 11-13. In other embodiments, tamper-evident bag seal 100 may, for example, be cut to length to more precisely fit any particular bag. The example dimensions of tamper-evident bag seal 100 shown in FIGS. 11-13 are exemplary only and are non-limiting. The components of the tamper-evident bag seal 100 may be provided with any dimensions, e.g., larger or smaller, than the examples listed above with regards to FIGS. 11-13, and tamper-evident bag seal 100 may be sized to fit on a bag smaller than 8 inches and/or larger than 14 inches.

As shown in FIGS. 6-8, the tamper-evident bag seal 100 may be installed on a bag 150, wherein the bag 150 preferably has a width less than the length of the tamper-evident bag seal 100. In such an example embodiment, when installed, opposing overhanging end portions 136 of the tamper-evident bag seal 100 may be adhered to one another via adhesive strip 116. In this configuration, the top portion of bag 150 may be pinched closed, with side gussets 154 folded in, and positioned between panels 110*a* and 110*b* of the tamper-evident bag seal 100 when installed and in the sealed untampered with state, thereby sealing the top opening of bag 150 as well as its side gussets 154.

FIG. 9 illustrates the tamper-evident bag seal 100 of FIGS. 6-8 shown as installed on a bag 150 and in a partially unsealed and tampered evident state, with tear-away strip 120 partially removed/compromised.

FIG. 10 illustrates the tamper-evident bag seal 100 of FIGS. 6-8 shown as installed on a bag 150 in an unsealed and tampered evident state, with tear-away strip 120 fully removed/compromised and one or more of the vertical perforations 128 compromised.

With reference to FIGS. 14-27, in one non-limiting example, tamper-evident bag seal 200 may be made of paperboard or any other suitable material, and may be of varying thicknesses based on application. In one non-limiting example, tamper-evident bag seal 200 may be made of paperboard, and may be in the range of, but not limited to, about 0.012-inch thick (or any other suitable thickness). Tamper-evident bag seal 200 may include two panels or flaps 210 (e.g., 210*a*, 210*b*) divided by a fold 212. An adhesive strip 216, such as, but not limited to, adhesive strips/beads, double sided tape, and/or other suitable adhesive technique, mechanism, and/or material may be provided on a bag facing side of each of the two panels or flaps 210.

Tamper-evident bag seal 200 may further include a tear-away strip 220. The tear-away strip 220 may be provided about midway of at least one of the two panels or flaps 210 and may extend horizontally along the length of the panel or flap 210 on which it is provided. The tear-away strip 220 may include certain inside and outside score cuts to facilitate a substantially smooth tear line. In one embodiment, tear-away strip 220 may include an inside pair of cut score lines 238 and an outside pair of cut score lines 240. In one example, inside cut score lines 238 form the side boundaries of the tear-away strip 220. Inside cut score lines 238 may each be flanked by an outside cut score line 240. In one example, outside cut score line 240 may be offset from its respective inside cut score line 238 by about, but not limited to, an ⅛ inch. The cut score lines 238 and outside pair of cut score lines 240 do not necessarily have to be a scored tear line, but rather could be any suitable technique, mechanism, and/or material for providing a weakened tear or separation lines.

Further, and referring now to a cross-section 17-17 of FIG. 17, inside cut score lines 238 may be cut about 50% through from the inside of the material. By contrast, outside cut score lines 240 may be cut about 50% through from the outside of the material. Inside cut score lines 238 and outside cut score lines 240 of tear-away strip 220 act to facilitate tearing as shown, for example, in FIG. 23, FIG. 24, and FIG. 45. Alternatively, tear-away strip portion 220 may be formed using a pair of 50% offset inside/outside perforation, score, or other weakened tear/separation lines disposed on either side of tear-away strip 220.

Tamper-evident bag seal 200 may further include vertical separation lines, such as vertical perforations 228, disposed along opposing end portions of at least one of the panels or flaps 210. The vertical perforations 228 may extend vertically from a bottom edge of its respective panel or flap 210 up to tear-away strip 220. In one example, the vertical perforations 228 may extend up to the outside cut score line 240 most proximate thereto. The vertical perforations 228 may be scored with score lines instead of perforated lines replacing the perforations. The vertical perforations 228 do not necessarily have to be a perforated or scored, but could be replaced with any suitable technique, mechanism, and/or material for providing a weakened tear/separation line. In one embodiment, the vertical perforations 228 would correlate with varied bag widths. In one example, when installed on a bag 250, respective vertical perforations 228 on opposing end portions of a panel or flap 210 would align with, or be slightly past, its respective outer edge of the bag 250. In one example, vertical perforations 228 are parallel with, and spaced a distance from one another. In one non-limiting example, tamper-evident bag seal 200 may include four (4) vertical perforations 228 spaced apart from one another on each of the opposing end portions of one or both of the panels or flaps 210 (e.g., on one or both of flaps 210*a* and/or 210*b*), for example, the vertical perforations 228 on each of the opposing end portions of their respective panel or flap 210 may be spaced in the range of, but not limited to, about ½ inch apart. The tamper-evident bag seal 200 is not limited to four (4) vertical perforations 228 on each opposing end portion of one or both of the panels or flaps 210, and in alternative embodiments may include less than or more than four (4) vertical perforations 228 on each opposing end portion of one or both of the panels or flaps 210. Further, the spacing between adjacent vertical perforations 228 is not limited to being in the range of about ½ inch apart, but could be spaced less than or more than ½ inch apart.

In one example, tamper-evident bag seal 200 may be foldable along fold 212, as shown for example in FIGS. 18 and 19.

In one non-limiting example, tear-away strip 220 may be provided about midway of flap 210*a*. In another non-limiting example, tear-away strip 220 may be provided about midway of flap 210*b*. In yet another non-limiting example, both flaps 210*a* and 210*b* include a tear-away strip 220. Further, tear-away strip 220 is not limited to being provided about midway of flap 210, but may be provided at any point thereon. For added strength, a length of tear strip backing (not shown, but substantially similar to that of tear strip backing 122) may be provided along tear-away strip 220 (e.g., along the bag facing side of tear-away strip 220). The tear strip backing may be formed, for example, of a thin cast polypropylene backing, such as, but not limited to, 2.35 mil poly material, a line of adhesive material, or any other suitable material. The tear strip backing may be provided as a reinforcing element for tearing tear-away strip 220, for example, to help tear-away strip 220 to be removed as a single continuous strip. In some embodiments, tamper-evident bag seal 200 may be absent tear strip backing.

Tamper-evident bag seal 200 may be provided as an add-on device to an existing bag that otherwise does not include a tamper-evident feature, such as bag 250 that does not otherwise include a tamper-evident feature.

The tear-away strip 220 and/or vertical perforations 228 are the mechanism for gaining access to and fully opening bag 250, and wherein tear-away strip 220 and vertical perforations 228, are also the tamper-evident feature of tamper-evident bag seal 200, wherein when either or both of tear-away strip 220 and/or vertical perforations 228 are compromised the tamper-evident bag seal 200 is in a tamper-evident state.

Referring now to FIGS. 25-27 are plan views of non-limiting examples of different sized tamper-evident bag seals 200 for use with different sized bags. Generally, tamper-evident bag seal 200 may have an overall length L and an overall width W. Further, each panel or flap 210 may have a width w. Adhesive strip 216 may be, for example, a strip or beads of adhesive material, double sided tape, 2 ply, 4 ply, or other suitable type tape, and/or other suitable adhesive technique, mechanism, and/or material, and may include a removable adhesive liner 230, such as, but not limited to calendared paper, or other suitable material, the removal of which may expose an adhesive layer of the adhesive strip 216. Additionally, the length of removable adhesive liner 230 and/or adhesive strip 216, may be greater than L, providing an extended portion 232. The extended portion 232 may extend a distance beyond at least one end of one or both of panels or flaps 210 of tamper-evident bag seal 200. In one non-limiting example, the length of the extended portion 232 of the removable adhesive liner 230 and/or adhesive strip 216 may be in the range of, but not limited to, about 0.25 inches. Having a length of removable adhesive liner 230 and/or adhesive strip 216, extending a distance beyond at least one end of one or both of panels or flaps 210 of tamper-evident bag seal 200, preferably allows a user to more easily grasp the extended portion 232 of the removable adhesive liner 230, for example, during installation to remove it thereby exposing the adhesive layer to allow the tamper-evident bag seal 200 to be sealed to a bag 250, as shown, for example, in FIG. 42A.

In the example shown in FIG. 25, tamper-evident bag seal 200 may be designed to fit on a bag about, but not limited to, 8-inches wide. In this example, tamper-evident bag seal 200 may have an overall length L of about, but not limited to, 10 inches and an overall width W of about, but not limited to, 6 inches. Further, each panel or flap 210 may have a width w of about, but not limited to, 3 inches. Further, removable adhesive liner 230 may, in one non-limiting example, have a width w2 in the range of, but not limited to, about 0.75 inches to about 1 inch, and adhesive strip 216 may have a width narrower than that of the removable adhesive liner 130.

Further, tear-away strip 220 may have a length substantially the same as that of the overall length of the tamper-evident bag seal 200, and may be in the range of, but not limited to, about ⅜ inches wide. The tear strip backing (if any) may be substantially about the same length as that of tear-away strip 220, and may be about, but not limited to, 0.125 inches wide. Further, in this example, an opposing pair of corresponding vertical perforations 228 would be space about 8-inches, or slightly more apart, such that they substantially align with the outside edges of the 8-inch wide bag 250.

In the example shown in FIG. 26, tamper-evident bag seal 200 may be designed to fit on a bag in the range of, but not limited to, about 10-inch to about 11-inch wide. In this example, the dimensions of tamper-evident bag seal 200 may be substantially the same as those described hereinabove with reference to FIG. 25 except that the overall length L may be in the range of, but not limited to, about 13 inches. Further, in this example, a first opposing pair of corresponding vertical perforations 228 may be space about 10-inches, or slightly more apart, and a second opposing pair of corresponding vertical perforations 228 may be space about 11-inches, or slightly more apart, such that they substantially align with the outside edges of the 10-inch or 11-inch wide bag 250, respectively.

In the example shown in FIG. 27, tamper-evident bag seal 200 may be designed to fit on a bag in the range of, but not limited to, about 12-inch to 14-inch wide. In this example, the dimensions of tamper-evident bag seal 200 are substantially the same as those described hereinabove with reference to FIG. 25 except that the overall length L may be in the range of, but not limited to, about 16 inches. Further, in this example, a first opposing pair of corresponding vertical perforations 228 may be space about 12-inches, or slightly more apart, and a second opposing pair of corresponding vertical perforations 228 may be space about 14-inches, or slightly more apart, such that they substantially align with the outside edges of the 12-inch or 14-inch wide bag 250, respectively.

Tamper-evident bag seal 200 is not limited to the examples shown in FIGS. 25-27. In other embodiments, tamper-evident bag seal 200 may, for example, be cut to length to more precisely fit any particular bag. The example dimensions of tamper-evident bag seal 200 shown in FIGS. 25-27 are exemplary only and are non-limiting. The components of the tamper-evident bag seal 200 may be provided with any dimensions, e.g., larger or smaller, than the examples listed above with regards to FIGS. 25-27, and tamper-evident bag seal 200 may be sized to fit on a bag smaller than 8 inches and/or larger than 14 inches.

As shown in FIGS. 20-22, the tamper-evident bag seal 200 may be installed on a bag 250, wherein the bag 250 preferably has a width less than the length of the tamper-evident bag seal 200. In such an example embodiment, when installed opposing overhanging end portions 236 of the tamper-evident bag seal 200 may be adhered to one another via adhesive strip 216. In this configuration, the top portion of bag 250 may be pinched closed, with side gussets 254 folded in, and positioned between panels 210*a* and 210*b* of the tamper-evident bag seal 200 when installed and in the sealed untampered with state, thereby sealing the top opening of bag 250 as well as its side gussets 254.

FIG. 23 illustrates the tamper-evident bag seal 200 of FIGS. 20-22 shown as installed on a bag 250 and in a partially unsealed and tampered evident state, with tear-away strip 220 partially removed/compromised.

FIG. 24 illustrates the tamper-evident bag seal 200 of FIGS. 20-22 shown as installed on a bag 250 in an unsealed and tampered evident state, with tear-away strip 220 fully removed/compromised and one or more of the vertical perforations 228 compromised.

With reference to FIGS. 28-33, in one non-limiting example, tamper-evident bag seal 300 may be made of paperboard or any other suitable material, and may be of varying thicknesses based on application. In one non-limiting example, tamper-evident bag seal 300 may be made of paperboard, and may be in the range of, but not limited to, about 0.012-inch thick (or any other suitable thickness). Tamper-evident bag seal 300 may include two panels or flaps 310 (e.g., 310*a*, 310*b*) divided by a fold 312. An opening 314 may be provided along fold 312 and at about the center of fold 312. An adhesive strip 316, such as, but not limited to, adhesive strips/beads, double sided tape, and/or other suitable adhesive technique, mechanism, and/or material may be provided on a bag facing side of each of the two panels or flaps 310.

Tamper-evident bag seal 300 may further include a tear-away strip 320. The tear-away strip 320 may be provided about midway of at least one of the two panels or flaps 310 and may extend horizontally along the length of the panel or flap 310 on which it is provided. The tear-away strip 320 may include certain inside and outside score cuts to facilitate a substantially smooth tear line. In one embodiment, tear-away strip 320 may include an inside pair of cut score lines 338 and an outside pair of cut score lines 340. In one example, inside cut score lines 338 form the side boundaries of the tear-away strip 320. Inside cut score lines 338 may each be flanked by an outside cut score line 340. In one example, outside cut score line 340 may be offset from its respective inside cut score line 338 by about, but not limited to, an ⅛ inch. The cut score lines 338 and outside pair of cut score lines 340 do not necessarily have to be a scored tear line, but rather could be any suitable technique, mechanism, and/or material for providing a weakened tear or separation lines.

Further, and referring now to a cross-section 31-31 of FIG. 31, inside cut score lines 338 may be cut about 50% through from the inside of the material. By contrast, outside cut score lines 340 may be cut about 50% through from the outside of the material. Inside cut score lines 338 and outside cut score lines 340 of tear-away strip 320 act to facilitate tearing as shown, for example, in FIG. 37, FIG. 38, and FIG. 46. Alternatively, tear-away strip portion 320 may be formed using a pair of 50% offset inside/outside perforation, score, or other weakened tear/separation lines disposed on either side of tear-away strip 320.

Tamper-evident bag seal 300 may further include vertical separation lines, such as vertical perforations 328, disposed along opposing end portions of at least one of the panels or flaps 310. The vertical perforations 328 may extend vertically from a bottom edge of its respective panel or flap 310 up to tear-away strip 320. In one example, the vertical perforations 328 may extend up to the outside cut score line 340 most proximate thereto. The vertical perforations 328 may be scored with score lines instead of perforated lines replacing the perforations. The vertical perforations 328 do not necessarily have to be a perforated or scored, but could be replaced with any suitable technique, mechanism, and/or material for providing a weakened tear/separation line. In one embodiment, the vertical perforations 328 would correlate with varied bag widths. In one example, when installed on a bag 350, respective vertical perforations 328 on opposing end portions of a panel or flap 310 would align with, or be slightly past, its respective outer edge of the bag 350. In one example, vertical perforations 328 are parallel with, and spaced a distance from one another. In one non-limiting example, tamper-evident bag seal 300 may include four (4) vertical perforations 328 spaced apart from one another on each of the opposing end portions of one or both of the panels or flaps 310 (e.g., on one or both of flaps 310*a* and/or 310*b*), for example, the vertical perforations 328 on each of the opposing end portions of their respective panel or flap 310 may be spaced in the range of, but not limited to, about ½ inch apart. The tamper-evident bag seal 300 is not limited to four (4) vertical perforations 328 on each opposing end portion of one or both of the panels or flaps 310, and in alternative embodiments may include less than or more than four (4) vertical perforations 328 on each opposing end portion of one or both of the panels or flaps 310. Further, the spacing between adjacent vertical perforations 328 is not limited to being in the range of about ½ inch apart, but could be spaced less than or more than ½ inch apart.

In one example, tamper-evident bag seal 300 may be foldable along fold 312, as shown for example in FIGS. 32 and 33.

In one non-limiting example, tear-away strip 320 may be provided about midway of flap 310*a*. In another non-limiting example, tear-away strip 320 may be provided about midway of flap 310*b*. In yet another non-limiting example, both flaps 310*a* and 310*b* include a tear-away strip 320. Further, tear-away strip 320 is not limited to being provided about midway of flap 310, but may be provided at any point thereon. For added strength, a length of tear strip backing (not shown, but substantially similar to that of tear strip backing 122) may be provided along tear-away strip 320 (e.g., along the bag facing side of tear-away strip 320). The tear strip backing may be formed, for example, of a thin cast polypropylene backing, such as, but not limited to, 2.35 mil poly material, a line of adhesive material, or any other suitable material. The tear strip backing may be provided as a reinforcing element for tearing tear-away strip 320, for example, to help tear-away strip 320 to be removed as a single continuous strip. In some embodiments, tamper-evident bag seal 300 may be absent tear strip backing.

Tamper-evident bag seal 300 may be provided as an add-on device to an existing bag that otherwise does not include a tamper-evident feature, such as bag 350 that does not otherwise include a tamper-evident feature. In one example, bag 350 may have bag handles 352. Bag handles 352 may be, for example, plastic, plastic rope, plastic ribbon, injection molded plastic, paper, rope, or other suitable type handles.

The tear-away strip 320 and/or vertical perforations 328 are the mechanism for gaining access to and fully opening bag 350, and wherein tear-away strip 320 and vertical perforations 328, are also the tamper-evident feature of tamper-evident bag seal 300, wherein when either or both of tear-away strip 320 and/or vertical perforations 328 are compromised the tamper-evident bag seal 300 is in a tamper-evident state.

Referring now to FIGS. 39-41 are plan views of non-limiting examples of different sized tamper-evident bag seals 300 for use with different sized bags. Generally, tamper-evident bag seal 300 may have an overall length L and an overall width W. Further, each panel or flap 310 may have a width w. Further, handle opening 314 may have a length 11 and a width w1. Adhesive strip 316 may be, for example, a strip or beads of adhesive material, double sided tape, 2 ply, 4 ply, or other suitable type tape, and/or other suitable adhesive technique, mechanism, and/or material, and may include a removable adhesive liner 330, such as, but not limited to calendared paper, or other suitable material, the removal of which may expose an adhesive layer of the adhesive strip 316. Additionally, the length of removable adhesive liner 330 and/or adhesive strip 316, may be greater than L, providing an extended portion 332. The extended portion 332 may extend a distance beyond at least one end of one or both of panels or flaps 310 of tamper-evident bag seal 300. In one non-limiting example, the length of the extended portion 332 of the removable adhesive liner 330 and/or adhesive strip 316 may be in the range of, but not limited to, about 0.25 inches. Having a length of removable adhesive liner 330 and/or adhesive strip 316, extending a distance beyond at least one end of one or both of panels or flaps 310 of tamper-evident bag seal 300, preferably allows a user to more easily grasp the extended portion 332 of the removable adhesive liner 330, for example, during installation to remove it thereby exposing the adhesive layer to allow the tamper-evident bag seal 300 to be sealed to a bag 350, as shown, for example, in FIG. 43A.

In the example shown in FIG. 39, tamper-evident bag seal 300 may be designed to fit on a bag about, but not limited to, 8-inches wide. In this example, tamper-evident bag seal 300 may have an overall length L of about, but not limited to, 10 inches and an overall width W of about, but not limited to, 6 inches. Further, each panel or flap 310 may have a width w of about, but not limited to, 3 inches. Further, handle opening 314 may have a length 11 of about, but not limited to, 4.25 inches and a width w1 of about, but not limited to, 0.375 inches. Further, removable adhesive liner 330 may, in one non-limiting example, have a width w2 in the range of, but not limited to, about 0.75 inches to about 1 inch, and adhesive strip 316 may have a width narrower than that of the removable adhesive liner 330.

Further, tear-away strip 320 may have a length substantially the same as that of the overall length of the tamper-evident bag seal 300, and may be in the range of, but not limited to, about ⅜ inches wide. The tear strip backing (if any) may be substantially about the same length as that of tear-away strip 320, and may be about, but not limited to, 0.125 inches wide. Further, in this example, an opposing pair of corresponding vertical perforations 328 would be space about 8-inches, or slightly more apart, such that they substantially align with the outside edges of the 8-inch wide bag 350.

In the example shown in FIG. 40, tamper-evident bag seal 300 may be designed to fit on a bag in the range of, but not limited to, about 10-inch to about 11-inch wide. In this example, the dimensions of tamper-evident bag seal 300 may be substantially the same as those described hereinabove with reference to FIG. 39 except that the overall length L may be in the range of, but not limited to, about 13 inches. Further, in this example, a first opposing pair of corresponding vertical perforations 328 may be space about 10-inches, or slightly more apart, and a second opposing pair of corresponding vertical perforations 328 may be space about 11-inches, or slightly more apart, such that they substantially align with the outside edges of the 10-inch or 11-inch wide bag 350, respectively.

In the example shown in FIG. 41, tamper-evident bag seal 300 may be designed to fit on a bag in the range of, but not limited to, about 12-inch to 14-inch wide. In this example, the dimensions of tamper-evident bag seal 300 are substantially the same as those described hereinabove with reference to FIG. 39 except that the overall length L may be in the range of, but not limited to, about 16 inches. Further, in this example, a first opposing pair of corresponding vertical perforations 328 may be space about 12-inches, or slightly more apart, and a second opposing pair of corresponding vertical perforations 328 may be space about 14-inches, or slightly more apart, such that they substantially align with the outside edges of the 12-inch or 14-inch wide bag 350, respectively.

Tamper-evident bag seal 300 is not limited to the examples shown in FIGS. 39-41. In other embodiments, tamper-evident bag seal 300 may, for example, be cut to length to more precisely fit any particular bag. The example dimensions of tamper-evident bag seal 300 shown in FIGS. 39-41 are exemplary only and are non-limiting. The components of the tamper-evident bag seal 300 may be provided with any dimensions, e.g., larger or smaller, than the examples listed above with regards to FIGS. 39-41, and tamper-evident bag seal 300 may be sized to fit on a bag smaller than 8 inches and/or larger than 14 inches.

As shown in FIGS. 34-36, the tamper-evident bag seal 300 may be installed on a bag 350, wherein the bag 350 preferably has a width less than the length of the tamper-evident bag seal 300. In such an example embodiment, when installed opposing overhanging end portions 336 of the tamper-evident bag seal 300 may be adhered to one another via adhesive strip 316. In this configuration, the top portion of bag 350 may be pinched closed, with side gussets 354 folded in, and positioned between panels 310*a* and 310*b* of the tamper-evident bag seal 300 when installed and in the sealed untampered with state, thereby sealing the top opening of bag 350 as well as its side gussets 354.

FIG. 37 illustrates the tamper-evident bag seal 300 of FIGS. 34-36 shown as installed on a bag 350 and in a partially unsealed and tampered evident state, with tear-away strip 320 partially removed/compromised.

FIG. 38 illustrates the tamper-evident bag seal 300 of FIGS. 36-39 shown as installed on a bag 350 in an unsealed and tampered evident state, with tear-away strip 320 fully removed/compromised and one or more of the vertical perforations 328 compromised.

In one embodiment, in operation, and referring now again to FIGS. 1-27, for a bag without handles such as bags 150, 250, the bag 150 or 250 may be provided, and may include some contents already inside (e.g., food) or some is added, and the tamper-evident bag seal 100, 200, respectively may be provided. A user may fold in the side gussets 154, 254 (if present) and pinch the top opening of bag 150, 250 closed. Tamper-evident bag seal 100, 200 may be placed over the top portion of bag 150, 250 and the outside side edges of bag 150, 250 may be aligned with corresponding ones of vertical perforations 128, 228, 328. Then tamper-evident bag seal 100, 200 may be folded at fold 112, 212, such that one flap 110, 210 (e.g., flap 110*a*, 210*a*) comes in contact with one outside side surface of bag 150, 250, and may be adhered thereto via the adhesive layer of adhesive strip 116, 216, and the other flap 110, 210 (e.g., flap 110*b*, 210*b*) may be folded down to come into contact with the other opposing outside side surface of bag 150, 250, and adhered thereto via the adhesive layer of adhesive strip 116, 216. Opposing overhanging portions 136, 236 of the flaps 110, 210 (110*a*, 210*a*) (110*b*, 210*b*) may also be brought in contact with one another and adhered together via the adhesive layer of adhesive strip 116, 216. Accordingly, tamper-evident bag seal 100, 200 is used to seal bag 150, 250, as shown for example in FIGS. 6-8 and 20-22. Prior to adhering the adhesive layer of adhesive strips 116, 216 to the outside side surfaces of the bag 150, 250 (and to one another along overhanging portions 136, 236), adhesive liner 130, 230 may be removed to expose the adhesive layer of adhesive strips 116, 216.

In another embodiment, in operation, and referring now again to FIGS. 28-41, for a bag with handles such as bag 350, the bag 350 may be provided, and may include some contents already inside (e.g., food) or some is added, and the tamper-evident bag seal 300 may be provided. A user may fold in the side gussets 354 (if present) and pinch the top opening of bag 350 closed. The bag handle(s) 352 of bag 350 may be brought together, and handle opening 314 of tamper-evident bag seal 300 may be fitted down over the bag handles 352 of bag 350. Tamper-evident bag seal 300 may be positioned over the top portion of bag 350 with outside side edges of bag 350 aligned with corresponding ones of vertical perforations 328. Then the tamper-evident bag seal 300 may be folded at fold 312, such that one flap 310 (e.g., flap 310*a*) comes in contact with one outside side surface of bag 350, and may be adhered thereto via the adhesive layer of adhesive strip 316, and the other flap 310 (e.g., flap 310*b*) may be folded down to come into contact with the other opposing outside side surface of bag 350, and adhered thereto via the adhesive layer of adhesive strip 316. Opposing overhanging portions 336 of the flaps 310 (310*a*, 310*b*) may also be brought in contact with one another and adhered together via the adhesive layer of adhesive strip 316. Accordingly, tamper-evident bag seal 300 is used to seal bag 350, as shown for example in FIGS. 34-36. Prior to adhering the adhesive layer of adhesive strips 316 to the outside side surfaces of the bag 350 (and to one another along overhanging portions 336), adhesive liner 330 may be removed to expose the adhesive layer of adhesive strips 316.

To open bag 150, 250, 350 a user may grasp one end of tear-away strip 120, 220, 320 and tear it away thereby removing/compromising the flap 110, 210, 310 on which the tear-away strip 120, 220, 320 is present. Once the tear-away strip 120, 220, 320 is removed, the user may tear the vertical perforations 128, 228, 328 that correspond with the width of bag 150, 250, 350 upon which the tamper-evident bag seal 100, 200, 300 is installed, thereby releasing the side gussets 154, 254, 354 (if present) and allowing them to be unfolded. The user may now unfold the side gussets 154, 254, 354 (if present) and fully open the top opening of the bag 150, 250, 350 and access the contents therein.

In an alternate embodiment, such as tamper-evident bag seal 100, 200 used with a handless bag, such as bag 150, 250, the tamper-evident bag seal 100, 200 may include a handle portion (not shown) formed therethrough in the area between the fold 112, 212 and adhesive strip 116, 216. Wherein the handle portion is configured to provide a handle for a user to grab and carry a bag 150, 250 that does not include a handle, such as bag handles 352 of bag 350. The rest of the tamper-evident bag seal 100, 200, in this alternative embodiment, would be substantially the same as described above.

In summary, tamper-evident bag seal 100, 200, 300 includes tear-away strip 120, 220, 320 and vertical perforations 128, 228, 328, which are the mechanism for opening bag 150 and for providing a visual indication of a tamper-evident condition. Namely, to open bag 150, 250, 350, with a tamper-evident bag seal 100, 200, 300 installed and sealed thereon, a user must tear away tear-away strip 120, 220, 320 and tear the appropriate vertical perforations 128, 228, 328. The compromised tear-away strip 120, 220, 320 and/or vertical perforations 128, 228, 328 provide easy visual evidence that bag 150, 250, 350 has been opened and/or tampered with. Accordingly, tear-away strip 120, 220, 320 and vertical perforations 128, 228, 328 provide the tamper-evident feature of bag 150, 250, 350 that otherwise does not include a tamper-evident feature.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A tamper-evident bag seal, comprising:
   a. a body having a length and a width, the body comprising a first panel and a second panel, the first and second panels each having a first side and second side;
   b. a fold line extending along the length of the body dividing the first panel and the second panel;
   c. a tear strip disposed along a length of at least one of the first panel and second panel;
   d. vertical separation lines disposed along opposing end portions of at least one of the first panel and second panel;
   e. a first adhesive strip disposed on the second side of the first panel and a second adhesive strip disposed on the second side of the second panel; and
   f. a first inside score line disposed along a length of a first side of the tear strip and a second inside score line disposed along a length of a second side of the tear strip, and a first outside score line offset from and extending a length of the first inside score line and a second outside score line offset from and extending a length of the second inside score line, wherein the first and second inside score lines are score lines partially cut through from the second side of the first and/or second panel upon which they are disposed, and the first and second outside score lines are score lines partially cut through from the first side of the first and/or second panel upon which they are disposed.

2. The tamper-evident bag seal of claim 1, wherein the first side of each of the first and second panel comprises an outward facing side and the second side of each of the first and second panel comprises a bag facing side, and wherein the first and second adhesive strips are configured to secure the second side of each of the first and second panels to respective first and second sides of a bag.

3. The tamper-evident bag seal of claim 1, wherein the tear strip further comprising a tear strip reinforcement backing, wherein the tear strip reinforcement backing comprises a length of backing material disposed along a backside of the tear strip.

4. The tamper-evident bag seal of claim 1, wherein one or both of the first adhesive strip and the second adhesive strip comprises a removable adhesive liner disposed atop an adhesive layer of the one or both of the first adhesive strip and the second adhesive strip, wherein removal of the removable adhesive liner exposes an adhesive layer of the adhesive strip.

5. The tamper-evident bag seal of claim 4, wherein the removable adhesive liner has a portion whose length is greater than the length of the body of the tamper-evident seal.

6. The tamper-evident bag seal of claim 1, wherein the vertical separation lines extend vertically between a bottom edge of its respective first panel or second panel and the tear strip.

7. The tamper-evident bag seal of claim 1, wherein the vertical separation lines comprise perforations.

8. The tamper-evident bag seal of claim 1, wherein the vertical separation lines comprise two or more vertical separation lines disposed along each opposing end portion of at least one of the first panel and second panel.

9. The tamper-evident bag seal of claim 8, wherein corresponding ones of vertical separation lines disposed on opposing end portions are spaced a distance substantially equal to that of a width of a bag upon which the tamper-evident bag seal is to be installed on.

10. The tamper-evident bag seal of claim 1, wherein the tear strip is disposed between the fold line and the first adhesive strip of the first panel.

11. The tamper-evident bag seal of claim 1, wherein the tear strip and vertical separation lines are disposed on a same one of the first panel or second panel.

12. The tamper-evident bag seal of claim 1, wherein the tear strip is disposed between the fold line and the second adhesive strip of the second panel.

13. The tamper-evident bag seal of claim 1, wherein the tamper-evident bag seal when installed on the bag and sealed thereon is configured to secure a contents of the bag therein, and wherein the contents of the bag cannot be accessed via the tamper-evident bag seal without causing the tamper-evident bag seal to indicate a tamper-evident condition.

14. The tamper-evident bag seal of claim 1, further comprising a tear line along either or both sides of the tear strip.

15. The tamper-evident bag seal of claim 1, wherein the first and second inside score lines form the side boundaries of the tear strip and the first and second outside score lines are offset a distance from and flank their respective first and second inside score lines.

16. The tamper-evident bag seal of claim 1, wherein the first and second inside score lines and the first and second outside score lines are parallel with one another.

17. The tamper-evident bag seal of claim 1, wherein the first and second inside score lines are score lines cut about 50% through from the second side of the first and/or second panel upon which they are disposed, and the first and second outside score lines are score lines cut about 50% through from the first side of the first and/or second panel upon which they are disposed.

18. The tamper-evident bag seal of claim 1, further comprising an opening provided along the first fold and disposed between the first panel and the second panel and substantially centered along the length of the body.

19. The tamper-evident bag seal of claim 18, wherein the opening is configured for receiving one or more handles of a bag therethrough.

20. A method of using a tamper-evident bag seal to secure an opening of a bag, comprising:

a. providing a tamper-evident bag seal, comprising;
   i. a body having a length and a width, the body comprising a first panel and a second panel, the first and second panels each having a first side and second side;
   ii. a fold line extending along the length of the body dividing the first panel and the second panel;
   iii. a tear strip disposed along a length of at least one of the first panel and second panel;
   iv. vertical separation lines disposed along opposing end portions of at least one of the first panel and second panel; and
   v. a first adhesive strip disposed on the second side of the first panel and a second adhesive strip disposed on the second side of the second panel;
   vi. a first inside score line disposed along a length of a first side of the tear strip and a second inside score line disposed along a length of a second side of the tear strip, and a first outside score line offset from and extending a length of the first inside score line and a second outside score line offset from and extending a length of the second inside score line, wherein the first and second inside score lines are score lines partially cut through from the second side of the first and/or second panel upon which they are disposed, and the first and second outside score lines are score lines partially cut through from the first side of the first and/or second panel upon which they are disposed;
b. positioning the tamper-evident bag seal about an opening of a bag, such that outer side edges of the bag, with side gussets folded in, are aligned with corresponding ones of the vertical separation lines;
c. folding the tamper-evident bag seal along the fold line such that the first adhesive strip and second adhesive strip come into contact with respective first and second outer sides of the bag; and
d. sealing the opening of the bag with the tamper-evident bag seal, thereby securing the contents within the bag.

21. The method of claim 20, wherein the first and second panels are adhered to respective first and second sides of the bag via the first and second adhesive strips, and wherein portions of the first and second panels that overhang a width of the bag are adhered together via the first and second adhesive strips.

22. The method of claim 20, further comprising a first inside score line disposed along a length of a first side of the tear strip and a second inside score line disposed along a length of a second side of the tear strip, and a first outside score line offset from and extending a length of the first inside score line and a second outside score line offset from and extending a length of the second inside score line, wherein the first and second inside score lines are score lines partially cut through from the second side of the first and/or second panel upon which they are disposed, and the first and second outside score lines are score lines partially cut through from the first side of the first and/or second panel upon which they are disposed.

23. The method of claim 20, wherein upon sealing the opening of the bag with the tamper-evident bag seal the contents of the bag cannot be accessed via the tamper-evident bag seal without causing the tamper-evident bag seal to indicate a tamper-evident condition.

24. A method of accessing contents of a bag secured with a tamper-evident bag seal installed thereon, comprising:

a. providing a bag with contents therein and a tamper-evident bag seal installed thereon, the tamper-evident bag seal, comprising;
   i. a body having a length and a width, the body comprising a first panel and a second panel, the first and second panels each having a first side and second side;
   ii. a fold line extending along the length of the body dividing the first panel and the second panel;
   iii. a tear strip disposed along a length of at least one of the first panel and second panel;

iv. vertical separation lines disposed along opposing end portions of at least one of the first panel and second panel; and v. a first adhesive strip disposed on the second side of the first panel and a second adhesive strip disposed on the second side of the second panel;

vi. a first inside score line disposed along a length of a first side of the tear strip and a second inside score line disposed along a length of a second side of the tear strip, and a first outside score line offset from and extending a length of the first inside score line and a second outside score line offset from and extending a length of the second inside score line, wherein the first and second inside score lines are score lines partially cut through from the second side of the first and/or second panel upon which they are disposed, and the first and second outside score lines are score lines partially cut through from the first side of the first and/or second panel upon which they are disposed;

b. removing the tear strip;

c. tearing corresponding ones of the vertical separation lines that are aligned with outer side edges of the bag;

d. unfolding the first panel or second panel of the tamper-evident bag seal that comprises the tear strip along the fold line;

e. unfolding side gussets of the bag and opening a top opening of the bag; and f. accessing the contents within the bag.

25. The method of claim 24, wherein the tamper-evident bag seal further comprises a first inside score line disposed along a first side of the tear strip and a second inside score line disposed along a second side of the tear strip, and a first outside score line offset from the first inside score line and a second outside score line offset from the second inside score line, wherein the first and second inside score lines are score lines partially cut through from the second side of the first and/or second panel upon which they are disposed, and the first and second outside score lines are score lines partially cut through from the first side of the first and/or second panel upon which they are disposed.

26. The method of claim 24, wherein the contents of the bag cannot be accessed via the tamper-evident bag seal without causing the tamper-evident bag seal to indicate a tamper-evident condition.

* * * * *